US009701323B2

(12) United States Patent
Manibharathi et al.

(10) Patent No.: US 9,701,323 B2
(45) Date of Patent: Jul. 11, 2017

(54) RAILCAR COUPLER

(71) Applicant: Bedloe Industries LLC, Wilmington, DE (US)

(72) Inventors: Roshan N. Manibharathi, Des Plaines, IL (US); Jerry R. Smerecky, South Barrington, IL (US); F. Andrew Nibouar, Chicago, IL (US); Corey M. Hudson, Warrenville, IL (US)

(73) Assignee: Bedloe Industries LLC, Wilmington, DE (US)

( * ) Notice: Subject to any disclaimer, the term of this patent is extended or adjusted under 35 U.S.C. 154(b) by 184 days.

(21) Appl. No.: 14/679,709

(22) Filed: Apr. 6, 2015

(65) Prior Publication Data

US 2016/0288806 A1 Oct. 6, 2016

(51) Int. Cl.
*B61G 3/08* (2006.01)
*B61G 3/06* (2006.01)

(52) U.S. Cl.
CPC *B61G 3/08* (2013.01); *B61G 3/06* (2013.01)

(58) Field of Classification Search
CPC ... B61G 3/00; B61G 3/02; B61G 3/04; B61G 3/06; B61G 3/08; B61G 3/10; B61G 3/12; B61G 3/14; B61G 3/16; B61G 3/18
See application file for complete search history.

(56) References Cited

U.S. PATENT DOCUMENTS 491,589 A 2/1893 Pooley
1,169,796 A 2/1916 Geddert
1,382,530 A 6/1921 Murphy
1,507,036 A 9/1924 Van Dorn
1,507,037 A 9/1924 Van Dorn
1,518,299 A 12/1924 Bazeley
1,525,566 A 2/1925 Bush et al.
1,564,400 A 12/1925 Averill
1,582,799 A 4/1926 Stewardson
1,604,335 A 10/1926 Baghurst et al.
1,606,896 A 11/1926 Reif
1,614,512 A 1/1927 Willison
1,629,351 A 5/1927 McConway, Jr
(Continued)

FOREIGN PATENT DOCUMENTS

AU 2009324267 A1 8/2010
BR 9602172 A 1/1998
(Continued)

OTHER PUBLICATIONS

Jul. 11, 2016—(PCT) International Search Report and Written Opinion—App PCT/US2016/026197.

*Primary Examiner* — R. J. McCarry, Jr.
(74) *Attorney, Agent, or Firm* — Banner & Witcoff, Ltd.

(57) ABSTRACT

A railcar coupler may include a coupler head comprising a shank and a head portion, the head portion defining a cavity for receiving a knuckle, a thrower, and a lock. The cavity can include a top pulling lug, a bottom pulling lug, and a thrower retaining lug. The top pulling lug can be configured to engage an upper knuckle pulling lug, and the bottom pulling lug being can be configured to engage a lower knuckle pulling lug. During operation of the railcar coupler, the ratio of the stress between the top pulling lug and the bottom pulling lug can be configured to be better balanced to help extend the life of the railcar coupler assembly.

27 Claims, 22 Drawing Sheets

(56) References Cited

U.S. PATENT DOCUMENTS 1,639,300 A 8/1927 Kinne
1,645,459 A 10/1927 Smith
1,647,302 A 11/1927 McConway, Jr. et al.
1,647,496 A 11/1927 Bazeley
1,696,040 A 12/1928 Kelso
1,698,991 A 1/1929 Dowling
1,703,598 A 2/1929 Richards
1,752,764 A 4/1930 Van Dorn
1,797,650 A 3/1931 George, Jr
1,869,713 A 8/1932 Regan
1,873,494 A 8/1932 Service
1,874,653 A 8/1932 Tatum
1,881,662 A 10/1932 Kelso
1,897,279 A 2/1933 Richards
1,919,305 A 7/1933 Richards
1,932,440 A 10/1933 Bazeley
1,945,362 A 1/1934 Bazeley
1,949,813 A 3/1934 Regan
1,954,578 A 4/1934 Service et al.
1,966,765 A 7/1934 Murphy
1,989,027 A 1/1935 Smith
2,000,435 A 5/1935 Bazeley
2,007,451 A 7/1935 Kinne
2,007,452 A 7/1935 Kinne
2,023,550 A 12/1935 Richards
2,083,422 A 6/1937 Bazeley
2,116,459 A 5/1938 Wolfe
2,116,817 A 5/1938 Akitt
2,148,364 A 2/1939 Barrows
2,162,390 A 6/1939 Rydin
2,167,613 A 7/1939 Kinne et al.
2,178,062 A 10/1939 Bazeley
2,183,501 A 12/1939 Kinne
2,209,365 A 7/1940 Van Dorn
2,214,003 A 9/1940 Van Dorn
2,214,036 A 9/1940 Van Dom
2,214,718 A 9/1940 Christianson
2,224,822 A 12/1940 Kinne
2,245,043 A 6/1941 Metzger
2,256,774 A 9/1941 Heimberger et al.
2,283,080 A 5/1942 Metzger
2,340,818 A 2/1944 Metzger
2,350,470 A 6/1944 Metzger
2,361,850 A 10/1944 Kinne
2,393,912 A 1/1946 Kayler
2,421,153 A 5/1947 Kinne
2,467,317 A 4/1949 Kayler
2,485,337 A 10/1949 Van Dorn
2,485,338 A 10/1949 Van Dorn
2,496,425 A 2/1950 Wolfe
2,498,958 A 2/1950 Kinne
2,498,959 A 2/1950 Kinne
2,533,940 A 12/1950 Johnson
2,562,203 A 7/1951 Metzger
2,562,504 A 7/1951 Metzger
2,568,312 A 9/1951 Wolfe
2,585,958 A 2/1952 Metzger
2,617,539 A 11/1952 Metzger
2,645,362 A 7/1953 Spence
2,646,176 A 7/1953 Wolfe
2,689,051 A 9/1954 Kayler
2,692,690 A 10/1954 Metzger
2,695,713 A 11/1954 Kayler
2,695,714 A 11/1954 Kayler
2,709,007 A 5/1955 Metzger
2,719,634 A 10/1955 Metzger
2,760,652 A 8/1956 Blattner
2,772,791 A 12/1956 Wolfe
2,797,821 A 7/1957 Blattner
2,801,755 A 8/1957 Kayler
2,812,075 A 11/1957 Metzger
2,832,477 A 4/1958 Metzger
2,866,560 A 12/1958 Metzger
2,881,837 A 4/1959 Staudt
2,881,927 A 4/1959 Furniss
2,919,038 A 12/1959 Metzger
2,922,532 A 1/1960 Metzger
2,931,518 A 4/1960 Metzger
2,948,414 A 8/1960 Metzger
2,948,415 A 8/1960 Metzger
2,948,416 A 8/1960 Metzger
3,086,662 A 4/1963 Metzger
3,114,461 A 12/1963 Livelsberger
3,146,895 A 9/1964 Livelsberger et al.
3,157,289 A 11/1964 De Penti
3,168,202 A 2/1965 Cope
3,334,822 A 8/1967 McIlvaine
3,387,716 A 6/1968 De Penti
3,572,518 A 3/1971 Wisler
3,670,901 A 6/1972 Metzger
3,698,570 A 10/1972 Metzger
3,722,708 A 3/1973 Ion et al.
3,767,062 A 10/1973 Holibaugh
3,831,777 A 8/1974 Kaufhold
3,833,131 A 9/1974 Altherr
3,850,311 A 11/1974 Kaufhold
3,850,312 A 11/1974 Baker, Sr.
3,853,228 A 12/1974 Metzger
3,854,599 A 12/1974 Day et al.
3,856,154 A 12/1974 DePenti
3,856,155 A 12/1974 Altherr
3,856,156 A 12/1974 Metzger
3,857,495 A 12/1974 Kaufhold
3,872,978 A 3/1975 Altherr
3,972,421 A 8/1976 DePenti
4,084,705 A 4/1978 Oshinsky et al.
4,090,615 A 5/1978 Martin
4,124,057 A 11/1978 Oshinsky
4,129,219 A 12/1978 Polanin
4,135,629 A 1/1979 Dilg et al.
4,146,143 A 3/1979 Schelle
4,172,530 A 10/1979 Altherr et al.
4,245,747 A 1/1981 Roberts
4,316,549 A 2/1982 Klimowicz
4,323,164 A 4/1982 Sutherland
4,363,414 A * 12/1982 Kaim ..... B61G 3/06
213/146
4,391,380 A 7/1983 Hoose
4,398,641 A 8/1983 Klimowicz
4,424,620 A 1/1984 Oshinsky
4,438,854 A 3/1984 Baughman et al.
4,438,855 A 3/1984 Altherr
4,466,546 A 8/1984 Altherr et al.
4,640,422 A 2/1987 Elliott
4,645,085 A 2/1987 Hanula et al.
5,305,899 A 4/1994 Kaufhold
5,415,303 A 5/1995 Hodges et al.
5,454,475 A 10/1995 Kaufhold
5,468,117 A 11/1995 Lobko et al.
5,481,986 A 1/1996 Spencer et al.
5,485,742 A 1/1996 Litten
5,507,400 A 4/1996 Long et al.
5,520,294 A 5/1996 Hanes
5,531,337 A 7/1996 Cappelletti et al.
5,573,126 A 11/1996 Beauclerc et al.
5,586,506 A 12/1996 Heubusch et al.
5,586,669 A 12/1996 Seay et al.
5,598,936 A 2/1997 Murphy
5,598,937 A 2/1997 Clark
5,617,965 A 4/1997 Hawryszkow
5,622,115 A 4/1997 Ehrlich et al.
5,642,823 A 7/1997 Kalina et al.
5,676,265 A 10/1997 Miller
5,685,228 A 11/1997 Ehrlich et al.
5,687,860 A 11/1997 Behrens et al.
5,704,499 A 1/1998 Wurzer et al.
5,730,063 A 3/1998 Forbes et al.
5,736,088 A 4/1998 Burke et al.
5,740,742 A 4/1998 Bush
5,743,191 A 4/1998 Coslovi
5,743,192 A 4/1998 Saxton et al.
5,762,214 A 6/1998 Bomgardner
5,775,524 A 7/1998 Dunham
5,785,192 A 7/1998 Dunham et al.

(56) References Cited

U.S. PATENT DOCUMENTS 5,794,537 A 8/1998 Zaerr et al.
5,809,898 A 9/1998 Kaufhold et al.
5,809,899 A 9/1998 Kaufhold et al.
5,823,371 A 10/1998 Riley et al.
5,826,735 A 10/1998 Litten
5,832,836 A 11/1998 Ehrlich et al.
5,832,839 A 11/1998 Forbes
5,833,086 A * 11/1998 Kaufhold ..... B61G 3/24 213/148
5,845,796 A 12/1998 Miller
5,865,122 A 2/1999 Hudson et al.
5,865,329 A 2/1999 Gay et al.
5,869,754 A 2/1999 Scott et al.
5,869,765 A 2/1999 Scott et al.
5,871,109 A 2/1999 Litten
5,876,018 A 3/1999 Crisp et al.
5,878,897 A 3/1999 Lazzaro et al.
5,890,608 A 4/1999 Hanes
5,906,164 A 5/1999 Bildtsen
5,927,521 A 7/1999 Downes et al.
5,927,522 A 7/1999 Carifa
5,931,322 A 8/1999 Storzek
5,943,964 A 8/1999 Downes et al.
5,952,566 A 9/1999 Scott et al.
5,954,211 A 9/1999 Grau et al.
5,954,212 A 9/1999 Beatty et al.
5,967,349 A 10/1999 Engelbrecht
5,979,335 A 11/1999 Saxton et al.
5,991,952 A 11/1999 Bintzler et al.
6,009,902 A 1/2000 Troiani et al.
6,017,098 A 1/2000 Kettle, Jr. et al.
6,024,233 A 2/2000 Natschke et al.
6,029,700 A 2/2000 Troiani et al.
6,030,244 A 2/2000 Buckheit et al.
6,044,771 A 4/2000 Nguyen
6,053,112 A 4/2000 Jones, Jr.
6,059,075 A 5/2000 Saxton et al.
6,062,406 A 5/2000 Duncan
6,067,485 A 5/2000 Balukin et al.
6,068,146 A 5/2000 Trent et al.
6,070,854 A 6/2000 Troiani et al.
6,077,005 A 6/2000 Westlake
6,085,608 A 7/2000 Santoro, Jr. et al.
6,089,268 A 7/2000 Troiani et al.
6,095,350 A 8/2000 Sauer et al.
6,095,618 A 8/2000 Heneka et al.
6,095,621 A 8/2000 Wood et al.
6,120,109 A 9/2000 Wood et al.
6,127,747 A 10/2000 Halvorson
6,135,665 A 10/2000 Alfieri et al.
6,138,579 A 10/2000 Khattab
6,148,733 A 11/2000 Gagliardino
6,148,965 A 11/2000 Forbes et al.
6,164,210 A 12/2000 Coslovi et al.
6,167,813 B1 1/2001 Kaufhold et al.
6,176,379 B1 1/2001 Daugherty, Jr.
6,189,714 B1 2/2001 Kettle, Jr. et al.
6,189,980 B1 2/2001 Kull
6,193,290 B1 2/2001 Barbara, Jr.
6,195,600 B1 2/2001 Kettle, Jr.
6,199,708 B1 3/2001 Monaco
6,199,709 B1 3/2001 Rossler
6,205,932 B1 3/2001 Khattab
6,206,214 B1 3/2001 de Koning et al.
6,206,215 B1 3/2001 Maa
6,216,604 B1 4/2001 Forbes et al.
6,220,502 B1 4/2001 Gallinger et al.
6,227,521 B1 5/2001 Scott et al.
6,233,806 B1 5/2001 Anderson et al.
6,234,702 B1 5/2001 Jeunehomme et al.
6,237,733 B1 5/2001 Kalina et al.
6,237,785 B1 5/2001 Daugherty, Jr.
6,249,722 B1 6/2001 Balukin et al.
6,257,680 B1 7/2001 Jacob
6,273,521 B1 8/2001 Halvorson et al.
6,273,670 B1 8/2001 Henson et al.
6,275,165 B1 8/2001 Bezos
6,276,058 B1 8/2001 Gallinger et al.
6,279,217 B1 8/2001 Gallinger et al.
6,279,765 B1 8/2001 Monaco
6,283,700 B1 9/2001 Oltrogge
6,290,079 B1 9/2001 Altherr
6,296,083 B1 10/2001 Forbes et al.
6,305,298 B1 10/2001 Kaufhold et al.
6,308,845 B1 10/2001 Sergent, IV
6,315,139 B1 11/2001 Kreher
6,321,922 B1 11/2001 Rumsey et al.
6,324,993 B1 12/2001 Jacob
6,352,400 B1 3/2002 Forbes
6,357,612 B1 3/2002 Monaco et al.
6,360,906 B1 3/2002 Kaufhold et al.
6,375,277 B1 4/2002 Carroll
6,379,213 B2 4/2002 Whitworth
6,389,984 B2 5/2002 Brandt
6,398,047 B1 6/2002 Ladendorf et al.
6,400,281 B1 6/2002 Darby, Jr. et al.
6,416,034 B1 7/2002 Sich
6,422,521 B1 7/2002 Tinklepaugh et al.
6,422,531 B1 7/2002 Sich
6,446,561 B1 9/2002 Khattab
6,446,820 B1 9/2002 Barker et al.
6,463,860 B1 10/2002 Sodder, Jr.
6,474,489 B2 11/2002 Payne et al.
6,484,644 B2 11/2002 Forbes et al.
6,488,163 B1 12/2002 Wurzer et al.
6,499,613 B1 12/2002 Grau et al.
6,505,564 B2 1/2003 Khattab
6,520,599 B2 2/2003 Wood et al.
6,525,647 B1 2/2003 Calamatas
6,539,878 B1 4/2003 Coslovi et al.
6,543,368 B1 4/2003 Forbes
6,550,399 B1 4/2003 Coslovi et al.
6,550,400 B1 4/2003 Forbes
6,551,039 B1 4/2003 Forbes
6,575,101 B2 6/2003 Blute et al.
6,575,102 B2 6/2003 Norton et al.
6,579,048 B2 6/2003 Al-Kaabi et al.
6,588,966 B2 7/2003 Kane et al.
6,591,470 B2 7/2003 Palmer, II
6,619,138 B2 9/2003 Kettle, Jr. et al.
6,619,491 B2 9/2003 Payne et al.
6,637,990 B2 10/2003 Al-Kaabi et al.
6,659,016 B2 12/2003 Forbes
6,659,017 B2 12/2003 Forbes
6,666,148 B1 12/2003 Coslovi et al.
6,669,237 B1 12/2003 Burch et al.
6,679,187 B2 1/2004 Dorian et al.
6,681,943 B2 1/2004 Barker et al.
6,688,482 B1 2/2004 Daugherty, Jr.
6,691,883 B1 2/2004 Daugherty, Jr.
6,705,478 B1 3/2004 Engle
6,712,231 B1 3/2004 Ernst et al.
6,722,287 B2 4/2004 Norton et al.
6,722,288 B2 4/2004 Beers
6,739,268 B2 5/2004 Al-Kaabi et al.
6,758,536 B2 7/2004 Jacob
6,758,919 B2 7/2004 Milligan
6,763,767 B2 7/2004 Jackson et al.
6,763,768 B2 7/2004 Hart et al.
6,776,299 B1 8/2004 Trescott
6,786,158 B2 9/2004 Jacob
6,796,448 B1 9/2004 Wilt et al.
6,805,251 B2 10/2004 Radewagen et al.
6,820,944 B2 11/2004 Wood et al.
6,821,065 B2 11/2004 Forbes
6,845,722 B2 1/2005 Forbes
6,845,874 B2 1/2005 Payne et al.
6,846,139 B2 1/2005 Al-Kaabi et al.
6,857,376 B2 2/2005 Coslovi et al.
6,863,086 B2 3/2005 Heiberger
6,866,452 B2 3/2005 Khattab et al.
6,867,708 B2 3/2005 Darby, Jr. et al.
6,871,600 B2 3/2005 Norton et al.
6,877,226 B2 4/2005 Khattab

(56) References Cited

U.S. PATENT DOCUMENTS 6,892,433 B2 5/2005 Barry et al.
6,895,866 B2 5/2005 Forbes
6,904,848 B2 6/2005 Norton et al.
6,915,746 B2 7/2005 Coslovi
6,920,828 B2 7/2005 Forbes
6,923,607 B2 8/2005 Al-Kaabi et al.
6,941,875 B2 9/2005 Norton et al.
6,944,925 B2 9/2005 Brueckert et al.
6,955,100 B1 10/2005 Barich et al.
6,968,788 B1 11/2005 Coslovi
6,976,432 B2 12/2005 Jacob
6,978,865 B2 12/2005 Fougere
6,983,702 B2 1/2006 Forbes
6,986,432 B2 1/2006 Limbach et al.
6,994,224 B2 2/2006 Barger et al.
7,004,079 B2 2/2006 Forbes
7,004,080 B2 2/2006 Creighton et al.
7,025,003 B2 4/2006 Khattab et al.
7,040,715 B2 5/2006 Wood et al.
7,044,062 B2 5/2006 Forbes
7,051,661 B2 5/2006 Herzog et al.
7,055,705 B2 6/2006 Sprave
7,070,062 B2 7/2006 Trescott
7,114,575 B2 10/2006 De Anda-Uribe et al.
7,121,212 B2 10/2006 Schorr et al.
7,150,368 B2 12/2006 Scott
7,177,732 B2 2/2007 Kraeling et al.
7,182,411 B2 2/2007 Levy et al.
7,188,513 B2 3/2007 Wilson
7,191,909 B2 3/2007 Heinisch et al.
7,210,413 B2 5/2007 Barry et al.
7,213,718 B2 5/2007 Ring
7,228,805 B2 6/2007 Beers et al.
7,234,904 B2 6/2007 Al-Kaabi et al.
RE39,777 E 8/2007 Forbes et al.
7,252,533 B1 8/2007 Lee et al.
7,255,047 B1 8/2007 Coslovi et al.
7,258,243 B2 8/2007 Ring et al.
7,261,044 B2 8/2007 Creighton et al.
7,263,931 B2 9/2007 Forbes
7,264,130 B2 9/2007 Sommerfeld et al.
7,267,059 B2 9/2007 Forbes
7,267,306 B2 9/2007 Eason et al.
7,275,893 B2 10/2007 Rexius et al.
7,302,944 B2 12/2007 Judson
7,305,923 B2 12/2007 Creighton et al.
7,328,871 B2 2/2008 Mace et al.
7,334,528 B2 2/2008 Khattab
7,337,826 B2 3/2008 Mautino et al.
7,360,979 B2 4/2008 Forbes
7,377,219 B2 5/2008 Brandt
7,401,559 B2 7/2008 Dawson et al.
7,410,069 B2 8/2008 Hogbring et al.
7,424,854 B2 9/2008 Forbes
7,434,519 B2 10/2008 Forbes et al.
7,461,600 B2 12/2008 Forbes et al.
7,469,939 B2 12/2008 Westman et al.
7,490,729 B2 2/2009 Mattschull et al.
7,494,309 B2 2/2009 Khattab et al.
7,497,171 B2 3/2009 Khattab
7,497,345 B2 3/2009 Brabb et al.
7,503,134 B2 3/2009 Buckner
7,513,376 B2 4/2009 Sprave
7,533,780 B2 5/2009 Daugherty, Jr.
7,536,957 B2 5/2009 Bush et al.
7,543,367 B2 6/2009 Beers et al.
7,546,807 B2 6/2009 Johnstone et al.
7,549,379 B2 6/2009 Monaco et al.
7,552,830 B2 6/2009 Radewagen
7,559,284 B2 7/2009 Forbes et al.
7,562,781 B2 7/2009 Kandoth-Kannoth et al.
7,568,584 B2 8/2009 Brough et al.
7,571,684 B2 8/2009 Forbes
7,588,154 B2 9/2009 Meyer et al.
7,591,621 B1 9/2009 Landrum et al.
7,603,954 B2 10/2009 Forbes
7,604,136 B2 10/2009 Kontetzki
7,619,506 B2 11/2009 Knoll et al.
7,665,622 B2 2/2010 Anderson et al.
7,670,090 B1 3/2010 Landrum et al.
7,681,507 B2 3/2010 Herzog et al.
7,686,177 B1 3/2010 Jackson
7,690,314 B2 4/2010 Clark et al.
7,694,834 B2 4/2010 Wolf et al.
7,699,008 B2 4/2010 Forbes
7,703,397 B2 4/2010 Forbes et al.
7,708,157 B2 5/2010 Kemper
7,717,290 B2 5/2010 Gerding
7,735,426 B2 6/2010 Creighton et al.
7,748,548 B1 7/2010 Ragsdale, Sr.
7,748,549 B1 7/2010 Browning
7,757,611 B2 7/2010 Forbes et al.
7,757,871 B2 7/2010 Mautino et al.
7,757,995 B2 7/2010 McKiernan
7,766,177 B2 8/2010 Stepp
7,770,847 B1 8/2010 Severson
7,775,385 B2 8/2010 Dudley
7,780,021 B2 8/2010 Forbes
7,780,022 B2 8/2010 Vermesi et al.
7,784,411 B2 8/2010 Forbes
7,789,023 B2 9/2010 Forbes
7,798,345 B2 9/2010 Krome
7,802,525 B2 9/2010 Dawson et al.
7,802,689 B2 9/2010 Kanjo
7,810,660 B1 10/2010 Dunham
7,814,842 B2 10/2010 Early
7,823,514 B2 11/2010 Forbes et al.
7,826,938 B2 11/2010 Kato et al.
7,837,045 B2 11/2010 Seitzberger et al.
7,837,046 B2 11/2010 Brewster
7,845,098 B1 12/2010 Huebner et al.
7,845,504 B2 12/2010 Davenport et al.
7,849,801 B2 12/2010 Dalrymple et al.
7,849,802 B2 12/2010 Dalrymple
7,850,128 B2 12/2010 Murphy
7,861,433 B2 1/2011 Saeler
7,861,659 B2 1/2011 Gillis et al.
7,866,267 B2 1/2011 Khattab
7,878,124 B2 2/2011 Low et al.
7,878,125 B2 2/2011 Forbes et al.
7,891,304 B2 2/2011 Herzog et al.
7,896,179 B2 3/2011 Hanaway
7,908,975 B2 3/2011 Forbes
7,913,865 B2 3/2011 Kontetzki
7,921,783 B2 4/2011 Forbes et al.
7,962,361 B2 6/2011 Ramchandani et al.
7,963,229 B2 6/2011 Timan
7,972,408 B2 7/2011 Bruso et al.
7,987,620 B2 8/2011 Huebner et al.
7,990,710 B2 8/2011 Hellriegel et al.
8,011,305 B2 9/2011 Al-Kaabi et al.
8,011,306 B2 9/2011 Forbes
8,025,014 B2 9/2011 Forbes et al.
8,047,140 B2 11/2011 Forbes et al.
8,049,608 B2 11/2011 Gaughan
8,056,741 B2 11/2011 Mautino et al.
8,061,277 B2 11/2011 Jacob
8,065,964 B2 11/2011 Forbes et al.
8,066,231 B2 11/2011 McKiernan
8,069,792 B2 12/2011 Shapery
8,070,108 B2 12/2011 Severson
8,074,818 B2 12/2011 Gerding
8,087,363 B2 1/2012 Clark et al.
8,091,717 B2 1/2012 Sprave et al.
8,096,431 B2 1/2012 Sprainis et al.
8,096,432 B2 1/2012 Sprainis et al.
8,113,752 B2 2/2012 Bullock
8,128,324 B2 3/2012 Bullock
8,132,515 B2 3/2012 Forbes et al.
8,136,683 B2 3/2012 Sprainis et al.
8,141,726 B2 3/2012 Forbes et al.
8,142,120 B2 3/2012 Landrum et al.
8,154,227 B1 4/2012 Young et al.
8,166,892 B2 5/2012 Forbes et al.

(56) References Cited

U.S. PATENT DOCUMENTS 8,167,251 B2 5/2012 Murphy et al.
8,172,045 B2 5/2012 Michel
8,177,463 B2 5/2012 Walker
8,186,525 B2 5/2012 Cui et al.
8,186,747 B2 5/2012 Bloodworth et al.
8,196,762 B2 6/2012 Smerecky
8,196,912 B2 6/2012 Carlstedt et al.
8,205,510 B2 6/2012 DiLuigi
8,220,175 B2 7/2012 Saeler
8,229,607 B2 7/2012 Hrdlicka et al.
8,229,787 B2 7/2012 Ramchandani et al.
8,230,792 B2 7/2012 Khattab
8,239,078 B2 8/2012 Siddappa et al.
8,249,763 B2 8/2012 Brooks et al.
8,250,989 B1 8/2012 Howell
8,250,991 B2 8/2012 Brandt
8,256,353 B1 9/2012 Howell
8,258,414 B2 9/2012 Toms
8,276,853 B2 10/2012 Murphy
8,297,454 B2 10/2012 Kolshorn et al.
8,297,455 B2 10/2012 Smyth
8,302,790 B2 11/2012 Dumey
8,302,791 B2 11/2012 Jiang et al.
8,328,030 B2 12/2012 Kontetzki
8,336,209 B2 12/2012 Sprainis et al.
8,342,105 B2 1/2013 Selapack et al.
8,348,074 B2 1/2013 Dahlstrom et al.
8,356,560 B2 1/2013 Forbes et al.
8,356,721 B1 1/2013 Jackson
8,365,674 B2 2/2013 Banwart
8,366,361 B1 2/2013 Landrum
8,370,006 B2 2/2013 Kumar et al.
8,376,160 B2 2/2013 Bomgardner et al.
8,393,359 B2 3/2013 Molaro et al.
8,397,925 B2 3/2013 Kataoka et al.
8,401,720 B2 3/2013 Daum et al.
8,403,607 B1 3/2013 Bullock
8,403,608 B1 3/2013 Bullock
8,403,609 B1 3/2013 Bullock
8,406,942 B2 3/2013 Siddappa et al.
8,408,406 B2 4/2013 Smerecky et al.
8,408,407 B2 4/2013 Nibouar et al.
8,408,852 B1 4/2013 Bullock
8,418,862 B2 4/2013 Liu et al.
8,418,863 B2 4/2013 Smerecky et al.
8,419,329 B1 4/2013 Bullock
8,430,192 B2 4/2013 Gillett
8,434,802 B2 5/2013 Lofley, Sr. et al.
8,464,881 B2 6/2013 Rieskamp
8,468,950 B2 6/2013 Wicks et al.
8,469,211 B2 6/2013 Meng et al.
8,479,660 B2 7/2013 Brandt
8,479,661 B2 7/2013 Forbes
8,485,371 B2 7/2013 Nibouar et al.
8,489,451 B2 7/2013 Ramchandani
8,496,128 B2 7/2013 Gagliardino
8,499,819 B2 8/2013 Nibouar et al.
8,500,378 B1 8/2013 Landrum et al.
8,529,174 B1 9/2013 Landrum et al.
8,534,475 B2 9/2013 Schipmann
8,540,093 B2 9/2013 Paral
8,544,662 B2 10/2013 Smerecky et al.
8,550,274 B2 10/2013 Gerding
8,560,211 B2 10/2013 Heverley, III
8,561,545 B2 10/2013 Donnelly
8,588,999 B2 11/2013 Hall et al.
8,589,001 B2 11/2013 Siddappa et al.
8,595,965 B2 12/2013 Sipperley et al.
8,596,203 B2 12/2013 Forbes et al.
8,596,475 B2 12/2013 Kobert et al.
8,600,590 B2 12/2013 Frazier et al.
8,600,804 B2 12/2013 Ramchandani et al.
8,602,231 B2 12/2013 Smith et al.
8,616,389 B2 12/2013 Peckham
8,622,004 B2 1/2014 Forbes et al.
8,627,772 B2 1/2014 Wicks et al.
8,631,952 B2 1/2014 Smerecky
8,640,631 B2 2/2014 Josephson et al.
8,646,631 B2 2/2014 Marchese et al.
8,655,521 B2 2/2014 Brooks et al.
8,659,472 B2 2/2014 Sai et al.
8,662,327 B2 3/2014 Nibouar et al.
8,672,151 B2 3/2014 Sprainis et al.
8,672,152 B2 3/2014 Nibouar et al.
8,674,534 B2 3/2014 Bodnar, Jr. et al.
8,684,199 B2 4/2014 Jiang et al.
8,695,818 B2 4/2014 Nibouar et al.
8,701,290 B2 4/2014 Sprainis et al.
8,701,566 B2 4/2014 Matsuoka et al.
8,708,625 B1 4/2014 Landrum et al.
8,714,377 B2 5/2014 Peckham
8,714,378 B2 5/2014 Maxeiner et al.
8,720,711 B2 5/2014 Nibouar et al.
8,739,705 B2 6/2014 Rezaei et al.
8,746,473 B2 6/2014 Smerecky et al.
8,746,474 B2 6/2014 Nibouar et al.
8,751,073 B2 6/2014 Kumar et al.
8,757,403 B2 6/2014 Yoshida et al.
8,768,543 B2 7/2014 Kumar et al.
8,770,113 B2 7/2014 Forbes
8,770,265 B2 7/2014 Nibouar et al.
8,781,671 B2 7/2014 Beck et al.
8,783,481 B2 7/2014 Nibouar et al.
8,783,670 B2 7/2014 Sprainis et al.
8,791,587 B2 7/2014 Smith, Jr. et al.
8,800,792 B2 8/2014 Westman et al.
8,807,047 B2 8/2014 Donnelly
8,833,094 B2 9/2014 Hellriegel et al.
8,833,269 B2 9/2014 Dawson et al.
8,834,082 B1 9/2014 Landrum et al.
8,838,303 B2 9/2014 Hatanaka
8,842,420 B2 9/2014 Driggers
8,842,430 B2 9/2014 Hellriegel et al.
8,855,839 B2 10/2014 Frazier et al.
8,857,573 B2 10/2014 Michel et al.
8,863,670 B2 10/2014 Jackson
8,869,708 B1 10/2014 Meyer
8,880,248 B2 11/2014 Frazier et al.
8,892,276 B1 11/2014 Young et al.
8,904,942 B2 12/2014 Herzog et al.
8,910,808 B2 12/2014 Halford et al.
8,915,193 B2 12/2014 Bis et al.
8,915,194 B2 12/2014 Creighton et al.
8,915,385 B2 12/2014 Hansson et al.
8,919,261 B2 12/2014 Blanco et al.
8,939,089 B2 1/2015 Hematian
8,939,300 B2 1/2015 Wilt et al.
8,947,207 B2 2/2015 Faroe et al.
8,950,606 B2 2/2015 Dunham
8,960,464 B2 2/2015 Peckham
8,967,053 B2 3/2015 Bis et al.
8,967,404 B2 3/2015 Sagawa et al.
8,973,508 B2 3/2015 Al-Kaabi et al.
8,978,260 B2 3/2015 Brueckert et al.
8,985,356 B2 3/2015 Krause et al.
8,985,525 B2 3/2015 Toms
8,997,657 B2 4/2015 Meister
9,002,548 B2 4/2015 Hrdlicka et al.
2003/0127412 A1 7/2003 Mautino et al.
2003/0160017 A1 8/2003 Wolinski et al.
2005/0011852 A1 1/2005 Fetterolf et al.
2005/0242053 A1 11/2005 Brabb et al.
2008/0110845 A1 5/2008 Edwards et al.
2009/0050594 A1 2/2009 Bui et al.
2010/0000877 A1 1/2010 Ameen et al.
2011/0049078 A1 3/2011 Meng et al.
2011/0163059 A1 7/2011 Gagliardino et al.
2011/0168655 A1 7/2011 Nibouar et al.
2011/0266242 A1 11/2011 Maxeiner et al.
2012/0097631 A1 4/2012 Gagliardino
2012/0175905 A1 7/2012 Mautino et al.
2012/0267492 A1 10/2012 Egerton
2012/0291980 A1 11/2012 Nibouar et al.
2012/0312768 A1 12/2012 Smerecky et al.

(56) References Cited

U.S. PATENT DOCUMENTS

| | | | |
|---|---|---|---|
| 2013/0025811 | A1 | 1/2013 | Nibouar et al. |
| 2013/0025815 | A1 | 1/2013 | Nibouar et al. |
| 2013/0160961 | A1 | 6/2013 | Smerecky et al. |
| 2013/0160962 | A1 | 6/2013 | Nibouar et al. |
| 2013/0168035 | A1 | 7/2013 | Nibouar et al. |
| 2013/0206716 | A1 | 8/2013 | Burgoyne et al. |
| 2013/0220961 | A1 | 8/2013 | Smith |
| 2013/0270210 | A1 | 10/2013 | Kukulski et al. |
| 2013/0277325 | A1 | 10/2013 | Hanaway |
| 2014/0110368 | A1 | 4/2014 | Wang |
| 2014/0116283 | A1 | 5/2014 | Steffen et al. |
| 2014/0217051 | A1 | 8/2014 | Brook et al. |
| 2014/0251937 | A1 | 9/2014 | Westman et al. |
| 2014/0284297 | A1 | 9/2014 | Peckham et al. |
| 2015/0014267 | A1 | 1/2015 | Creighton et al. |
| 2015/0017323 | A1 | 1/2015 | Ruebusch et al. |
| 2015/0069002 | A1 | 3/2015 | Stroud |
| 2015/0114921 | A1 | 4/2015 | Chen et al. |

FOREIGN PATENT DOCUMENTS

| | | | |
|---|---|---|---|
| BR | 8200586 | U | 12/2003 |
| BR | P10706036 | A2 | 3/2011 |
| BR | PI0706026 | A2 | 3/2011 |
| BR | PI0706029 | A2 | 3/2011 |
| BR | PI0706034 | A2 | 3/2011 |
| BR | PI0706035 | A2 | 3/2011 |
| BR | PI0616252 | A2 | 6/2011 |
| BR | PI0621076 | A2 | 11/2011 |
| BR | PI0719705 | A2 | 12/2013 |
| CA | 2116720 | A1 | 12/1994 |
| CA | 2121633 | A1 | 8/1995 |
| CA | 2122541 | A1 | 8/1995 |
| CA | 2137705 | A1 | 9/1995 |
| CA | 2153723 | A1 | 5/1996 |
| CA | 2156657 | A1 | 5/1996 |
| CA | 2173710 | A1 | 10/1996 |
| CA | 2171030 | A1 | 11/1996 |
| CA | 2157724 | A1 | 12/1996 |
| CA | 2177562 | A1 | 12/1996 |
| CA | 2184671 | A1 | 3/1997 |
| CA | 2186208 | A1 | 3/1997 |
| CA | 2175440 | A1 | 10/1997 |
| CA | 2175446 | A1 | 10/1997 |
| CA | 2204100 | A1 | 11/1997 |
| CA | 2209756 | A1 | 12/1997 |
| CA | 2180589 | A1 | 1/1998 |
| CA | 2194254 | A1 | 3/1998 |
| CA | 2194528 | A1 | 3/1998 |
| CA | 2224844 | A1 | 7/1998 |
| CA | 2283695 | A1 | 9/1998 |
| CA | 2284266 | A1 | 9/1998 |
| CA | 2202568 | A1 | 10/1998 |
| CA | 2227109 | A1 | 1/1999 |
| CA | 2227389 | A1 | 1/1999 |
| CA | 2246000 | A1 | 4/1999 |
| CA | 2301178 | A1 | 4/1999 |
| CA | 2233184 | A1 | 5/1999 |
| CA | 2248494 | A1 | 5/1999 |
| CA | 2252272 | A1 | 7/1999 |
| CA | 2236876 | A1 | 9/1999 |
| CA | 2237012 | A1 | 9/1999 |
| CA | 2238550 | A1 | 9/1999 |
| CA | 2241235 | A1 | 9/1999 |
| CA | 2241238 | A1 | 9/1999 |
| CA | 2242183 | A1 | 9/1999 |
| CA | 2260658 | A1 | 9/1999 |
| CA | 2267725 | A1 | 9/1999 |
| CA | 2322971 | A1 | 9/1999 |
| CA | 2323200 | A1 | 9/1999 |
| CA | 2324275 | A1 | 9/1999 |
| CA | 2239998 | A1 | 10/1999 |
| CA | 2274981 | A1 | 12/1999 |
| CA | 2243904 | A1 | 1/2000 |
| CA | 2243906 | A1 | 1/2000 |
| CA | 2277759 | A1 | 1/2000 |
| CA | 2251316 | A1 | 3/2000 |
| CA | 2280202 | A1 | 3/2000 |
| CA | 2257711 | A1 | 4/2000 |
| CA | 2261512 | A1 | 5/2000 |
| CA | 2266202 | A1 | 5/2000 |
| CA | 2289302 | A1 | 5/2000 |
| CA | 2289774 | A1 | 6/2000 |
| CA | 2283621 | A1 | 7/2000 |
| CA | 2292062 | A1 | 7/2000 |
| CA | 2271602 | A1 | 9/2000 |
| CA | 2367902 | A1 | 9/2000 |
| CA | 2395874 | A1 | 11/2000 |
| CA | 2377258 | A1 | 12/2000 |
| CA | 2311993 | A1 | 1/2001 |
| CA | 2312276 | A1 | 1/2001 |
| CA | 2388993 | A1 | 5/2001 |
| CA | 2317078 | A1 | 6/2001 |
| CA | 2317079 | A1 | 6/2001 |
| CA | 2326593 | A1 | 8/2001 |
| CA | 2334427 | A1 | 8/2001 |
| CA | 2343627 | A1 | 10/2001 |
| CA | 2326829 | A1 | 12/2001 |
| CA | 2313910 | C | 1/2002 |
| CA | 2352797 | A1 | 1/2002 |
| CA | 2317315 | A1 | 2/2002 |
| CA | 2317316 | A1 | 2/2002 |
| CA | 2352804 | A1 | 3/2002 |
| CA | 2355494 | A1 | 3/2002 |
| CA | 2366987 | A1 | 7/2002 |
| CA | 2334087 | A1 | 8/2002 |
| CA | 2343605 | A1 | 10/2002 |
| CA | 2381372 | A1 | 11/2002 |
| CA | 2381851 | A1 | 11/2002 |
| CA | 2363462 | C | 12/2002 |
| CA | 2421190 | A1 | 9/2003 |
| CA | 2384043 | A1 | 10/2003 |
| CA | 2459743 | C | 10/2003 |
| CA | 2760356 | A1 | 10/2003 |
| CA | 2540790 | C | 12/2003 |
| CA | 2429792 | A1 | 1/2004 |
| CA | 2449599 | C | 5/2004 |
| CA | 2454954 | C | 7/2004 |
| CA | 2492633 | C | 8/2004 |
| CA | 2516585 | C | 9/2004 |
| CA | 2489162 | C | 10/2004 |
| CA | 2428380 | A1 | 11/2004 |
| CA | 2433701 | A1 | 12/2004 |
| CA | 2433974 | C | 12/2004 |
| CA | 2525500 | C | 12/2004 |
| CA | 2526624 | C | 12/2004 |
| CA | 2534146 | C | 3/2005 |
| CA | 2483546 | A1 | 4/2005 |
| CA | 2484154 | A1 | 4/2005 |
| CA | 2484378 | A1 | 4/2005 |
| CA | 2545573 | C | 6/2005 |
| CA | 2783582 | | 6/2005 |
| CA | 2553001 | C | 8/2005 |
| CA | 2473940 | C | 9/2005 |
| CA | 2508361 | A1 | 12/2005 |
| CA | 2707736 | A1 | 2/2006 |
| CA | 2583728 | A1 | 5/2006 |
| CA | 2537008 | C | 8/2006 |
| CA | 2543027 | C | 10/2006 |
| CA | 2603663 | C | 10/2006 |
| CA | 2568871 | C | 11/2006 |
| CA | 2605513 | C | 1/2007 |
| CA | 2620670 | C | 6/2007 |
| CA | 2792435 | A1 | 6/2007 |
| CA | 2633261 | A1 | 7/2007 |
| CA | 2589665 | C | 1/2008 |
| CA | 2592404 | C | 1/2008 |
| CA | 2592405 | C | 1/2008 |
| CA | 2600815 | C | 3/2008 |
| CA | 2622344 | A1 | 6/2008 |
| CA | 2622557 | A1 | 6/2008 |
| CA | 2669899 | C | 6/2008 |
| CA | 2670769 | C | 6/2008 |
| CA | 2677604 | C | 8/2008 |

(56) References Cited

FOREIGN PATENT DOCUMENTS

| | | | |
|---|---|---|---|
| CA | 2625595 | C | 9/2008 |
| CA | 2628874 | C | 10/2008 |
| CA | 2682007 | A1 | 11/2008 |
| CA | 2682476 | C | 11/2008 |
| CA | 2684343 | C | 11/2008 |
| CA | 2684349 | C | 11/2008 |
| CA | 2684372 | C | 11/2008 |
| CA | 2684381 | A1 | 11/2008 |
| CA | 2684384 | C | 11/2008 |
| CA | 2684389 | A1 | 11/2008 |
| CA | 2705865 | A1 | 5/2009 |
| CA | 2643297 | C | 6/2009 |
| CA | 2710112 | A1 | 7/2009 |
| CA | 2725123 | A1 | 11/2009 |
| CA | 2725187 | A1 | 11/2009 |
| CA | 2725188 | A1 | 11/2009 |
| CA | 2725197 | A1 | 11/2009 |
| CA | 2755662 | A1 | 11/2009 |
| CA | 2755684 | A1 | 11/2009 |
| CA | 2725346 | A1 | 12/2009 |
| CA | 2730885 | A1 | 2/2010 |
| CA | 2666818 | C | 3/2010 |
| CA | 2667680 | C | 3/2010 |
| CA | 2669460 | C | 3/2010 |
| CA | 2736509 | A1 | 3/2010 |
| CA | 2736510 | A1 | 3/2010 |
| CA | 2691259 | A1 | 7/2010 |
| CA | 2707358 | A1 | 7/2010 |
| CA | 2707359 | A1 | 7/2010 |
| CA | 2748669 | A1 | 7/2010 |
| CA | 2573306 | C | 10/2010 |
| CA | 2702342 | A1 | 12/2010 |
| CA | 2771357 | A1 | 3/2011 |
| CA | 2729512 | A1 | 7/2011 |
| CA | 2786788 | A1 | 7/2011 |
| CA | 2785210 | A1 | 8/2011 |
| CA | 2803301 | A1 | 12/2011 |
| CA | 2749439 | A1 | 2/2012 |
| CA | 2758318 | A1 | 2/2012 |
| CA | 2808141 | A1 | 2/2012 |
| CA | 2784234 | A1 | 3/2012 |
| CA | 2826291 | A1 | 8/2012 |
| CA | 2785967 | | 10/2012 |
| CA | 2832702 | A1 | 11/2012 |
| CA | 2836548 | A1 | 11/2012 |
| CA | 2836552 | A1 | 11/2012 |
| CA | 2836553 | A1 | 11/2012 |
| CA | 2836571 | A1 | 11/2012 |
| CA | 2840741 | A1 | 2/2013 |
| CA | 2840767 | A1 | 2/2013 |
| CA | 2848390 | A1 | 3/2013 |
| CA | 2840834 | A1 | 4/2013 |
| CA | 2840835 | A1 | 6/2013 |
| CA | 2840838 | A1 | 7/2013 |
| CA | 2840840 | A1 | 7/2013 |
| CA | 2840841 | A1 | 7/2013 |
| CA | 2792096 | C | 8/2013 |
| CA | 2865958 | A1 | 9/2013 |
| CA | 2779516 | | 11/2013 |
| CA | 2820906 | C | 4/2014 |
| CA | 2889083 | A1 | 5/2014 |
| CN | 1333840 | A | 1/2002 |
| CN | 1697749 | A | 11/2005 |
| CN | 1272085 | C | 8/2006 |
| CN | 1842457 | B | 10/2006 |
| CN | 1293628 | C | 1/2007 |
| CN | 1902107 | A | 1/2007 |
| CN | 1329552 | A | 8/2007 |
| CN | 101065282 | A | 10/2007 |
| CN | 200977926 | Y | 11/2007 |
| CN | 101296810 | A | 10/2008 |
| CN | 201140718 | Y | 10/2008 |
| CN | 100431891 | C | 11/2008 |
| CN | 101346269 | A | 1/2009 |
| CN | 101356089 | A | 1/2009 |
| CN | 100457578 | C | 2/2009 |
| CN | 101384465 | A | 3/2009 |
| CN | 101432179 | A | 5/2009 |
| CN | 201235827 | Y | 5/2009 |
| CN | 101475012 | | 7/2009 |
| CN | 101495929 | A | 7/2009 |
| CN | 101535114 | A | 9/2009 |
| CN | 101600612 | A | 12/2009 |
| CN | 201362262 | Y | 12/2009 |
| CN | 101674968 | A | 3/2010 |
| CN | 101715402 | A | 5/2010 |
| CN | 101801759 | A | 8/2010 |
| CN | 101830236 | A | 9/2010 |
| CN | 101888944 | A | 11/2010 |
| CN | 201694200 | U | 1/2011 |
| CN | 101962024 | | 2/2011 |
| CN | 102007618 | A | 4/2011 |
| CN | 102036887 | A | 4/2011 |
| CN | 201808573 | U | 4/2011 |
| CN | 102083669 | A | 6/2011 |
| CN | 102083670 | A | 6/2011 |
| CN | 102083671 | A | 6/2011 |
| CN | 102083672 | A | 6/2011 |
| CN | 102083673 | A | 6/2011 |
| CN | 102105339 | A | 6/2011 |
| CN | 102159348 | A | 8/2011 |
| CN | 102159440 | A | 8/2011 |
| CN | 102171087 | A | 8/2011 |
| CN | 202006800 | U | 10/2011 |
| CN | 102292253 | A | 12/2011 |
| CN | 102348572 | A | 2/2012 |
| CN | 102575909 | A | 7/2012 |
| CN | 102712322 | A | 10/2012 |
| CN | 102740994 | A | 10/2012 |
| CN | 102741107 | A | 10/2012 |
| CN | 102803045 | B | 11/2012 |
| CN | 202541572 | U | 11/2012 |
| CN | 102892660 | B | 1/2013 |
| CN | 101678845 | B | 6/2013 |
| CN | 103167979 | A | 6/2013 |
| CN | 103298573 | A | 9/2013 |
| CN | 103328127 | A | 9/2013 |
| CN | 103328128 | A | 9/2013 |
| CN | 103328301 | A | 9/2013 |
| CN | 103328302 | A | 9/2013 |
| CN | 203255206 | U | 10/2013 |
| CN | 103442963 | A | 12/2013 |
| CN | 103492101 | A | 1/2014 |
| CN | 103492102 | A | 1/2014 |
| CN | 103547500 | A | 1/2014 |
| CN | 103625503 | A | 3/2014 |
| CN | 203485931 | U | 3/2014 |
| CN | 103889814 | A | 6/2014 |
| CN | 103998319 | A | 8/2014 |
| CN | 101678846 | B | 9/2014 |
| CN | 104023873 | A | 9/2014 |
| CN | 104024080 | A | 9/2014 |
| CN | 104029693 | A | 9/2014 |
| CN | 104039627 | A | 9/2014 |
| CN | 104105559 | A | 10/2014 |
| IN | 200701262 | P2 | 4/2007 |
| IN | 250898 | B | 6/2007 |
| IN | 200601657 | P4 | 6/2007 |
| IN | 200600734 | P1 | 8/2007 |
| IN | 200802018 | P1 | 7/2008 |
| IN | 200803472 | P1 | 7/2008 |
| IN | 200801181 | P4 | 9/2008 |
| IN | 200801185 | P4 | 9/2008 |
| IN | 200801317 | P4 | 11/2008 |
| IN | 200801318 | P4 | 11/2008 |
| IN | 200800521 | P3 | 6/2009 |
| IN | 200903931 | P1 | 11/2009 |
| IN | 200903918 | P2 | 2/2010 |
| IN | 200903969 | P2 | 2/2010 |
| IN | 200903970 | P2 | 2/2010 |
| IN | 200904010 | P2 | 3/2010 |
| IN | 200904012 | P2 | 3/2010 |
| IN | 201003245 | P1 | 11/2010 |
| IN | 201007488 | P4 | 8/2011 |

(56) References Cited

FOREIGN PATENT DOCUMENTS

| | | | |
|---|---|---|---|
| IN | 201007490 | P4 | 8/2011 |
| IN | 201007491 | P4 | 8/2011 |
| IN | 201007492 | P4 | 8/2011 |
| IN | 201007494 | P4 | 8/2011 |
| IN | 201007495 | P4 | 8/2011 |
| IN | 201205638 | P4 | 11/2013 |
| IN | 201206030 | P4 | 11/2013 |
| IN | 201309165 | P4 | 9/2014 |
| IN | 201309168 | P4 | 9/2014 |
| IN | 201309169 | P4 | 9/2014 |
| IN | 201303557 | P1 | 11/2014 |
| IN | 201311247 | P1 | 1/2015 |
| IN | 201311249 | P1 | 1/2015 |
| IN | 201311250 | P1 | 1/2015 |
| IN | 201311252 | P1 | 1/2015 |
| MX | 9604341 | | 8/1997 |
| MX | 9601139 | | 4/1998 |
| MX | 9604342 | | 5/1998 |
| MX | 9703056 | | 5/1998 |
| MX | 9704974 | | 5/1998 |
| MX | 9707927 | | 8/1998 |
| MX | 9706658 | | 10/1998 |
| MX | PA99010709 | | 3/2002 |
| MX | PA00003012 | | 4/2002 |
| MX | PA01002646 | | 4/2002 |
| MX | PA00012612 | | 6/2003 |
| MX | PA99002642 | | 6/2004 |
| MX | PA02004457 | | 7/2004 |
| MX | NL03000035 | | 10/2004 |
| MX | PA00006654 | | 10/2004 |
| MX | PA00006766 | | 6/2005 |
| MX | PA04012829 | | 6/2005 |
| MX | PA02004522 | | 8/2005 |
| MX | PA02012655 | | 8/2005 |
| MX | PA04009989 | | 9/2005 |
| MX | PA04009992 | | 9/2005 |
| MX | PA05003123 | | 10/2005 |
| MX | PA05009373 | | 11/2005 |
| MX | PA05005965 | | 3/2006 |
| MX | PA06002179 | | 5/2006 |
| MX | PA04009991 | | 9/2006 |
| MX | PA06002580 | | 9/2006 |
| MX | 2007001445 | A | 4/2007 |
| MX | 2007015314 | | 2/2008 |
| MX | 2007008600 | | 10/2008 |
| MX | 2007008692 | | 1/2009 |
| MX | 2007008694 | | 1/2009 |
| MX | 2007011196 | | 2/2009 |
| MX | 2009005989 | | 6/2009 |
| MX | 2009011718 | | 11/2009 |
| MX | 2009011719 | | 11/2009 |
| MX | 2009011720 | | 11/2009 |
| MX | 2009011721 | | 11/2009 |
| MX | 2009011723 | | 11/2009 |
| MX | 2009011725 | | 11/2009 |
| MX | 2009011728 | | 11/2009 |
| MX | 2009011729 | | 11/2009 |
| MX | 2009008366 | | 12/2009 |
| MX | 2009007062 | | 3/2010 |
| MX | 2009005758 | | 5/2010 |
| MX | 2009005759 | | 7/2010 |
| MX | 2011001159 | | 4/2011 |
| MX | 2011003004 | | 4/2011 |
| MX | 2010012717 | | 5/2011 |
| MX | 2010012719 | | 5/2011 |
| MX | 2010012721 | | 5/2011 |
| MX | 2010012722 | | 5/2011 |
| MX | 2010012724 | | 5/2011 |
| MX | 2010012726 | | 5/2011 |
| MX | 2011002758 | | 6/2011 |
| MX | PA99002091 | | 6/2011 |
| MX | 2010006639 | | 11/2011 |
| MX | 2011008663 | | 2/2012 |
| MX | 2012003427 | | 5/2012 |
| MX | 2012008812 | | 8/2012 |
| MX | 2012007736 | | 11/2012 |
| MX | 2012008104 | | 12/2012 |
| MX | 2012013181 | | 1/2013 |
| MX | 2012013213 | | 8/2013 |
| MX | 2013012451 | | 1/2014 |
| MX | 2013013524 | | 2/2014 |
| MX | 2013013525 | | 2/2014 |
| MX | 2013013526 | | 2/2014 |
| MX | 2013013527 | | 2/2014 |
| MX | 2013008910 | | 4/2014 |
| MX | 2013009331 | | 4/2014 |
| MX | 2014000241 | | 4/2014 |
| MX | 2014000243 | | 4/2014 |
| MX | 2014000246 | | 4/2014 |
| MX | 2014000248 | | 4/2014 |
| MX | 2014000250 | | 4/2014 |
| MX | 2014000252 | | 4/2014 |
| MX | 2014000244 | | 5/2014 |
| MX | 2014003187 | | 7/2014 |
| MX | 2014015038 | | 3/2015 |
| MX | 2014011082 | | 4/2015 |
| WO | 2009142750 | | 11/2009 |

* cited by examiner

RAILCAR COUPLER

FIELD

The present disclosure relates generally to the field of railcar couplers, and more specifically to distributing loads and stresses more evenly or better balanced over railcar coupler bodies to increase the wear life of coupler assemblies.

BACKGROUND

Railcar couplers can be placed on railway cars at each end to permit the connection of each end of a railway car to a next end of an adjacent railway car. However, due to in service loads, natural corrosion, and natural wear and tear after hundreds of thousands of miles on the rails, car coupler assemblies and the components that make up the assemblies will wear and/or crack and break in service over time. The main areas of wear and tear are the surfaces and components of the car couplers that are directly loaded. The coupler head of the coupler is adapted to support a knuckle, which is configured to interlock with an adjacent knuckle on an adjacent railcar. When in the locked position, the loads of the knuckle are primarily transferred directly to the coupler head through the top pulling lug and the bottom pulling lug. As a result, the top and bottom pulling lugs are loaded with the tractive effort of the entire train plus any additional dynamic forces and may experience wear more quickly than other components of the coupler.

SUMMARY

This Summary provides an introduction to some general concepts relating to this disclosure in a simplified form that are further described below in the Detailed Description. This Summary is not intended to identify key features or essential features of the disclosure.

Aspects of the disclosure herein relate to a railcar coupler that can include a coupler body with a shank and a head portion, the head portion may define a cavity for receiving a knuckle, a thrower, a lock, a lock lift assembly, and a pin. The cavity can include a top pulling lug, a bottom pulling lug, and a thrower retaining lug. The top pulling lug can be configured to engage an upper knuckle pulling lug, and the bottom pulling lug being can be configured to engage a lower knuckle pulling lug. During operation of the railcar coupler, the ratio of the stress between the top pulling lug and the bottom pulling lug can be configured to be better balanced to help extend the life of the railcar coupler assembly.

In one example, the top pulling lug and a bottom pulling lug in the coupler body can be configured to balance the loads transferred to the coupler head such that the loads and corresponding stresses between the upper pulling lug and the bottom pulling lug are substantially equal or more balanced. In one example, the top pulling lug and the bottom pulling lug can have substantially equal strengths and deformation rates to evenly distribute or receive loads to or from the upper knuckle pulling lug and the lower knuckle pulling lug to maintain the loads and stresses on the upper knuckle pulling lug and the lower knuckle substantially balanced.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

I. Detailed Description of Example Railcar Couplers

In the following description of various examples of railcar couplers and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "front," "back," "rear," "side," "forward," "rearward," "backward," "top," and "bottom" and the like may be used in this specification to describe various example features and elements of the disclosure, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the disclosure.

Figure 1A:
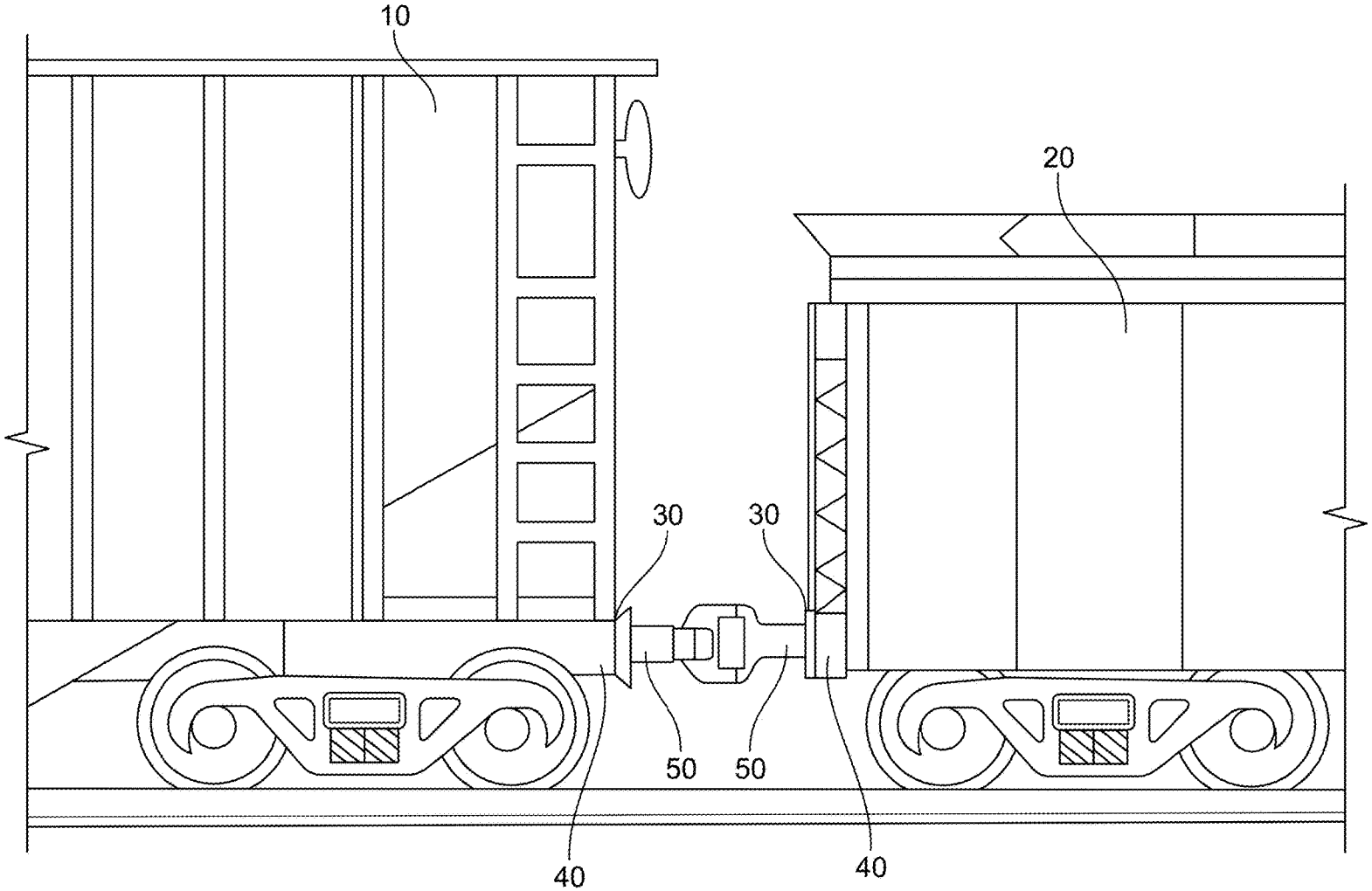
FIG. 1A shows a side perspective view of portions of two railroad cars.

FIG. 1A shows a side perspective view of portions of two railroad cars 10, 20 which can be connected by railcar coupler assemblies 50. The railcar coupler assemblies 50 can be mounted within a yoke 30, which can be secured at each end of the railway cars in center sills 40. The center sills 40 can form part of the railcars 10, 20.

Figure 1B:
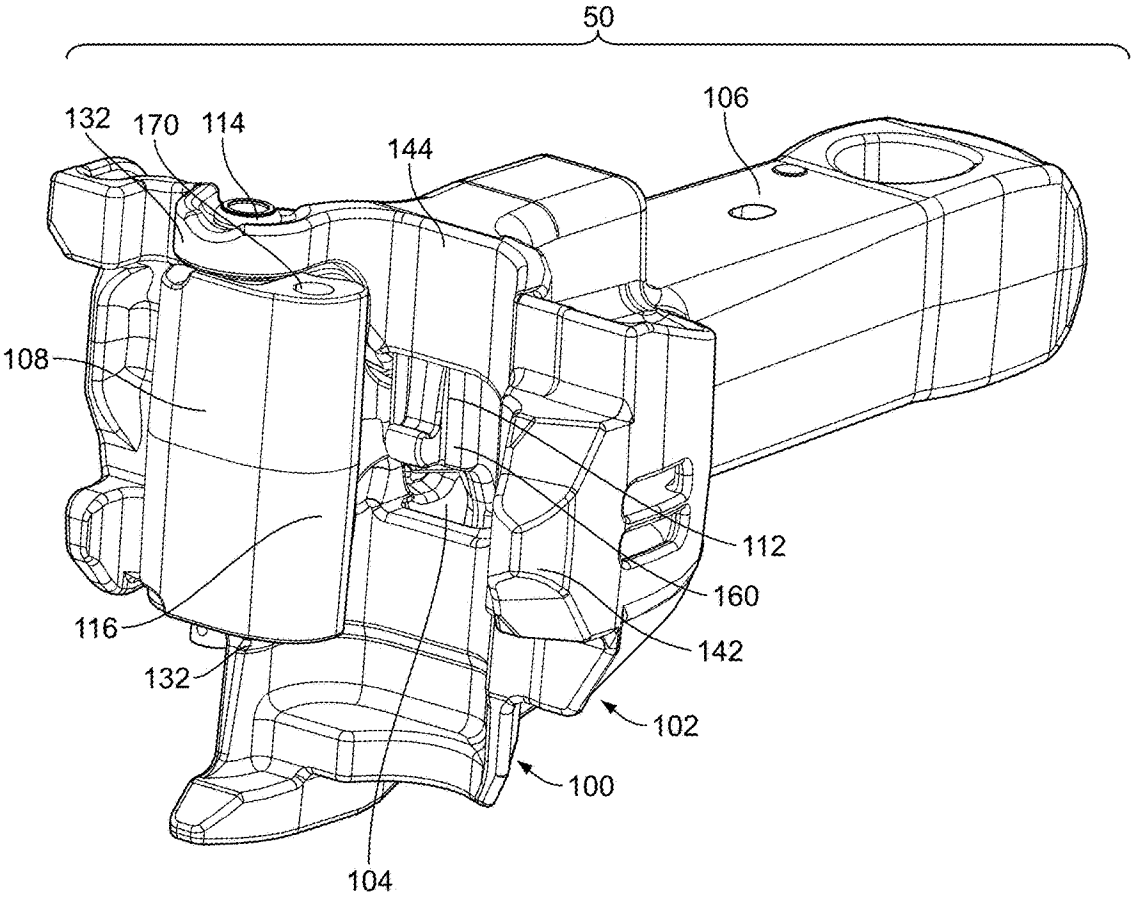
FIG. 1B shows a front right perspective of an example coupler assembly.

FIG. 1B shows a perspective view of a railcar coupler assembly 50. The railcar coupler assembly 50 is shown in a locked position and is configured to connect to another railcar coupler assembly. A Type F coupler head is illustrated in the accompanying Figs. However, the railway car coupler may be any known type of coupler. For example, the railway car coupler assembly 50 may be part of a Type E coupler, a Type H tightlock coupler, a Type EF coupler, or any other type of coupler.

As shown in FIG. 1B, a coupler body 100 can include a shank 106 and a coupler head 102. The coupler head 102 includes a guard arm 142 on which side can be referred to as the guard arm side of the coupler head 102. As shown in FIG. 1B, a knuckle 108 is received on the other side of the coupler head 102 from the guard arm 142, which can be referred to as the knuckle side of the coupler head 102. In addition, a front face 144 is located between the knuckle side and the guard arm side of the coupler head 102.

Figure 2A:
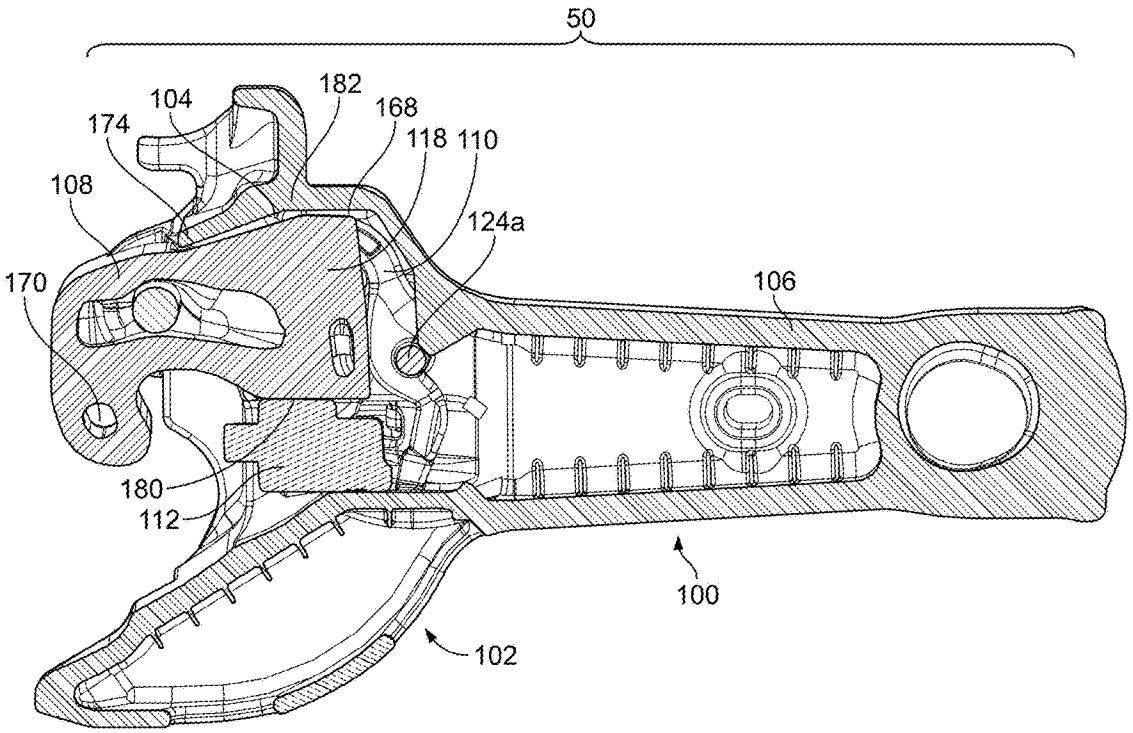
FIG. 2A shows a top view of a cross section of the example coupler assembly of FIG. 1B.

In the coupler head 102 lies a cavity 104, extending into the coupler head 102, which is configured to receive the knuckle 108 and a thrower 110 (as shown in FIG. 2A), which is configured to move the knuckle 108 from a locked position to an unlocked position. The cavity 104 also receives a lock 112 that can be configured to lock the knuckle 108 in a locked position and an unlocked position.

Figure 2B:
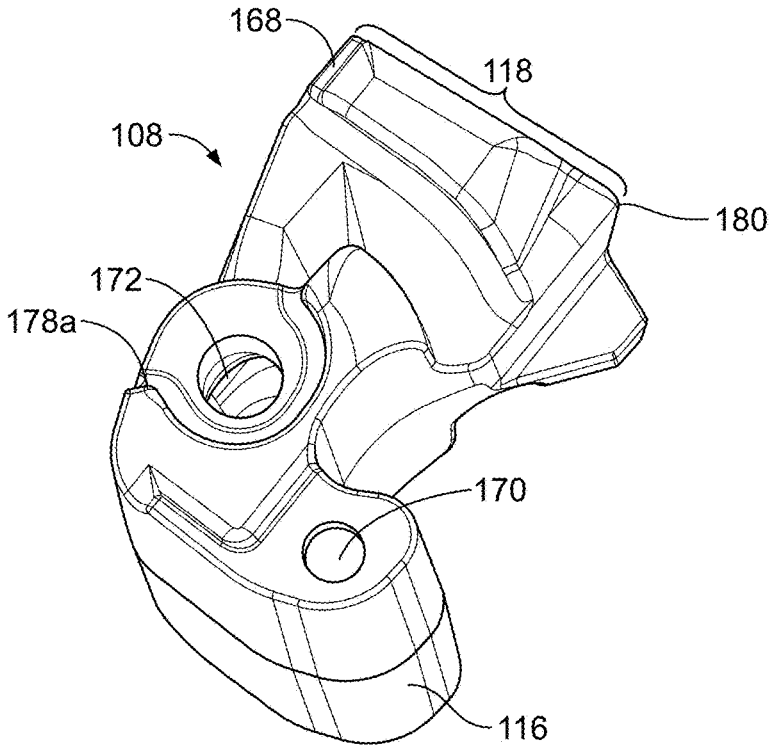
FIG. 2B shows a top perspective view of an example knuckle that can be used in conjunction with the example coupler of FIG. 1B.

The knuckle 108 is shown in various views in the Figs. FIGS. 1B, 2A, 3, and 4 show differing perspective and cross-sectional views of the coupler body 100 with the knuckle 108 in the locked position, and FIG. 2B shows a front perspective view of an example knuckle 108. As shown in FIG. 2B, the knuckle 108 can include a nose 116, a tail 118, a flag hole 170, and a pin hole 172. The knuckle 108 is configured to engage a correspondingly shaped knuckle on an adjacent railcar to join two railcars as depicted in FIG. 1A. Also, the nose 116, which is disposed transversely inwardly of pin 114 as seen in FIG. 1B, is configured to engage a knuckle on an adjacent railcar.

As shown in FIG. 1B, the knuckle 108 can be pivotally connected to the coupler head 102 by a vertical pin 114, which extends through the pin hole 172. As discussed in more detail below, the knuckle 108 is configured to rotate about the axis of the vertical pin 114 to move from the locked position to the unlocked position and from the unlocked position to the locked position.

The knuckle 108 is limited in its motion in the coupler body 100. As is shown in FIGS. 2A and 2B, the knuckle 108 can also include a tail stop 168 and a lockface 180, which maintain the position of the knuckle 108 in the coupler body 100 in the locked position. As can be seen in FIG. 2A, for example, when in the locked position, in buff (compression) the knuckle tail stop 168 contacts up against the corresponding contact point 182 on the coupler body 100. Whereas when in draft (tension), the knuckle's lockface 180 contacts the lock 112, which in turn contacts the lock face wall as shown in FIG. 2A, of the coupler body 100. Additionally, as shown in FIG. 2B, the knuckle 108 can be provided with rotational stops 178*a*, which provide a limit on the amount of rotation of the knuckle 108 in the coupler head 102. For example, in the unlocked position, in draft or as rotated by the thrower 110, the knuckle 108 opens fully and knuckle rotation stops 178*a* will contact body rotation stops 174 to limit how far the knuckle 108 is permitted to open.

Figure 3:
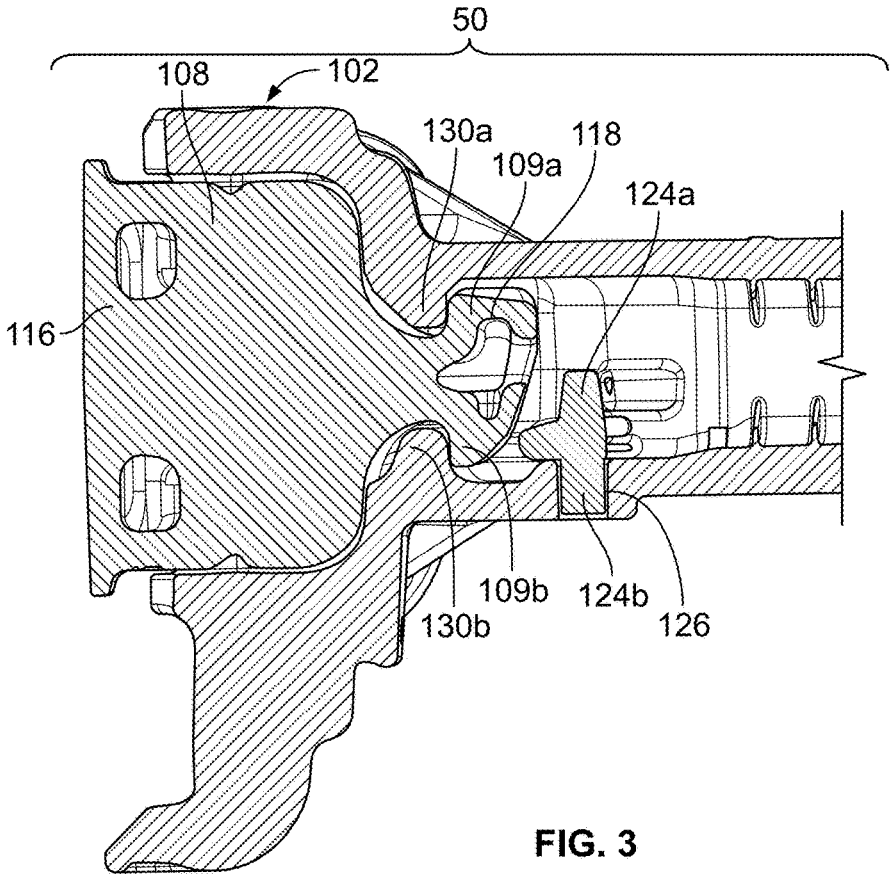
FIG. 3 shows a side view of a cross section of the example coupler assembly of FIG. 1B.

FIG. 3 shows a cross-sectional right side view of the coupler head with the knuckle 108 in the locked position. As is shown in FIG. 3, the knuckle 108 can also include a tail 118, which extends in a rearward direction of the nose 116 when the coupler body 100 is in the locked position. The tail 118 of the knuckle 108 can include an upper knuckle pulling lug 109*a* and a lower knuckle pulling lug 109*b*. As discussed herein, the upper knuckle pulling lug 109*a* and the lower knuckle pulling lug 109*b* are configured to engage a top pulling lug 130*a* and a bottom pulling lug 130*b* of the coupler head 102 body when the knuckle 108 is in the locked position.

Figure 4:
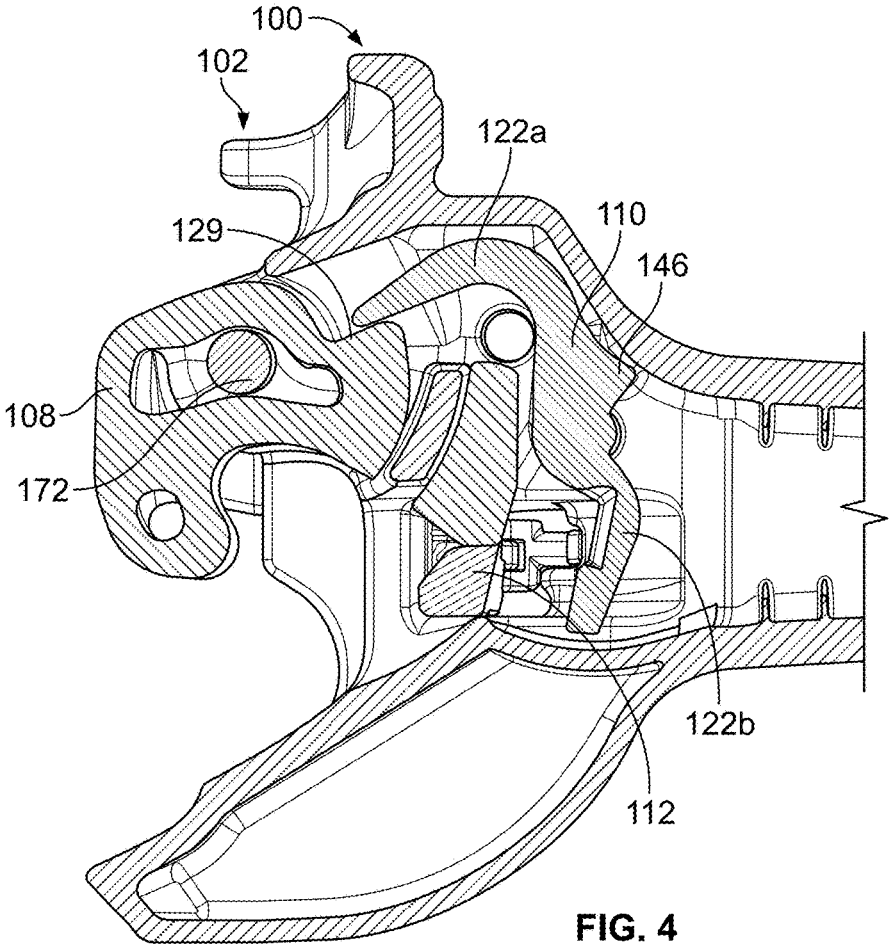
FIG. 4 shows a top view of another cross section of the example coupler assembly of FIG. 1B.

FIG. 4 shows a top cross-sectional view of the coupler head 102, which extends through the knuckle 108, and again shows the knuckle 108 in the locked position. As shown in FIG. 4, the knuckle 108 can include a thrower pad 129 for engaging the first leg 122*a* of the thrower 110. The thrower pad 129 allows the thrower 110 to move the knuckle 108 into the unlocked position.

The coupler head 102 is also shown in various Figs. herein. Referring again to FIG. 1B, pivot lugs 132 can be formed on the coupler head 102 to protect the vertical pin 114. As is shown in FIG. 3, in addition to housing the lock 112, the knuckle 108, and the thrower 110, the cavity 104 of the coupler head 102 can also include a top pulling lug 130*a* and a bottom pulling lug 130*b*. The pulling lugs 130*a* and 130*b* are configured to engage the upper and lower knuckle pulling lugs 109*a* and 109*b* of the knuckle 108, when the knuckle 108 is in the locked position. When coupled to an adjacent rail car, the engagement of the pulling lugs 130*a*, 130*b* and the knuckle pulling lugs 109*a*, 109*b* can allow the pulling lugs 130*a* and 130*b* to receive a transfer draft load from the corresponding knuckle of the adjacent coupler on the adjacent railcar.

The pulling lugs 130*a* and 130*b* can be designed such that the stresses placed on the coupler head 102 are more balanced across the upper and lower portions of the coupler body 100. In one example, the pulling lugs 130*a*, 130*b* are arranged such that the ratio of the stresses between the pulling lugs is less than 3 to 2. In one example, the ratio of the stresses between the top pulling lug 130*a* and the bottom pulling lug 130*b* can be approximately 1 to 1. Therefore, the ratio of the stresses can range from about 3:2 to 1:1 between the pulling lugs of the coupler body 100. The balancing of the stresses helps to decrease pulling lug stresses in the pulling lugs 130*a*, 130*b* and can assist in increasing the fatigue or wear life of the coupler head 102 and may also assist in increasing the fatigue life and/or wear life of the knuckle 108.

Figure 5:
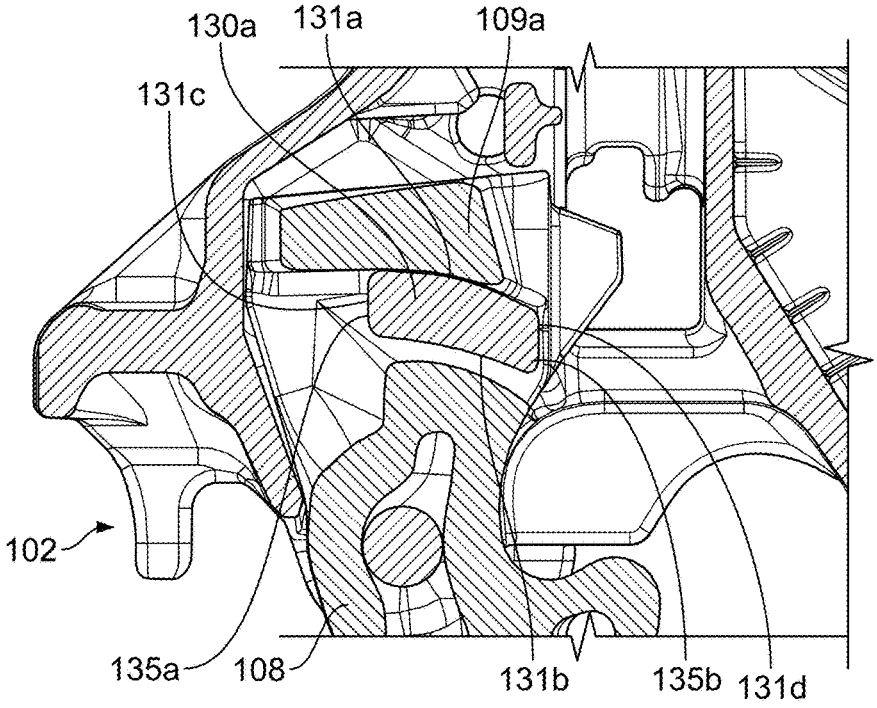
FIG. 5 shows a top view of a cross section of a portion of the example coupler assembly of FIG. 1B.

FIG. 5 shows a top cross-sectional view of the coupler head 102. In one example, to provide a uniform and low stress across the top pulling lug 130*a*, the top pulling lug 130*a* can be formed with a substantially constant thickness throughout its full width. As is shown in FIG. 5, the top pulling lug 130*a* has a substantially uniform thickness extending from a first end 135*a* to a second end 135*b* to assist in providing a uniform stress distribution across the top pulling lug 130*a*. Additionally, the top pulling lug 130*a* has a first end thickness and a second end thickness, and the first end thickness can be substantially equal to the second end thickness.

Also the top pulling lug 130*a* defines a first surface 131*a*, which is configured to engage the upper knuckle pulling lug 109*a* and an opposing second surface 131*b*. In one example, the first surface 131*a* and the second surface 131*b* of the top pulling lug 130*a* can define a first and second arcuate path where the first and second arcuate path can be substantially parallel in the same plane at a given height. Also as shown in FIG. 5, the first surface 131*a* arcuate path follows the surface of the top knuckle pulling lug 109*a* where the top knuckle pulling lug 109*a* contacts the top pulling lug 130*a*. Additionally as shown in FIG. 5, the top pulling lug 130*a* has a first end surface 131*c* and a second end surface 131*d* that extend substantially parallel to each other. Also, as is discussed below, the top pulling lug 130*a* can also be provided with varying thickness in its longitudinal direction such that the bottom cross sectional area is greater than distal cross-sectional area resulting in a partial frusto-conical like shape.

Figure 6A:
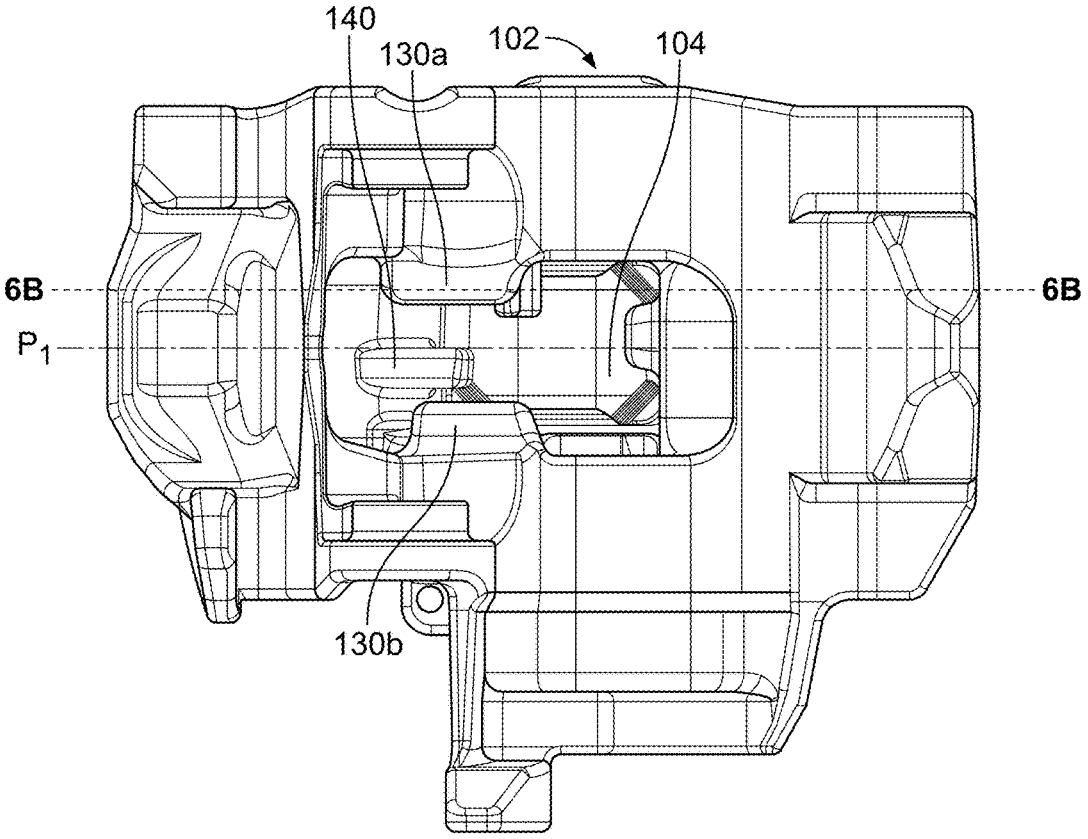
FIG. 6A shows another front perspective view of the example coupler body of FIG. 1B.
Figure 6B:
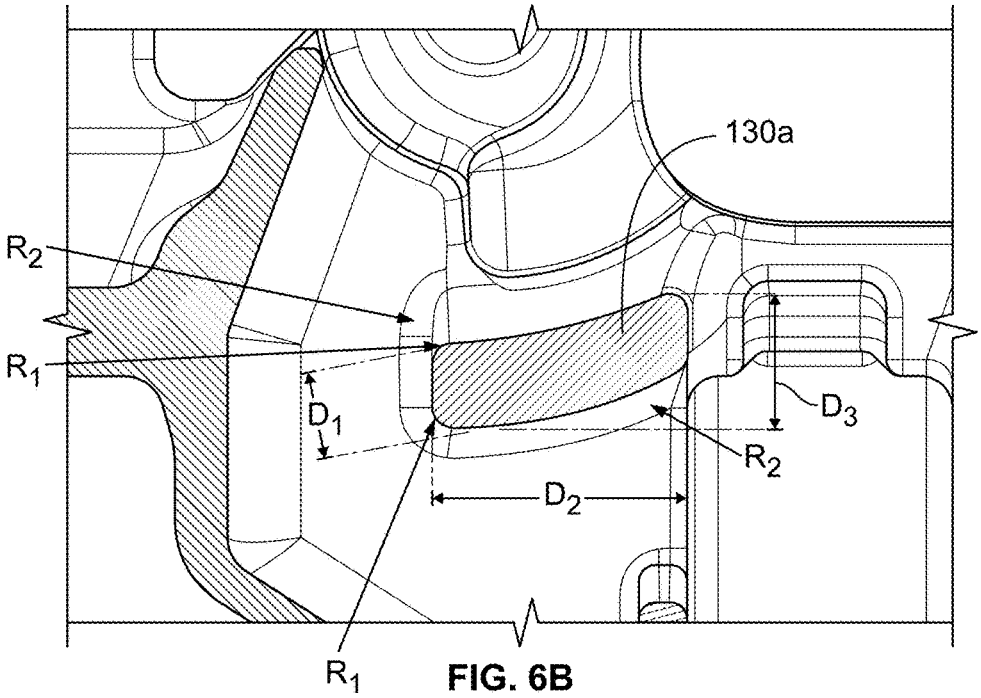
FIG. 6B shows a bottom view of a cross section along the line 6B of FIG. 6A.

FIG. 6A shows another front perspective view of the coupler head 102, and FIG. 6B shows a cross section of a portion of the coupler head 102 shown in FIG. 6A. In reference to FIGS. 6A and 6B, in one particular example, at a height 1.5 in. above the horizontal centerline plane $P_1$ of the coupler body 100, the top pulling lug 130*a* can have a substantially constant thickness $D_1$ which can range from 1 in. to 1.75 in., the linear length $D_2$ can range from 3 in. to 4 in., and the depth $D_3$ that extends from a front-most surface of the top pulling lug 130*a* to a rear-most surface of the top pulling lug 130*a* can range from 1 in. to 2 in. In one particular example, the top pulling lug 130*a* can have a substantially constant thickness $D_1$ which is substantially equal to 1.2 in. and overall linear length $D_2$ substantially equal to 3.5 in. or 3.6 in., and a depth $D_3$ substantially equal to 1.9 in. that extends from a front most surface of the top pulling lug 130*a* to a rearmost surface of the top pulling lug 130*a*. Also the four corner fillet radii $R_1$ can be substantially equal at the distal end of the top pulling lug 130*a* and in one example can be 0.3 in. Additionally, the base fillet radii $R_2$ of the top pulling lug 130*a* can be formed equal and, in one example, can be equal to 0.375 in.

Figure 7:
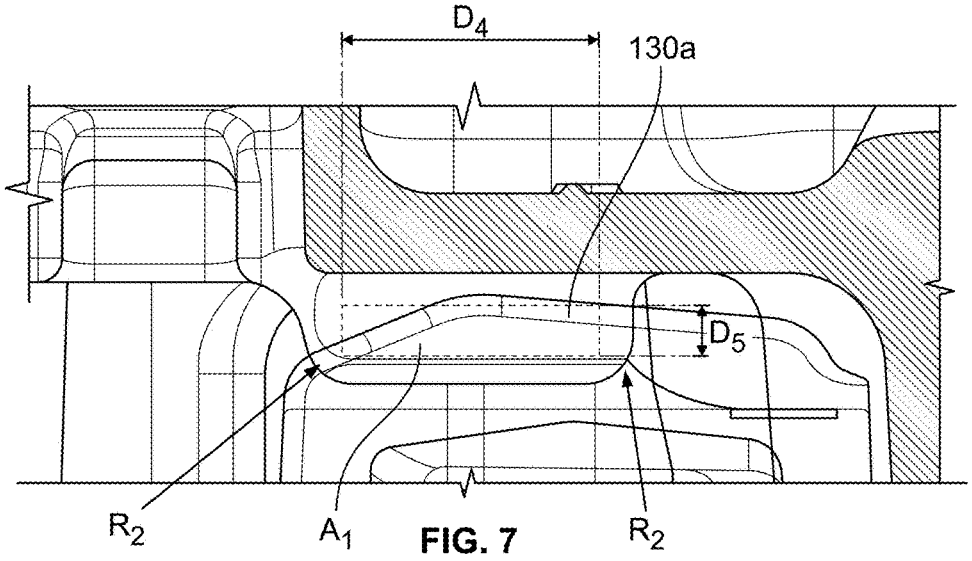
FIG. 7 shows front perspective view of a portion of the example coupler body of FIG. 1B.

Referring to FIG. 7, as shown by the dashed lines, the top pulling lug 130*a* defines a top pulling lug contact area $A_1$ where the upper knuckle pulling lug 109*a* contacts the top pulling lug 130*a*. In one example, the approximate arc length of the top pulling lug contact area can be approximately equal to 2.9 in., but can range from 2 in. to 3.5 in. In addition, the length $D_4$ of the top pulling lug contact area can range from 3 in. to 3.5 in., and the height $D_5$ of the top pulling lug contact area can be up to 0.75 in. In one example, the total top pulling lug contact area $A_1$ can be in the range of 1.25 $in^2$ to 2 $in^2$. In one particular example, the linear length $D_4$ of the top pulling lug contact area can be approximately equal to 2.8 in., and the height $D_5$ of the top pulling lug contact area can be approximately equal to 0.6 in. resulting in a total top pulling lug contact area $A_1$ of 1.7 $in^2$, however, in certain examples can be greater than 1.0 $in^2$. In one example, the ratio of the length $D_4$ to the height $D_5$ of the top pulling lug 130*a* can range between 4 to 1 and 5 to 1 and in more particular examples can be greater than 4 to 1 and can be substantially equal to or approximately 5 to 1.

Additionally as shown in FIG. 7, the distal end of the top pulling lug 130*a* can include equally sized fillets $R_2$ extending inwardly, which in one example can be approximately equal to 0.6 in. Also the height of the top pulling lug 130*a* can be approximately equal to 1.2 in., and the length of the top pulling lug 130*a* at its middle section can be approximately equal to 3.6 in. and approximately 4.3 in. at its base section.

Figure 7A:
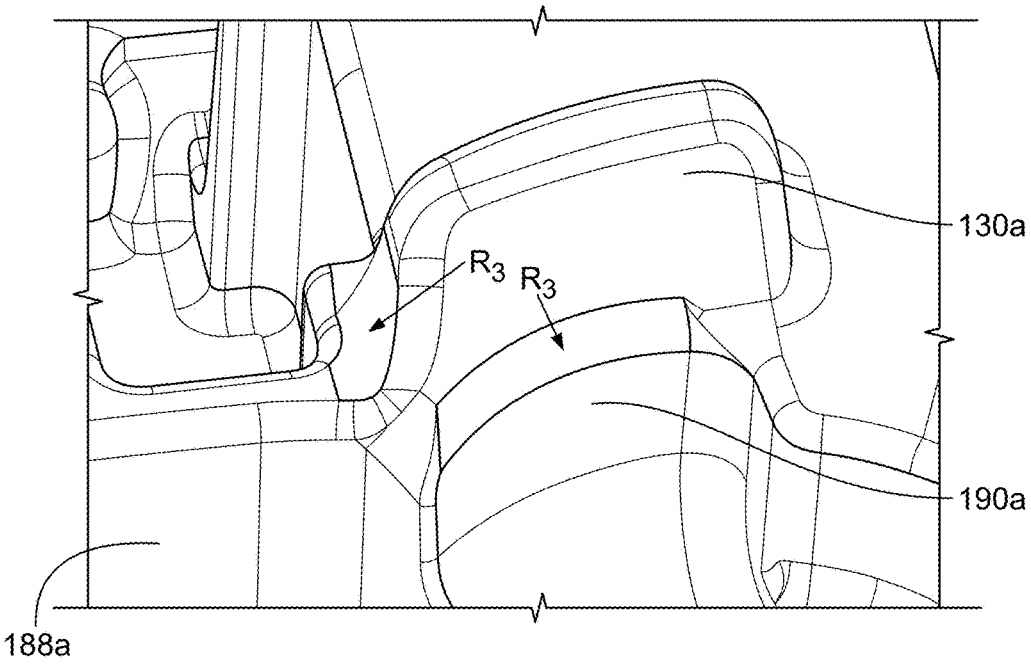
FIG. 7A shows a front bottom view of a portion of the coupler body of FIG. 1B.
Figure 7B:
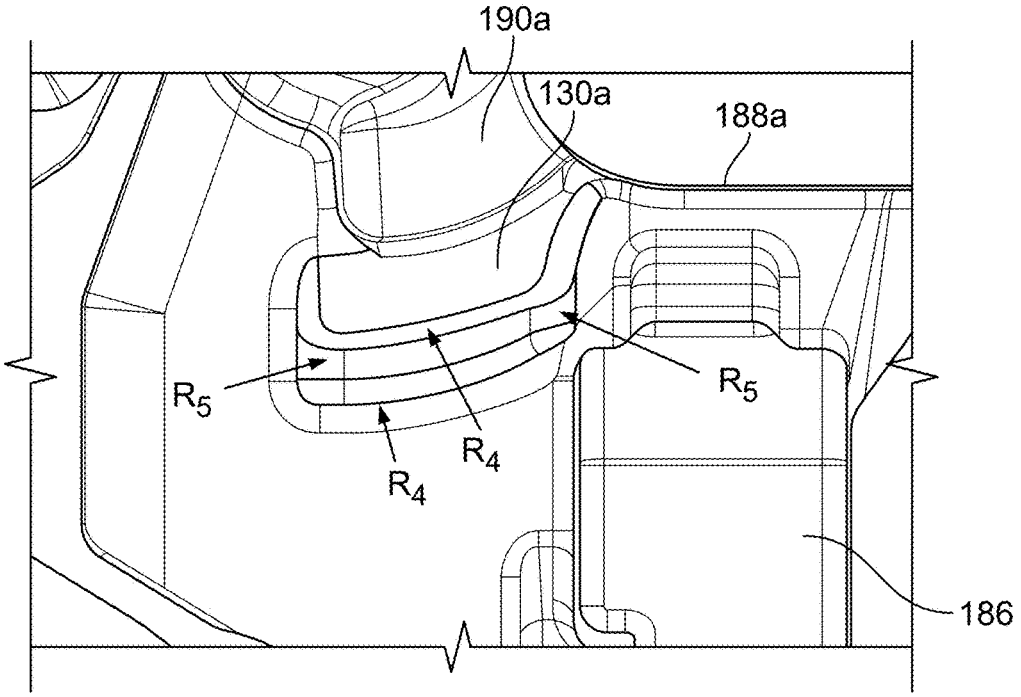
FIG. 7B shows a top perspective view of a portion of the coupler body of FIG. 1B.
Figure 7C:
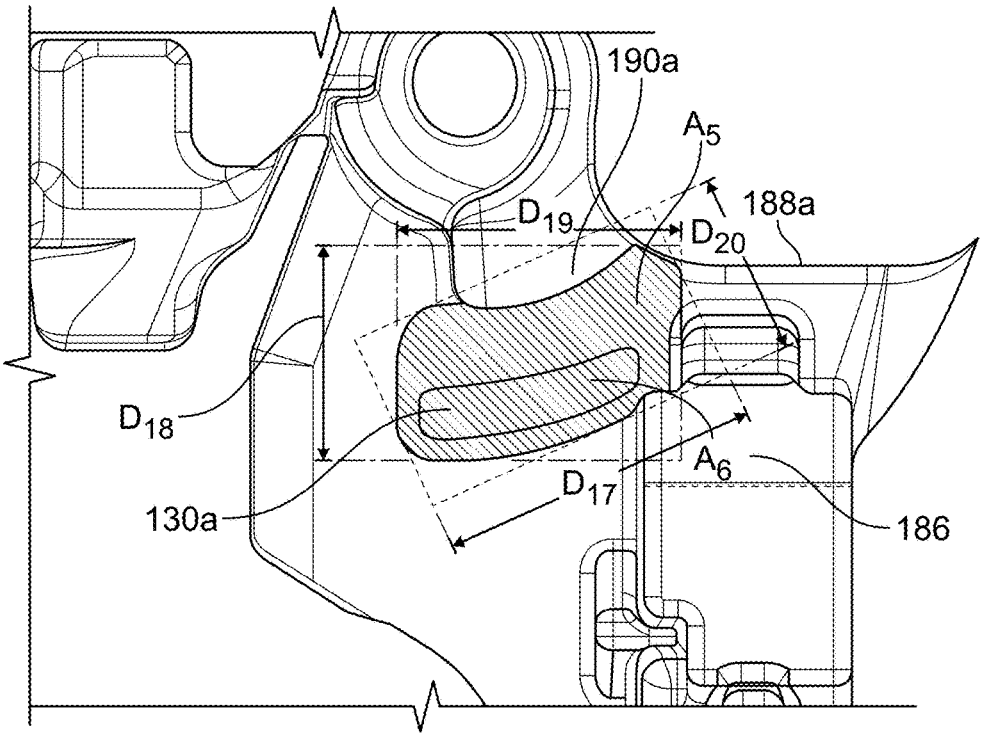
FIG. 7C shows another top perspective view of a portion of the coupler body of FIG. 1B.

FIGS. 7A-7C show various additional perspective views of the top pulling lug 130*a*. FIG. 7A shows a front bottom view of the top pulling lug 130*b*. As depicted in FIG. 7A, the non-contact side lock side fillet radius and the base non-contact side fillet radius $R_3$ can be formed equal to each other. In one example, the fillet radius, $R_3$ can range from 0.5 in. to 0.75 in., and in one particular example, the fillet radius $R_3$ can be equal to 0.6 in. FIG. 7B shows another bottom perspective view of the top pulling lug 130*a*. As shown in FIG. 7B, the fillet radii $R_5$ extending along the non-contact side and the contact side of the top pulling lug 130*a* can be formed equal and in one example can range from 0.2 in. to 0.4 in. In one particular example, the fillet radii $R_5$ extending along the non-contact side and the contact side of the top pulling lug 130*a* can equal 0.3 in. Also in one example, the two opposing fillet radii $R_4$ on the contact side and the non-contact side adjacent to the distal horizontal surface of the top pulling lug can be formed approximately equal to 0.4 in.

FIG. 7C shows another bottom view the top pulling lug 130*a*. As shown in FIG. 7C, the base of the top pulling lug 130*a* can be formed much larger than the distal end of the pulling lug 130*a*. As shown in FIG. 7B, the perimeter of the base of the top pulling lug 130*a* can be substantial in relation to the distal end of the pulling lug 130*a*. In one example, the perimeter of the base of the pulling lug 130*b* can be maximized by extending the base of the top pulling lug 130*a* to the lock hole 186, the upper buffing shoulder 190*a*, and the upper front face 188*a*.

Maximizing the perimeter of the base of the top pulling lug 130*a* also maximizes the base cross-sectional area $A_5$ of the top pulling lug 130*a*. In one example, the top pulling lug base cross-sectional area $A_5$ can range from 8 $in^2$ to 13 $in^2$. In one particular example, the top pulling lug base cross-sectional area $A_5$ can be approximately 11.2 $in^2$. Additionally, the cross-sectional area adjacent to the distal end $A_6$, which can be the cross-sectional area immediately below the distal fillets and radii, of the top pulling lug 130*a* can be formed smaller than the top pulling lug base cross-sectional area $A_5$. In one example, the cross-sectional area adjacent to the distal end $A_6$ of the top pulling lug 130*b* can be formed between 2 $in^2$ and 4 $in^2$, and in one particular example, the cross-sectional area adjacent to the distal end $A_6$ of the top pulling lug 130*b* can be approximately 3.1 $in^2$. Therefore, the ratio of the top pulling lug 130*a* base cross-sectional area $A_5$ to the cross-sectional area adjacent to the distal end $A_6$ of the top pulling lug 130*a* can be in the range of 2 to 5.5 or greater than 2.5 and in one particular example can be 3.6. Also as is shown in FIG. 7C, various dimensions $D_{17}$-$D_{20}$ can be maximized to maximize the base area and perimeter of the base area of the top pulling lug 130*b*. In one particular example, $D_{17}$ can be approximately 5.3 in., $D_{18}$ can be approximately 3.6 in., $D_{19}$ can be approximately 4.7 in., and $D_{20}$ can be approximately 3.0 in.

Figure 8:
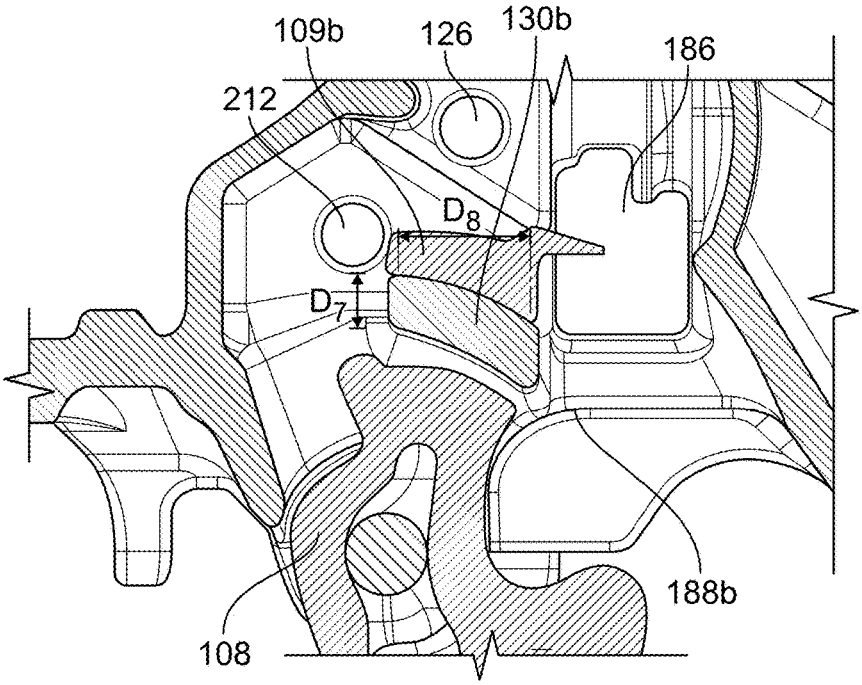
FIG. 8 shows a top view of a cross section of a portion of the example coupler assembly of FIG. 1B.

FIG. 8 shows a top cross-sectional view of the coupler head 102 showing the bottom pulling lug 130*b*. As shown in FIG. 8, like the top pulling lug 130*a*, the bottom pulling lug 130*b* can be designed to have a size, and in one example, a substantially uniform thickness to provide for a more uniform stress distribution in the coupler head 102. The example bottom pulling lug 130*b* has a substantially uniform thickness to provide a uniform stress distribution between the top pulling lug 130*a* and the bottom pulling lug 130*b*. In one example, the bottom pulling lug 130*b* has a substantially constant thickness throughout the full width of the bottom pulling lug 130*b*, which provides a uniform and low stress across the bottom pulling lug 130*b*.

Figure 9A:
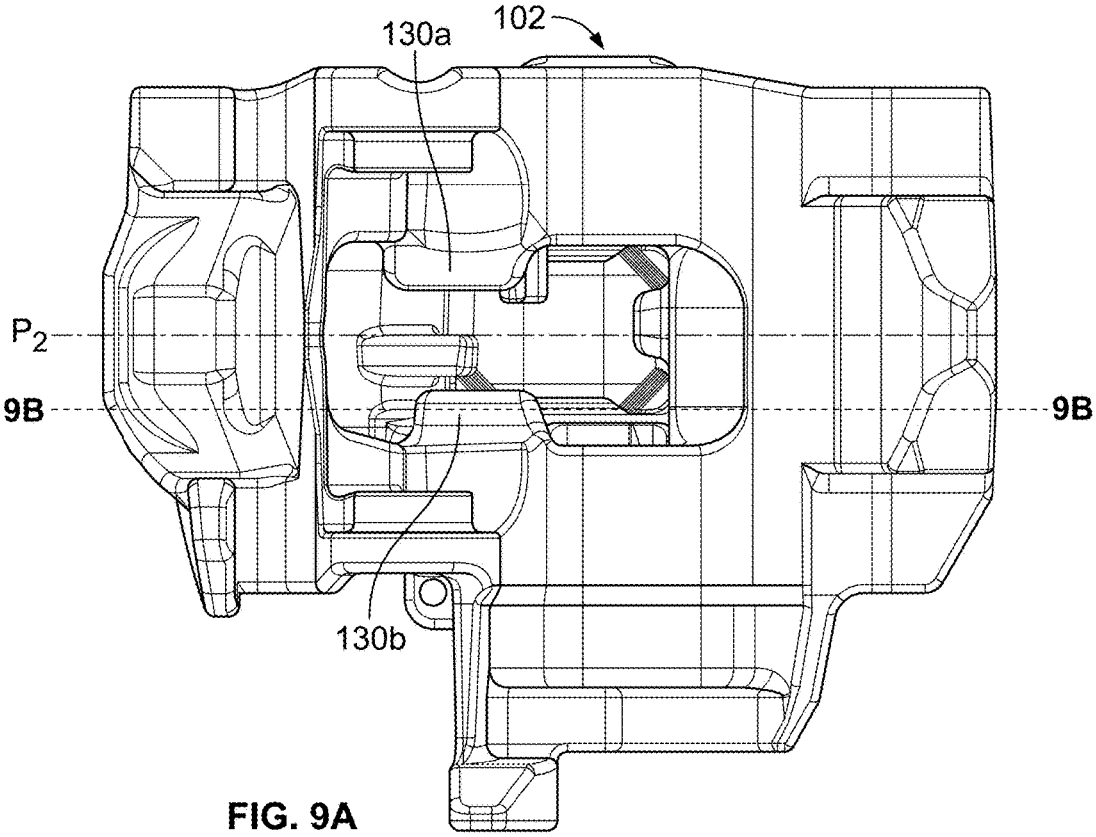
FIG. 9A shows another front perspective view of the example coupler body of FIG. 1B.
Figure 9B:
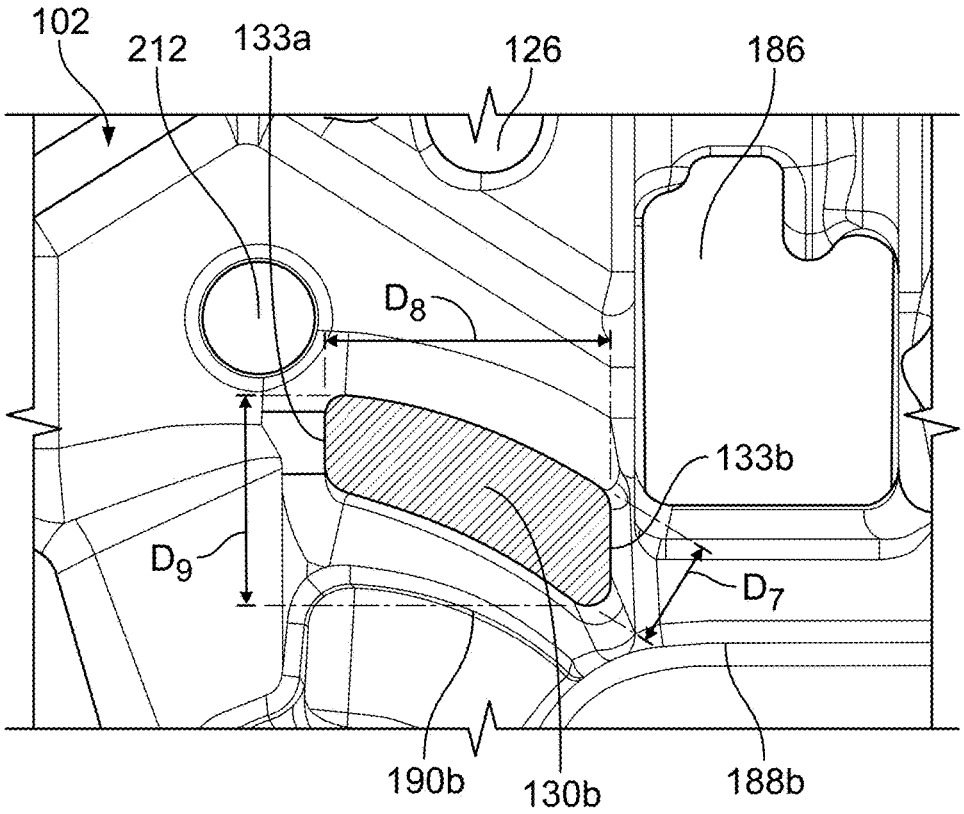
FIG. 9B shows a top view of a cross section along the line 9B in FIG. 9A.

FIG. 9A shows another front perspective view of the coupler head 102, and FIG. 9B shows a cross section of a portion of the coupler head 102 along the line 9B shown in FIG. 9A. In reference to FIGS. 9A and 9B, in one example, at a height 1.9 in. below the horizontal centerline plane $P_2$ of the coupler body 100, the bottom pulling lug 130*b* can have a substantially constant thickness $D_7$ ranging from 1.0 to 1.5 in., which extends in a transverse direction and an overall length $D_8$ ranging from 2.25 in. to 3.25 in. and a depth $D_9$ ranging from 2.0 in. to 2.5 in. that extends from a front-most surface of the bottom pulling lug 130*b* to a rear-most surface of the bottom pulling lug 130*b*. This can allow more contact with the lower knuckle pulling lug 109*b* and better distributes stresses when the coupler body 100 is in draft. Additionally, the bottom pulling lug 130*b* can be formed with a first end 133*a* and a second end 133*b*, and the second end 133*b* can be formed larger than the first end 133*a*.

In one particular example, the bottom pulling lug 130*b* has a thickness $D_7$ approximately equal to 1.2 in. and an overall length $D_8$ approximately equal to 2.6 in., and a depth $D_9$ approximately equal to 2.3 in. that extends from a front most surface of the bottom pulling lug 130*b* to a rearmost surface of the bottom pulling lug 130*b*. In another example, the bottom pulling lug 130*b* has a substantially constant thickness $D_7$ approximately equal to 1.2 in. and an overall length $D_8$ approximately equal to 3.2 in., and a depth $D_9$ approximately equal to 2.3 in. that extends from a front most surface of the bottom pulling lug 130*b* to a rearmost surface of the bottom pulling lug 130*b*. Also bottom pulling lug 130*b* can also be provided with varying thicknesses in the longitudinal direction from a bottom surface to the top surface such that the bottom cross-sectional area is greater than the top cross sectional area. In this way, the bottom pulling lug 130*b* can converge in the longitudinal direction from the bottom area to the distal end.

Figure 9C:
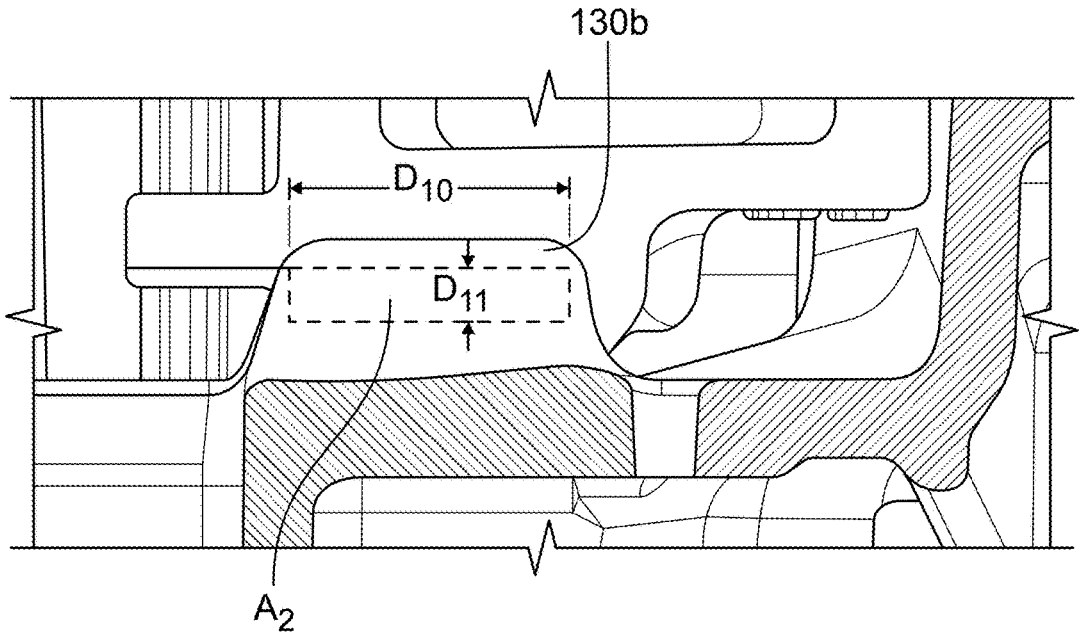
FIG. 9C shows another front perspective view of a portion of the example coupler body of FIG. 1B.

Also as shown by the dashed lines in FIG. 9C, the bottom pulling lug 130*b* defines a bottom pulling lug contact area $A_2$ where the lower knuckle pulling lug 109*b* contacts the bottom pulling lug 130*b*. In one example, the approximate arc length of the contact area can range from 2 in. to 3 in. and in one particular example the arc length of the contact area can be 2.9 in. In addition, the length $D_{10}$ of the contact area can range from 1.0 in. to 3.0 in. and, in one particular example, can be 2.8 in. and the height $D_{11}$ of the contact area can range from 0.25 in. to 1 in. and, in one particular example, can be 0.6 in. resulting in a total contact area $A_2$ ranging from 1.6 $in^2$. In another specific example, the length $D_{10}$ can be 2.3 in. and the height $D_{11}$ of the contact area can be 0.75 in. resulting in a total contact area $A_2$ of approximately 1.7 $in^2$. However, the contact patch area can be greater than 1.0 $in^2$ and can range from 0.25 $in^2$ to 2.25 $in^2$. In one example, the ratio of the length $D_{10}$ to the height $D_{11}$ of the bottom pulling lug contact patch area can range from 1.3 to 12 and in certain examples can be greater than 3 to 1 and can be substantially equal to or approximately 5 to 1.

As discussed herein, the example pulling lugs 130*a*, 130*b* are configured to balance the stresses across the coupler body 100. This can be accomplished, for example, by maintaining substantially equal contact patch areas between the top pulling lug and the bottom pulling lug. In one example, the top pulling lug contact patch area $A_1$ for engaging the upper knuckle pulling lug 109*a* and the bottom pulling lug contact patch area $A_2$ configured to engage the lower knuckle pulling lug 109*a* form a ratio of equal to or less than 1.5. In another example, the ratio of the top pulling lug contact patch area $A_1$ to the bottom pulling lug contact patch area $A_2$ can be approximately 1 to 1. This allows the ratio of the stresses between the top pulling lug and the bottom pulling lug to be approximately 1 to 1.

In one example, AAR Grade E cast steel, with a 120 KSI tensile strength and a 100 KSI yield point can be used to form the example coupler body 100. Having more uniform lugs will provide a reduction in stress that is below the ultimate tensile strength of 120 ksi of this material for a given load of 900 Kips. However, it is contemplated that other grades of steel or iron that have similar mechanical properties could also be used. In one example, the stress levels in the top and bottom lugs were approximately 100 Ksi, which is a reduction in stress when compared to prior coupler head designs. In particular, stress levels of 102 Ksi and 106 Ksi in the top and bottom pulling lugs 130*a*, 130*b* respectively can be achieved for a given draft load of 900 Kips. For a comparison example, in previous designs, the stress levels for the top and bottom pulling lugs with a 900 Kips draft load condition coupler experiences 316 Ksi and 208 Ksi in the top and bottom pulling lugs respectively. Therefore, a 68% and 49% reduction in the stresses experienced in the top and bottom pulling lugs from prior designs may be achieved. Lower stress levels in the coupler head and will reduce the tendency for the coupler body 100 to crack or fail in service.

FIGS. 10A-10I show another example bottom pulling lug 230*b* which can be reduced in size to accommodate for thrower removal and provided with various fillets to assist in better distributing the stresses in the coupler body 100. In one example, the fillets can be formed with larger radii to create a bottom pulling lug 230*b* allows more contact with the lower knuckle pulling lug 109*b* and better distributes stresses when the coupler body 100 is in draft condition. In addition, the various fillets and size of the bottom pulling lug 230*b* can accommodate both the removal of the thrower when desired and can also permit the thrower to be positioned in an inverted position without the thrower 110 becoming displaced from the opening 126 that receives the thrower 110.

Figure 10A:
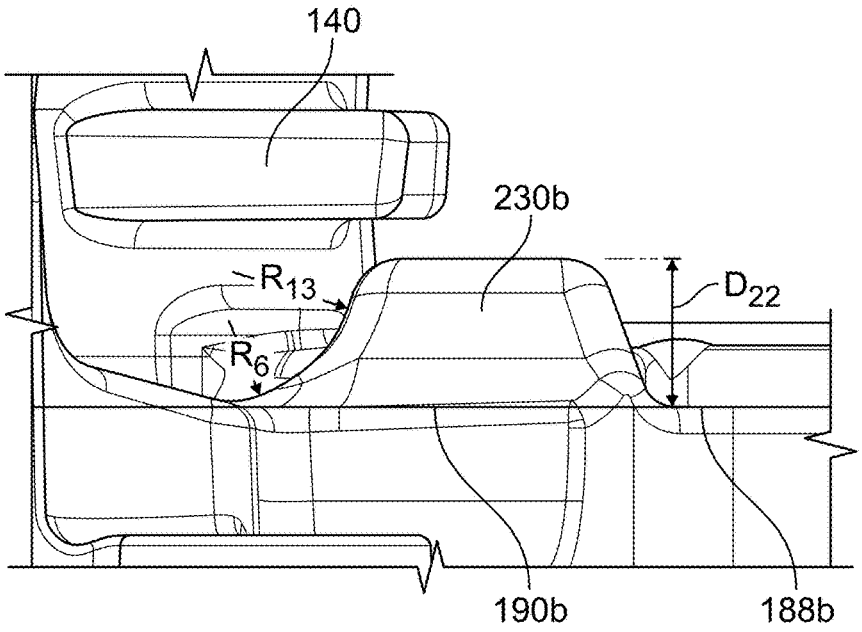
FIG. 10A shows a front perspective view of another example coupler body.

FIG. 10A shows a front perspective view of the example bottom pulling lug 230*b*. As shown in FIG. 10A, the bottom pulling lug 230*b* can taper towards the distal end of the pulling lug. In one example, the bottom pulling lug 230*b* can have a height $D_{22}$, which can range from 1.25 to 1.75 and, in one particular example, can be 1.4 in. In one example, a front thrower middle side fillet radius $R_{13}$ can range from 1 in to 1.25 in. and, in one particular example, can be approximately 1.125 in.

Figure 10B:
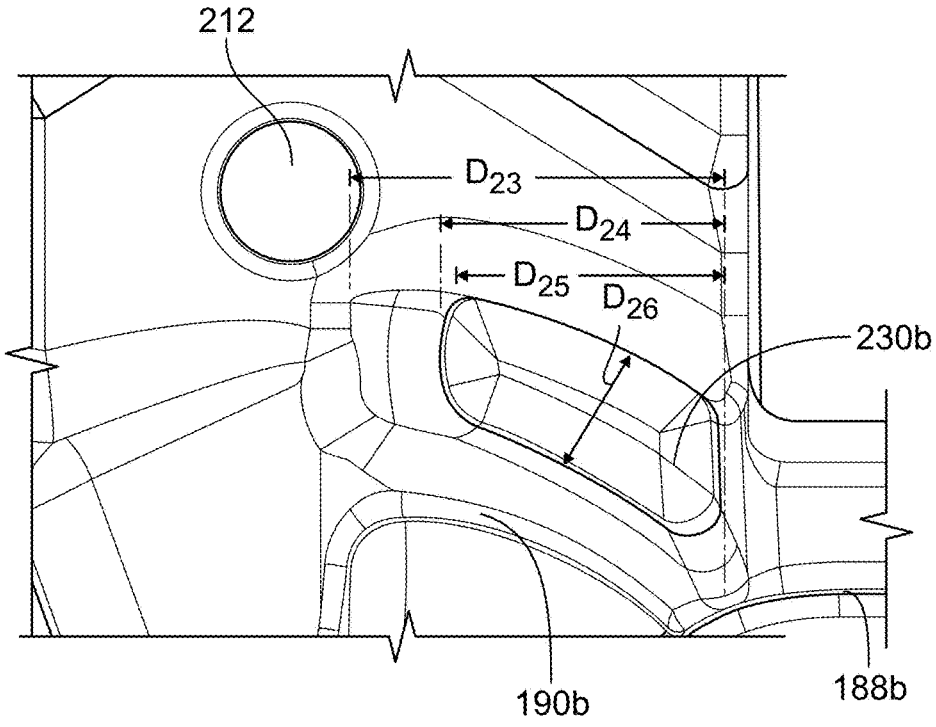
FIG. 10B shows a top perspective view of the example coupler body of FIG. 10A.
Figure 10C:
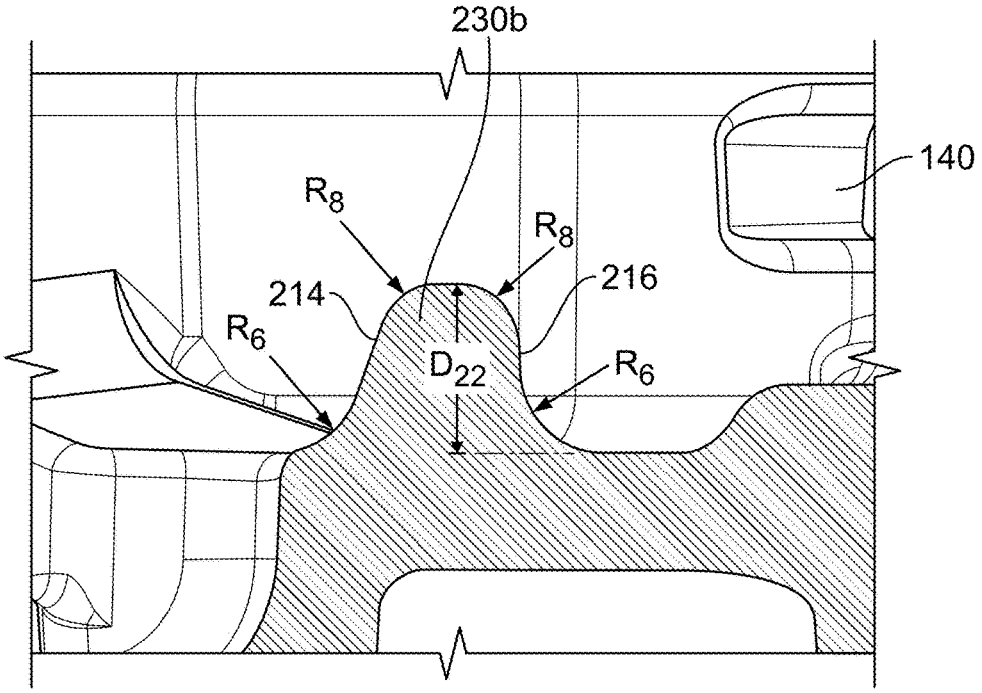
FIG. 10C shows a cross-sectional view of the example coupler body of FIG. 10A.

FIG. 10B shows a top perspective view of the example bottom pulling lug 230*b*. Because the pulling lug tapers toward its distal end, the length of the pulling lug varies from its base to its distal end. The length $D_{23}$ adjacent to the base, in one example, can range from 3.25 in. to 3.6 in., and in one particular example can be 3.4 in. A length $D_{24}$ at the bottom pulling lug midsection close to the distal end can range from 2.3 in. to 2.8 and in one particular example can be approximately 2.6 in. A length $D_{25}$ at the bottom pulling lugs distal end can range from 2.25 in. to 2.6 and in one particular example can be approximately 2.5 in. Also, the bottom pulling lug 230*b* can have an average thickness $D_{26}$ ranging from 0.9 in. to 1.4 in. and in one particular example can be 1.2 in. Additionally, FIG. 10C shows a cross-sectional view of the bottom pulling lug 230*b*. As shown in FIG. 10C, the rear surface 214 of the contact side of the bottom pulling lug 230*b* can have a greater slope than the front surface 216 of the non-contact side of the bottom pulling lug 230*b*.

Figure 10D:
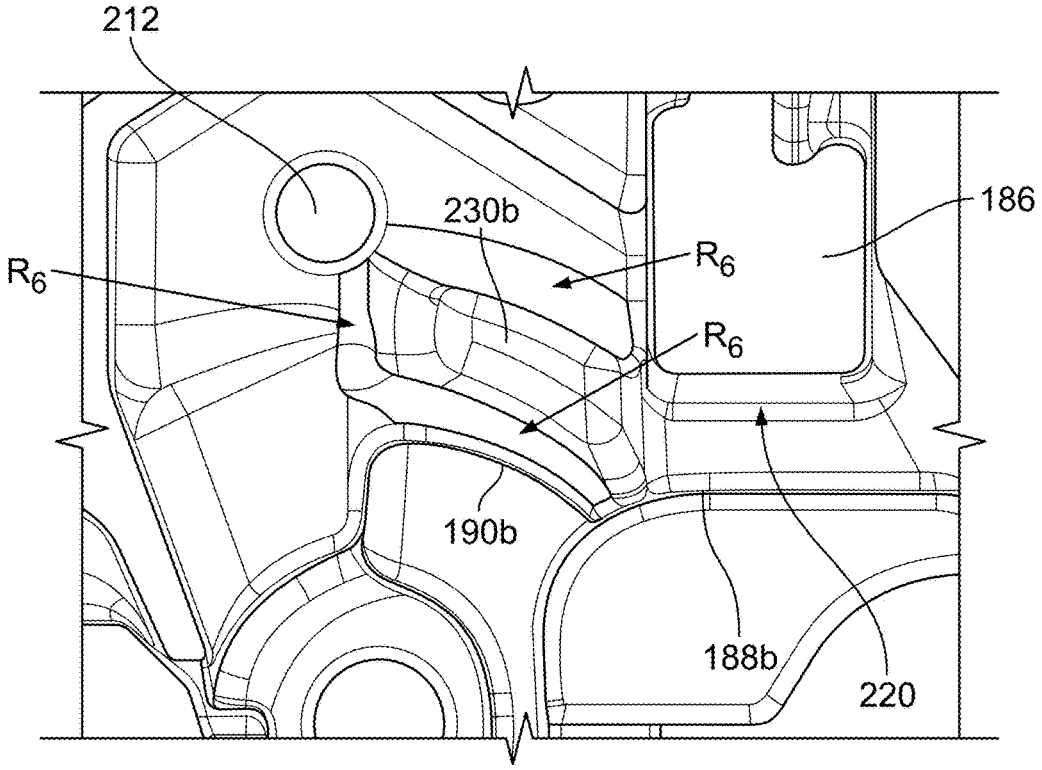
FIG. 10D shows a top perspective view of another example coupler body.

FIG. 10D shows a top perspective view of the example bottom pulling lug 230*b*. As shown in FIG. 10D, the bottom pulling lug 230*b* can be provided with a substantial or larger base fillet radius $R_6$, which can be a constant fillet radius. In one example, the base fillet radius $R_6$ can extend around a majority of the bottom pulling lug 230*b* base and from the drain hole 212, to the opening 186 for the lock, to the bottom buffing shoulder 190*b*, to the bottom front face 188*b*, and to the space 220 between the lock hole and the non-contact side face needed to remove the lock, and as limited by the thrower 110 when the knuckle 108 is in the open position. In one example, the bottom fillet radius $R_6$ can range from 0.5 in. to 1.25 in. and, in one particular example, can be 0.7 in.

Figure 10E:
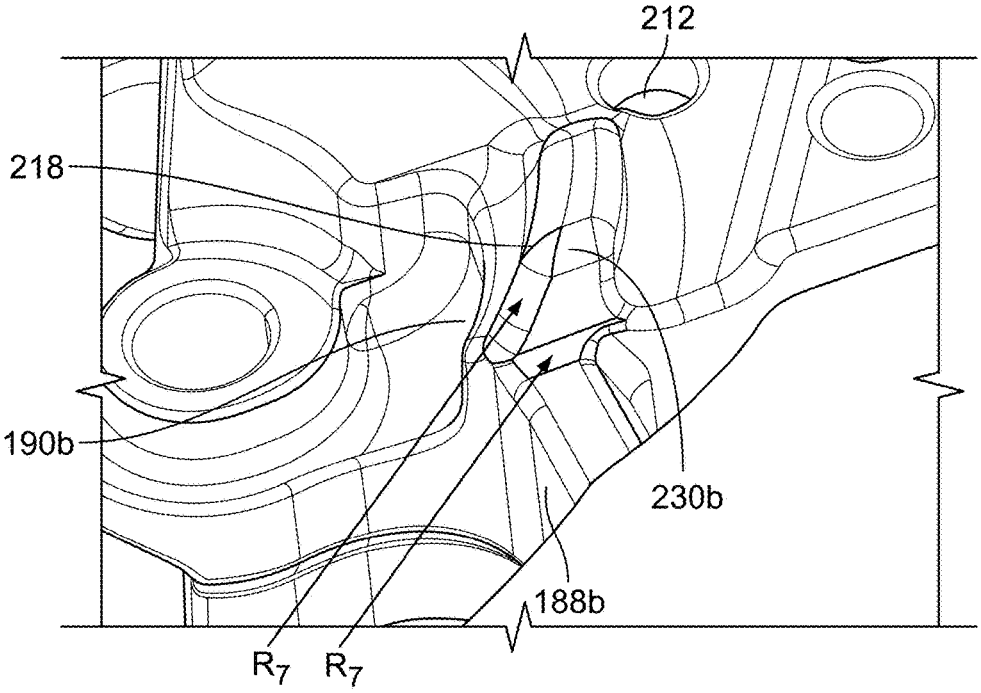
FIG. 10E shows a right side perspective view of the example coupler body of FIG. 10A.

FIG. 10E shows a right-side perspective view of the example bottom pulling lug 230*b*. As shown in FIG. 10E, the non-contact side lock side fillet radius and the right base fillet radius can also be formed larger and equal to each other. In one example, the non-contact side lock side fillet radius and the right base fillet radius both shown as $R_7$ can range from 0.2 in. to 0.5 in., and in a particular example, the non-contact side lock side fillet radius and the right base fillet radius $R_7$ can equal 0.3 in.

Figure 10F:
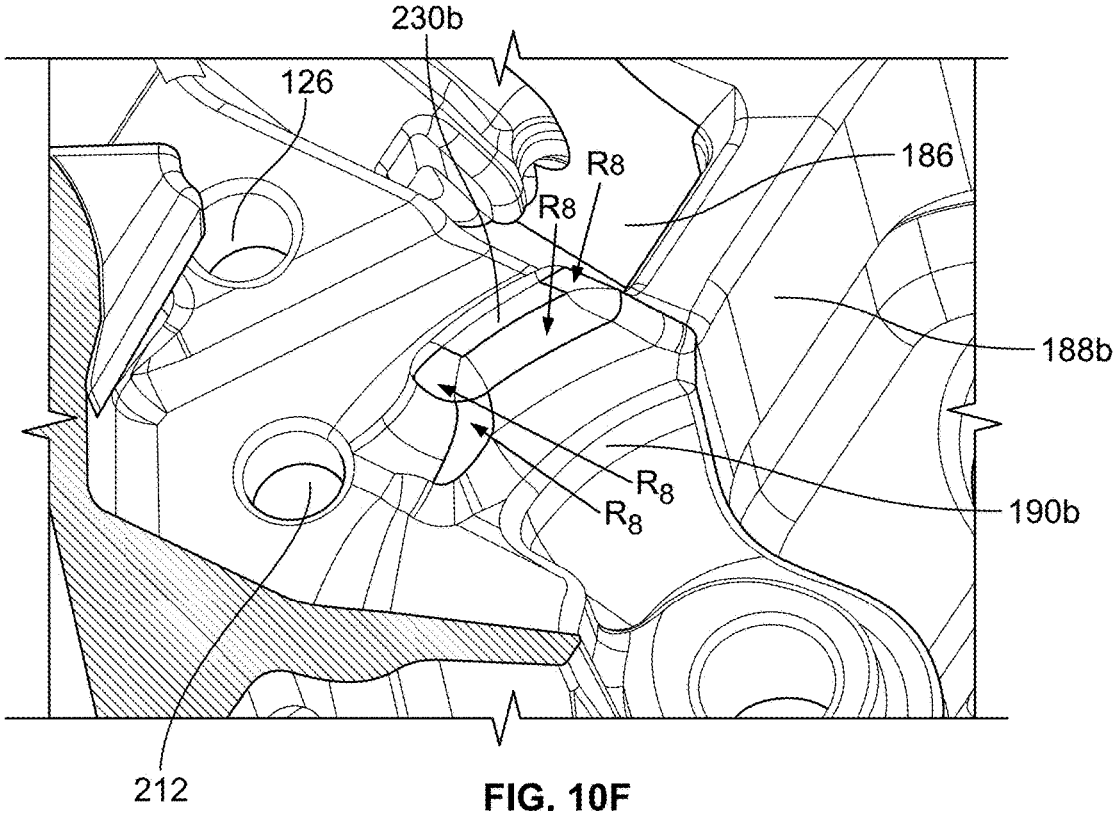
FIG. 10F shows a front left side perspective view of the example coupler body of FIG. 10A.

FIG. 10F shows a top front left perspective view of the example bottom pulling lug 230*b*. As shown in FIG. 10F, the top non-contact side fillet radius, the top sides fillet radii, and the non-contact side thrower face radius $R_8$ can all be formed larger than in the previous example bottom pulling lug and can all be formed equal to each other. In one example, the top non-contact side fillet radius, the top sides fillet radii, and the non-contact side thrower face radius each shown as $R_8$ can be formed in the range of 0.25 in. to 0.75 in. In one particular example, the top non-contact side fillet radius, the top sides fillet radii, and the non-contact side thrower face radius $R_8$ can be formed equal to 0.5 in.

Figure 10G:
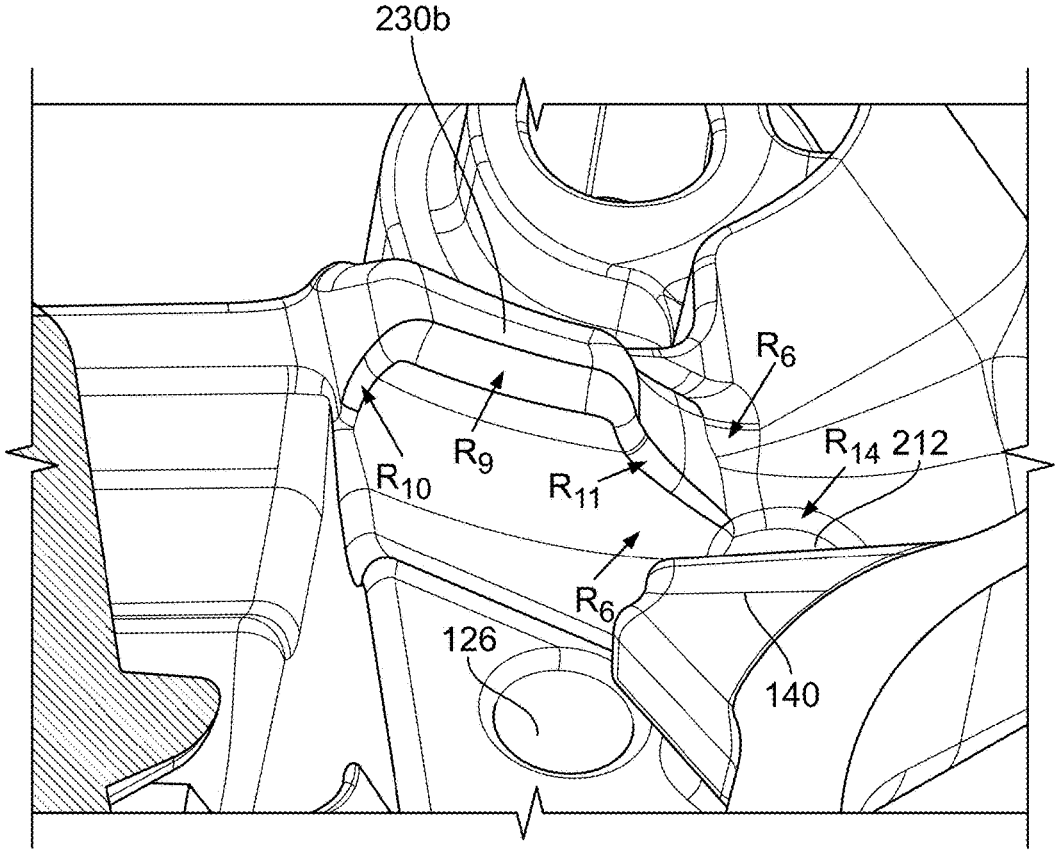
FIG. 10G shows a rear perspective view of the example coupler body of FIG. 10A.

FIG. 10G shows a rear perspective view of the bottom pulling lug 230*b* or the contact side of the bottom pulling lug 230*b* where the bottom pulling lug 230*b* contacts the lower knuckle pulling lug. As shown in FIG. 10G, the contact side of the bottom pulling lug 230*b*, can be provided with various fillets as well. However, as shown in FIG. 10G, the fillets can vary in size. For example, the top contact-side fillet radius $R_9$ can be formed slightly larger than the contact-side lock side fillet radius $R_{10}$ and the contact-side thrower side fillet radius $R_{11}$. Also the contact-side lock side fillet radius $R_{10}$ can be formed larger than the contact-side thrower side fillet radius $R_{11}$. In one example, top contact-side fillet radius $R_9$ the contact-side lock side fillet radius $R_{10}$, and the contact-side, thrower-side fillet radius $R_{11}$ can all be formed in the range of 0.1 to 0.5 in. In one particular example, top contact-side fillet radius $R_9$ can be 0.3 in., the contact-side lock side fillet radius $R_{10}$ can be 0.3 in. and the contact-side thrower side fillet radius $R_{11}$ can be 0.2 in.

The top contact-side fillet radius $R_9$, the contact-side lock side fillet radius $R_{10}$, and the contact-side thrower side fillet radius $R_{11}$ can form a substantially continuous fillet radius in the range of 0.1 in. to 0.5 in. that extends along the outer edges of the contact side of the bottom pulling lug, starting at the base of the bottom pulling lug 230*b* on the lock side or lock side hole 186 and continues up in a substantially vertical direction, then in a substantially horizontal direction, then in a substantially vertical direction and ends at the start of the drain hole 212. The base fillet radius $R_6$ bridges the contact-side, thrower-side fillet radius $R_{11}$ and the contact-side lock side fillet radius $R_{10}$. In addition, as shown in FIGS. 10F and 10G, the bottom pulling lug 230*b* can partially resemble a frusto-conical shape.

Figure 10H:
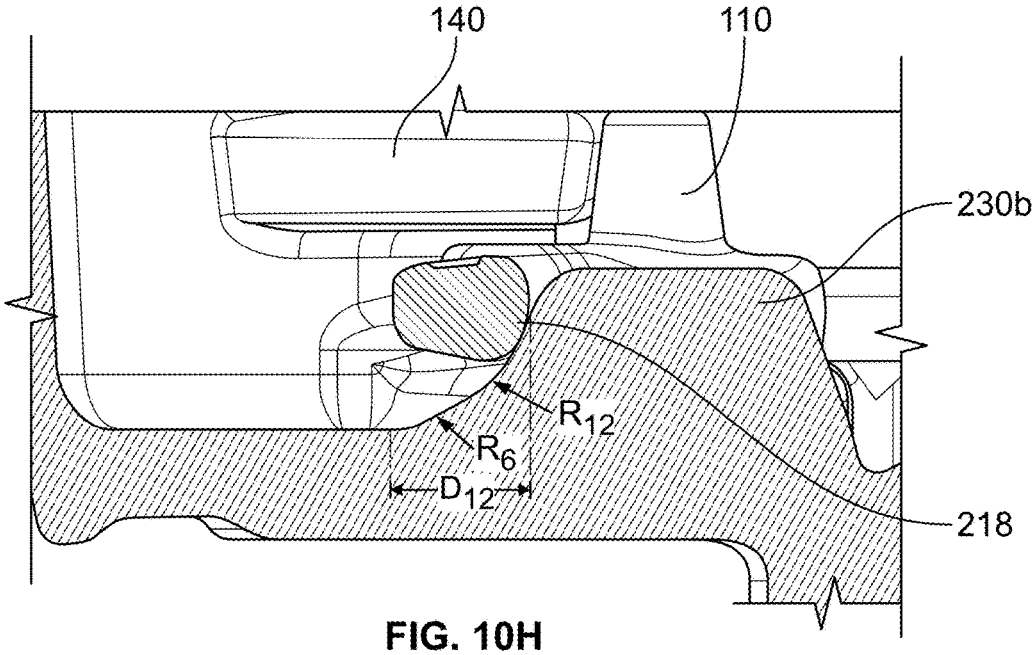
FIG. 10H shows front cross-sectional view of the example coupler body of FIG. 10A.

FIG. 10H shows a cross sectional view of the bottom pulling lug 230*b* and the thrower 110. As shown in FIG. 10H, the bottom pulling lug 230*b* extends underneath the thrower 110. In particular, the larger fillet radii $R_6$, $R_{12}$ along the base allows for the bottom pulling lug 230*b* to extend underneath the thrower 110 in the thrower position that the thrower 110 assumes when the knuckle is in the unlocked position. Also as shown in FIG. 10H, the area of material forming the bottom pulling lug 230*b* that extends underneath the thrower 110 starts from the thrower side of the bottom pulling lug 230*b* at the base of the bottom pulling lug 230*b* and extends over a slope starting at the fillet $R_6$ at the base of the bottom pulling lug 230*b* and ends at an intersection of the fillet $R_{12}$ at the top of the bottom pulling lug 230*b* and a vertical tangent 218 intersecting the fillet $R_{12}$ on the bottom pulling lug 230*b*.

Also as shown in FIG. 10H, the thrower side of the bottom pulling lug can be provided with the fillet radius $R_{12}$, which extends from the base fillet radius $R_6$. In one example, the fillet radius $R_{12}$ can be between 1 in. and 1.5 in., and, in one particular example, can be equal to 1.125 in. Also, in one specific example, the distance $D_{12}$ that the bottom pulling lug 130*b* extends underneath the thrower can be 1.2 in.

Figure 10I:
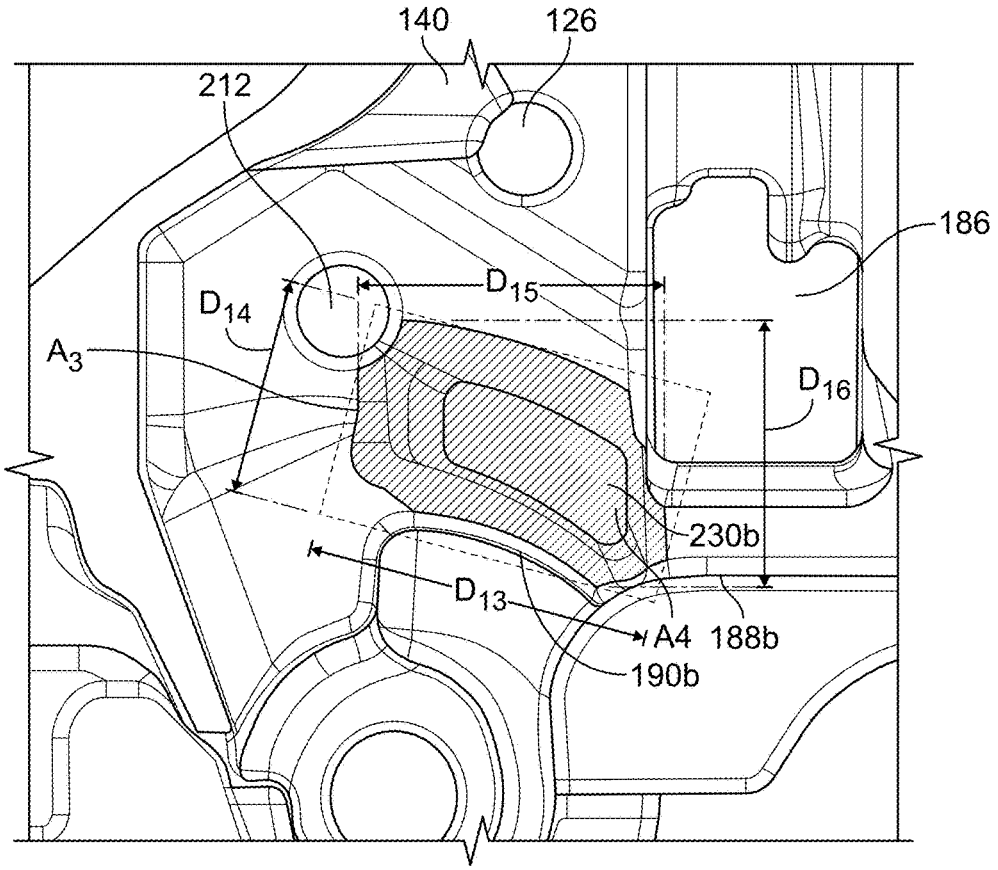
FIG. 10I shows a top perspective view of the example coupler body of FIG. 10A.

FIG. 10I shows a top perspective view of the bottom pulling lug 230*b*. As shown in FIG. 10I, the base of the bottom pulling lug 230*b* can be formed much larger than the distal end of the pulling lug 230*b*. This permits the bottom pulling lug 230*b* to assist in distributing the stresses across the coupler body 100, while also allowing the thrower 110 to be maintained in the coupler body 100 when the coupler body 100 is inverted. As shown in FIG. 10I, the perimeter of the base of the bottom pulling lug 230*b* can be maximized within the coupler body 100. In one example, the perimeter of the base of the pulling lug 230*b* can be maximized by extending the base of the pulling lug to the drain hole 212, the lock hole 186, the bottom front face 188*b*, and the bottom buffing shoulder 190*b*.

Maximizing the perimeter of the base of the bottom pulling lug 230*b* also maximizes the base area of the bottom pulling lug 230*b*. In one example, the bottom pulling lug base cross-sectional area $A_3$ can range from 8 $in^2$ to 12 $in^2$. In one particular example, the bottom pulling lug base cross-sectional area $A_3$ can be approximately 10.3 $in^2$. Additionally, a cross-sectional area adjacent to the distal end $A_4$, which does not include the distal fillets or radii of the bottom pulling lug 230*b* can be formed smaller than the bottom pulling lug base cross-sectional area. In one example, the area $A_4$ adjacent to the distal end of the bottom pulling lug 230*b* can be formed between 2 $in^2$ and 4 $in^2$, and in one particular example, the cross-sectional area adjacent to the distal end $A_4$ of the bottom pulling lug 130*b* can be approximately 3.2 $in^2$. Therefore, the ratio of the bottom pulling lug 230*b* base area $A_3$ to the area $A_4$ adjacent to the distal end of the bottom pulling lug 230*b* can be in the range of 2 to 5.5 or greater than 2.5 and in one particular example can be 3.3.

Also as is shown in FIG. 10I, various dimensions $D_{13}$-$D_{16}$ can be maximized to maximize the base area and perimeter of the base area of the bottom pulling lug 230*b*. In one particular example, $D_{13}$ can be approximately 4.8 in., $D_{14}$ can be approximately 3 in., $D_{15}$ can be approximately 4.3 in., and $D_{16}$ can be approximately 3.7 in.

Referring again to FIGS. 2-4, the thrower 110 is located adjacent to the knuckle 108 in a rearward direction of the coupler head 102. The thrower 110 includes an upper trunnion 124*a* and a lower trunnion 124*b* and can be provided with a first leg 122*a* and an opposing second leg 122*b*. The lower trunnion 124*b* is configured to be placed into an opening 126 in the coupler head 102, and a bottom surface of the thrower 110 is configured to rest on a thrower support surface 150 in the coupler head 102. The thrower 110 is configured to move the knuckle 108 from a locked position to an unlocked position. In particular, referring to FIG. 3, the thrower 110 is configured to rotate horizontally about the lower trunnion 124*b* in the coupler head 102 in a position disposed rearwardly of the pulling lugs 130*a* and 130*b*.

Figure 11A:
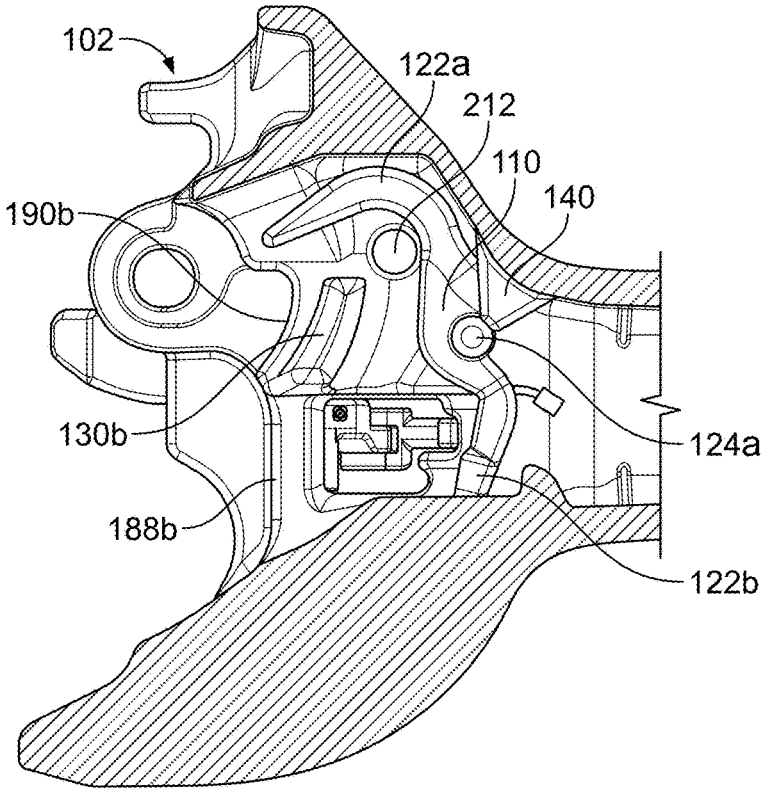
FIG. 11A shows a top view of a cross section of another portion of the example coupler assembly of FIG. 1B.
Figure 11B:
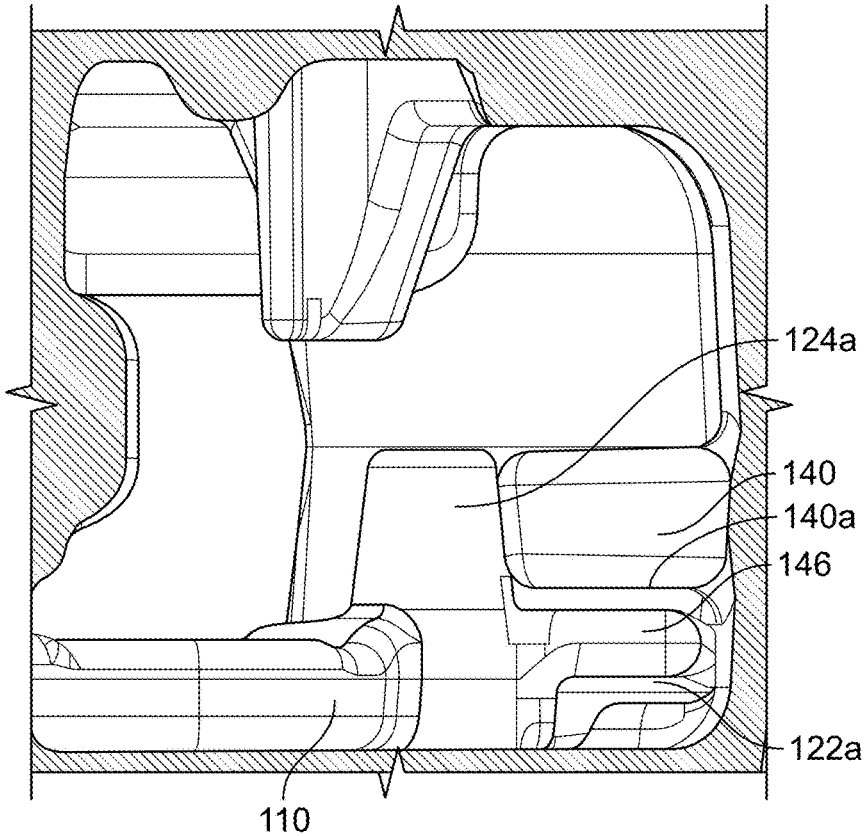
FIG. 11B shows a rear perspective view of a portion of the example coupler assembly of FIG. 1B.

Turning now to FIG. 11A, the thrower retainer lug 140 profile provides a bearing surface while the knuckle 108 is rotated open and retains the thrower 110 in the same position when the railcar is moved from an upright position to an inverted position. FIG. 11A shows a top cross-sectional view of the coupler head 102 showing the thrower 110. As shown in FIG. 11A, a thrower retaining lug 140 abuts the upper trunnion 124*a* and prevents the thrower 110 from becoming displaced from the coupler head 102. As shown in FIG. 11A, the thrower retainer lug 140 overlaps a portion of the top surface of the thrower 110. In particular, as shown in FIG. 11B, the first leg 122*a* can be provided with a thrower retaining shelf 146. The amount of coupler head thrower retainer lug overlap with the thrower retaining shelf 146 can be configured so the thrower 110 can stay in position when the railcar is moved from its upright position to an inverted position. The thrower retaining shelf 146 can be positioned adjacent to the upper trunnion 124*a* and acts as a safety mechanism for retaining the thrower 110 in place during the operation of the coupler body 100 in a railcar.

Figure 11C:
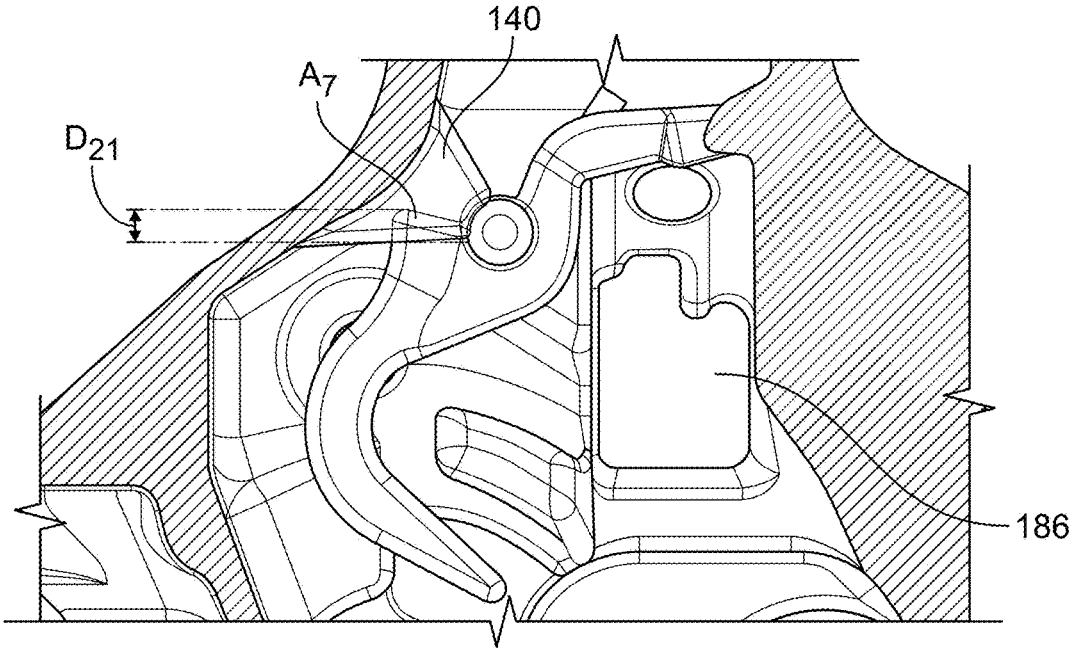
FIG. 11C shows another top view of a cross section of another portion of the example coupler assembly of FIG. 1B.

In particular, as shown in FIG. 11B, the thrower retaining lug 140 of the coupler body 100 can be provided with a bottom wall 140*a* spaced above the thrower retaining shelf 146. The bottom wall 140*a* of the retainer lug 140 can be configured for engagement with the thrower retaining shelf 146 during unusual upward movement of the thrower 110. This prevents accidental dislodgement of the lower trunnion 124*b* from the opening 126 of a coupler head 102 during normal operating conditions that may occasionally occur in railway service, for example, when the coupler head 102 is subjected to vertical movements or when the railcar is moved from its upright position to an inverted position when the railcar is dumped. This allows the thrower retainer lug 140 to maintain the thrower 110 in the opening 126 in any orientation of the coupler body 100. In one example, as shown in FIG. 11C, the amount of overlap $D_{21}$ between the thrower 110 and the thrower retaining lug 140 can be greater than or equal to 0.4 in. and in one particular example can be 0.6 in. in the position that the thrower 110 assumes when the knuckle is in the unlocked position. Also, the overlapping area $A_7$ between the thrower 110 and the thrower retaining lug 140 can be greater than or equal to 0.4 $in^2$ and in one particular example can be approximately equal to 0.6 $in.^2$ Certain features can affect the amount of overlap needed between the thrower retaining lug 140 and thrower retaining shelf 146, such as, the diameter of the opening 126 for receiving the lower trunnion 124*b* of the thrower 110 and the lower trunnion 124*b* diameter. Also the knuckle 108 rotation stops 178*a* and the coupler head 102 rotation stops (e.g. coupler body rotation stops 174), the knuckle 108 as centered by the vertical pin 114 relative to the knuckle pin hole 172, and the coupler head slot for receiving the vertical pin 114 may also affect the amount of overlap of the thrower 110 and the thrower retaining lug 140. In particular, the amount of overlap of the thrower 110 and the thrower retaining lug 140 can be dictated or controlled by two operations of the coupler body 100: (1) when the knuckle 108 is open and bottomed out by the knuckle rotation stops 178*a* of the knuckle 108 and the coupler head 102 rotation stops 174 and when the knuckle 108 is pulled open at the pulling face, which creates overlap between the thrower retaining lug 140 and (2) when the knuckle is removed the thrower 110 is positioned up against the side of the bottom pulling lug 130*b* for moving the thrower 110 and the thrower retainer lug 140 out of alignment and for lifting the thrower out of the opening 126 (e.g. the thrower has to be tilted in a forward direction and lifted simultaneously for removal from the coupler head 102).

Also, when the knuckle 108 is open, adequate overlap between the coupler head thrower retaining lug 140 and the thrower retaining shelf 146 needs to be maintained to accommodate manufacturing tolerances of the thrower 110 and in order to accommodate for the relative wear of the parts of the coupler body 100, for example, the wear of the thrower retainer lug 140, the thrower 110, the vertical pin 114, the pin hole 172, and the knuckle rotation stops 178*a* relative to each other.

Additionally, the thrower retainer lug 140 is configured to also allow the thrower 110 to be removed with ease and without any interference from the retaining lug 140 when the thrower 110 is fully opened and against the bottom pulling lug 130*b* (i.e. with the knuckle removed). Likewise, in order to allow the thrower 110 to fully seat in the opening 126 for receiving the lower trunnion 124*b*, the thrower retaining lug 140 can be configured to allow the thrower 110 to be installed. This also allows for throwers to be interchanged with the coupler body 100 and allows the thrower retaining lug 140 to maintain the thrower 110 in position during use of the coupler body 100.

Also the size of the thrower retainer lug 140 in conjunction with the bottom pulling lug 130*b* also allows the thrower 110 to be capable of being installed and removed from the coupler head 102. For instance, with the knuckle 108 removed, the bottom pulling lug 130*b* establishes and limits the amount of rotation of the thrower 110, but still allows the thrower retainer shelf 146 to be free from, and having no overlap between the thrower retaining lug 140 and the thrower retaining shelf 146, thus allowing the thrower 110 to be lifted up and removed or installed.

Also, as shown in FIGS. 11A-11D the thrower retaining lug 140 can be configured to guide the upper trunnion 124*a* at a contact portion of the outer circumference through the motion of the thrower 110. This helps maintain the thrower 110 in the same position as the thrower 110 is rotated from the locked position to the unlocked position. The contact portion of the outer circumference can be less than 90 degrees, and can be approximately 30 degrees to 75 degrees. In one specific example, the contact portion of the outer circumference can be approximately 63 degrees.

Figure 11D:
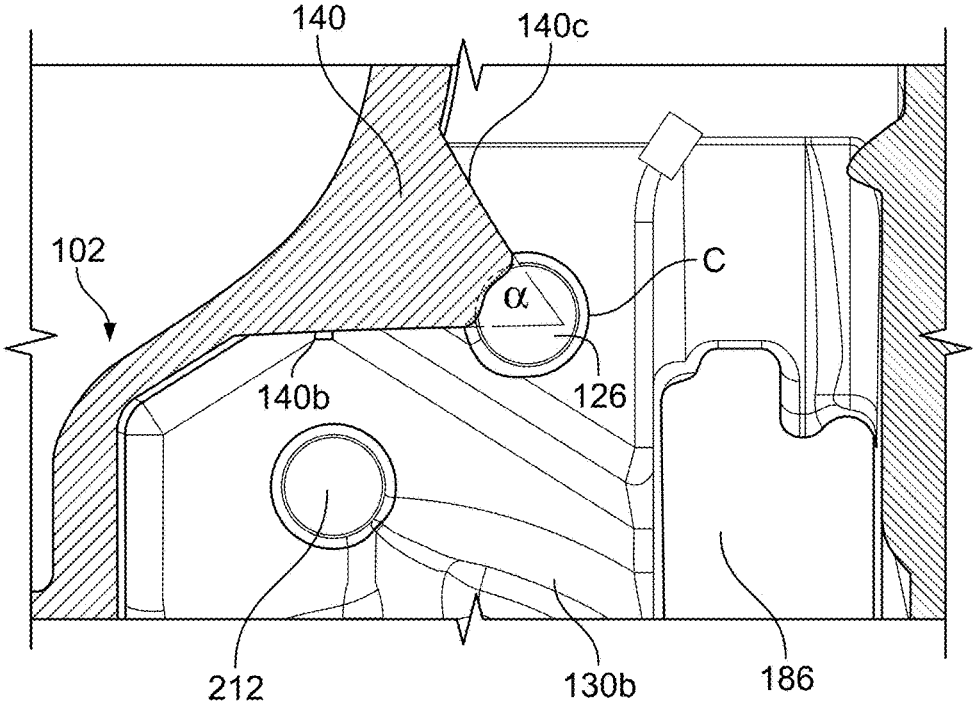
FIG. 11D shows a top cross-sectional view of another portion of the example coupler body of FIG. 1B.

The geometry and size of the thrower retaining lug 140 allows the bottom pulling lug 130*b* to be increased in size, which may result in decreasing the pulling lug stress and can help to increase the fatigue life of the coupler head 102. Also as shown in FIG. 11D, the thrower retaining lug 140 can be provided with a first vertical surface 140*b* and a second vertical surface 140*c*. The first vertical surface 140*b* and the second vertical surface 140*c* can form an angle $\alpha$ less than 90 degrees. In one example, the angle $\alpha$ can be in between 30 and 75 degrees, and in one particular example the angle $\alpha$ can be approximately less than 70 degrees or approximately equal to 63 degrees.

Figure 11E:
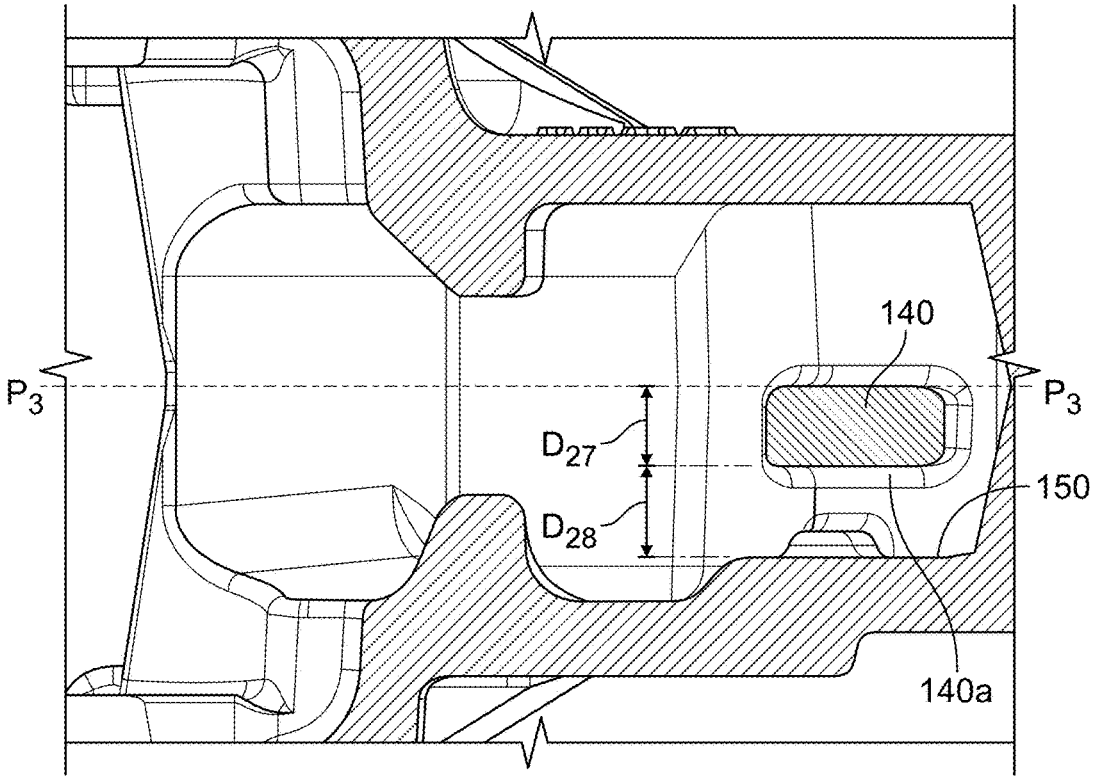
FIG. 11E shows a side cross-sectional view of the example coupler body of FIG. 1B.

FIG. 11E shows a side cross-sectional view of the example thrower retainer lug 140 and shows the dimensional relationship between the thrower retaining lug 140 and the thrower support surface 150 and the parting line which defines plane $P_3$. In one example, the bottom surface 140*a* of the thrower retaining lug 140 can be located at a distance $D_{27}$ of approximately 1.0 in. from the plane $P_3$ and a distance $D_{28}$ of 1.2 in. from the thrower support surface 150.

Figure 12:
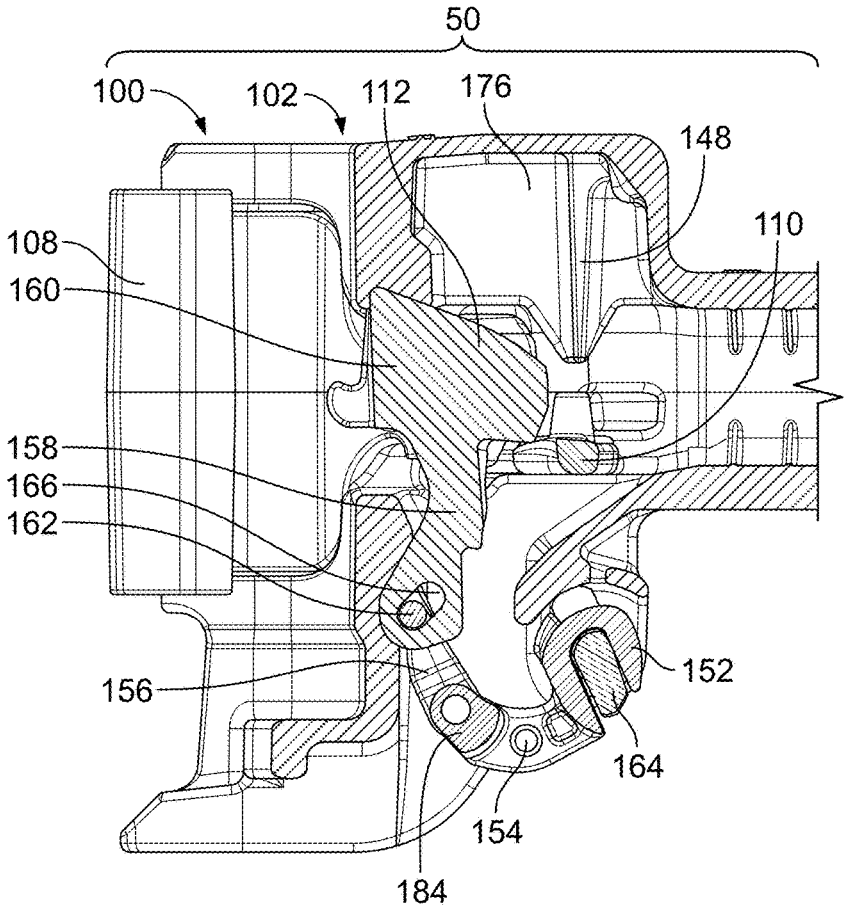
FIG. 12 shows a side cross-sectional view of another portion of the example coupler assembly of FIG. 1B.

A vertical cross-sectional view of the coupler body 100 is depicted in FIG. 12, which shows the lock 112. The lock 112 is configured to maintain the knuckle 108 in either a locked position or an unlocked position regardless of the orientation of the coupler body 100. The lock 112 can include a head 160, a rotor 164, and a leg 158.

As shown in FIG. 12, the lock 112 can be connected to a locklift assembly 184. For a Type F coupler, the locklift assembly 184 can include a lever 154 and toggle 156. A hook 152 can be connected to the lever 154, which is connected to the toggle 156. The toggle 156 can include a lock slot trunnion 162. The trunnion 162 is located in a slot 166 formed in the leg 158 of the lock 112. The coupler head 102 cavity 104 also defines a lock chamber 176 for receiving the head 160 of the lock 112. Also within the cavity 104, the coupler head 102 can also be provided with a knuckle side lock guide 148.

Figure 13:
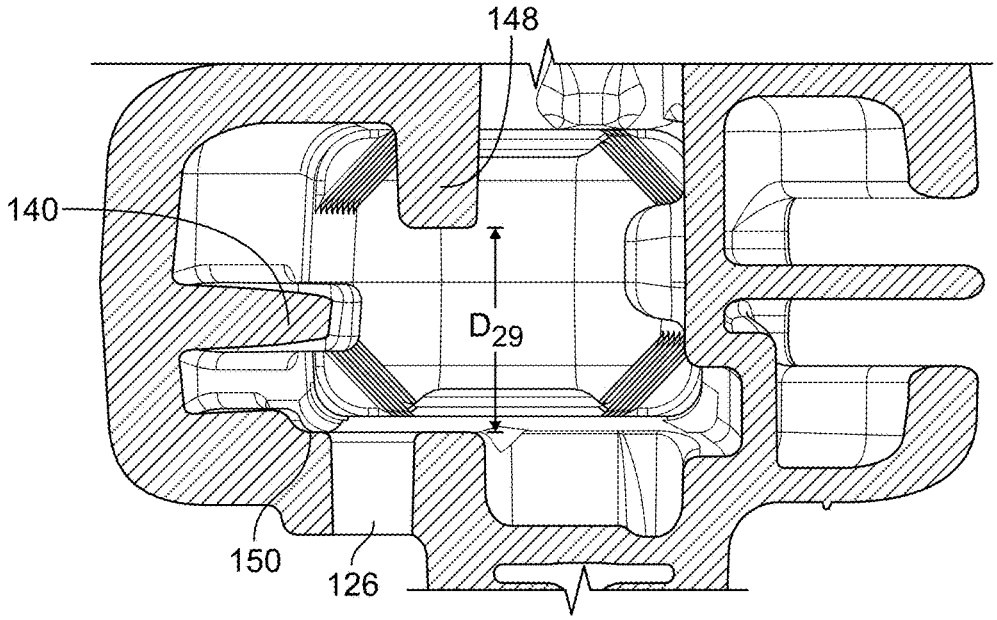
FIG. 13 shows a front cross-sectional view of a portion of the example coupler body of FIG. 1B.

The knuckle slide lock guide 148 is configured to act as a vertical guide for the lock 112. In particular, as shown in FIG. 13, the knuckle slide lock guide 148 provides a vertical guide for the head 160 of the lock 112. Since the knuckle slide lock guide 148 is located adjacent to the thrower 110, when installed, the height of the knuckle side lock guide 148 can also be configured so as to provide adequate clearance for the thrower 110 to be installed and removed. In one particular example, the knuckle side lock guide 148 can be positioned at or more than 2.75 in. and in one particular example can be more than 3.0 in., $D_{29}$, above the thrower support surface 150 on the coupler head 102.

Figure 14A:
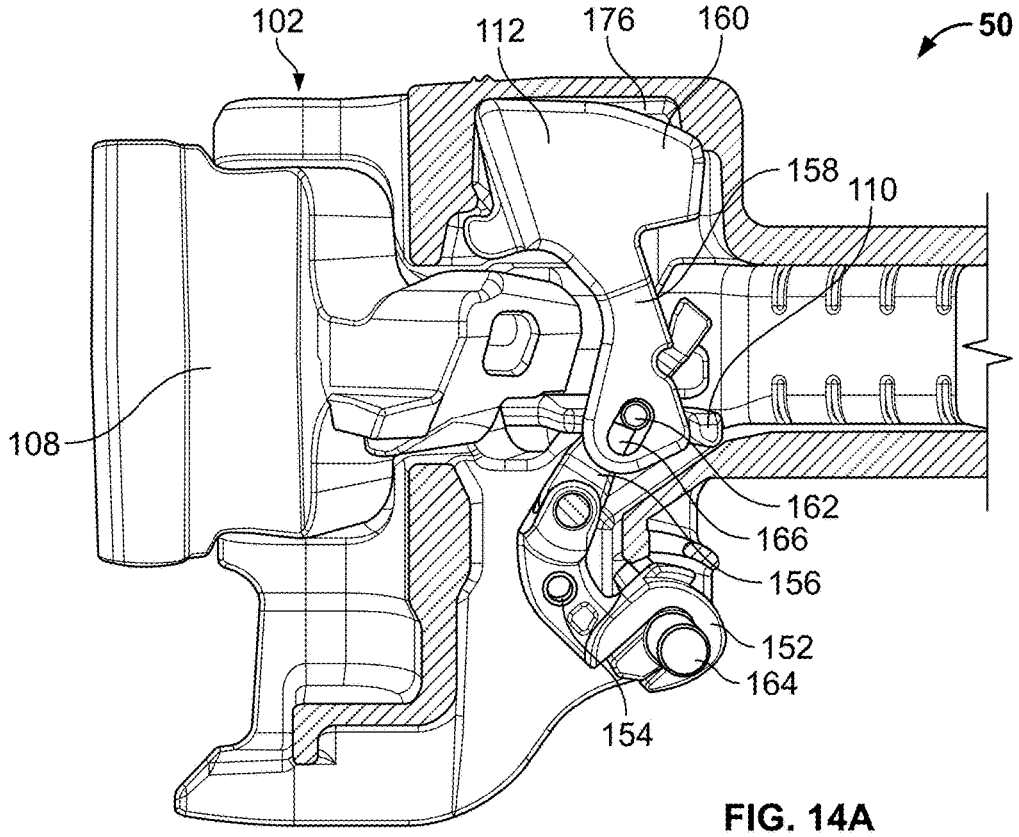
FIG. 14A shows a side perspective view of the example coupler assembly in FIG. 1B in the unlocked position.
Figure 14B:
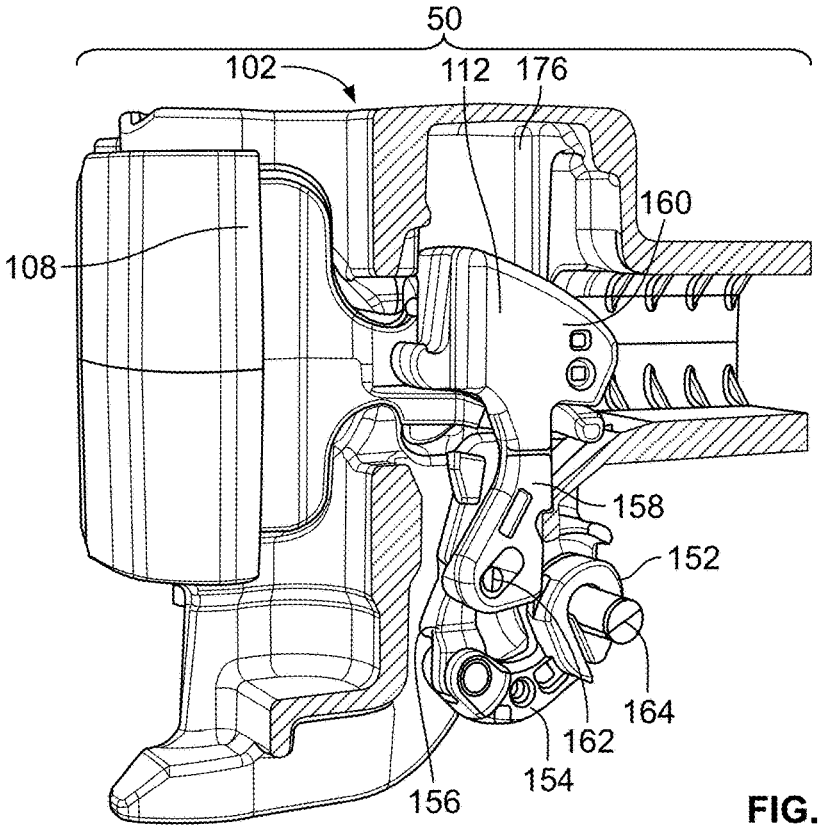
FIG. 14B shows a side perspective view of the example coupler assembly in FIG. 1B in the locked position.

FIG. 14A shows the coupler in an unlocked position and FIG. 14B shows the coupler in a locked position. To operate the coupler assembly 50 to connect adjacent railcars, as the railcar is moved toward an adjacent railcar, the knuckle 108, in the opened position shown in FIG. 14A, will contact an adjacent guard arm of a coupler located on the adjacent railcar. In connecting the railcars, both the knuckle 108 of the coupler assembly 50 and the knuckle on an adjacent railcar may each rotate inward such that each of the two knuckles can be locked into place within their respective coupler heads such that the knuckles are in the locked position as is shown in FIG. 14B. During the joining process, as is shown in relation to FIGS. 14A and 14B, when the knuckles are rotated, the lock 112 is actuated and configured to slide downward within the cavity of each coupler head to lock the knuckle in place to and join the two couplers together.

To unlock the F coupler, movement of the rotor 164, which can be rotated by an uncoupling lever (not shown) causes the hook 152 and the lever 154 to rotate and through the articulation of the lever 154 and the toggle 156, the lock slot trunnion 162 moves within slot 166 in the lock leg 158 and causes the leg 158 and the head 160 to move from the locked position to the unlocked position. Thus, the lock 112 is engaged and caused to leave its locked position and move to its knuckle-throwing position shown in FIG. 14A. The lock 112 is configured to slide up into the lock chamber 176 such that the head 160 and the leg 158 rotate. The head 160 and the leg 158 are rotated into contact with the thrower 110. Upon engagement with the thrower 110, the rotation of the lock head 160 and the lock leg 158 causes the thrower 110 to pivot and throw the knuckle 108 as is shown in FIG. 14A.

In particular, the second leg 122*b* of the thrower 110 is configured to be engaged by the lock leg 158 of the lock 112 in the coupler head 102, such that during the unlocking cycle of the coupler assembly 50, the lock 112 moves the second leg 122*b* of the thrower 110 thereby moving the first leg 122*a* of the thrower 110 about the lower trunnion 124*b* against the knuckle 108. Specifically, as the lock 112 is raised out of its locking engagement with knuckle tail 118, the leg 158 of the lock 112 is moved rearwardly against the second leg 122*b* of the thrower 110 causing the thrower 110 to pivot about the trunnion 124, such that the first leg 122*a*, through engagement with the thrower pad 129 of the knuckle 108 rotates the knuckle 108 to an unlocked position depicted in FIG. 14A.

Figure 15A:
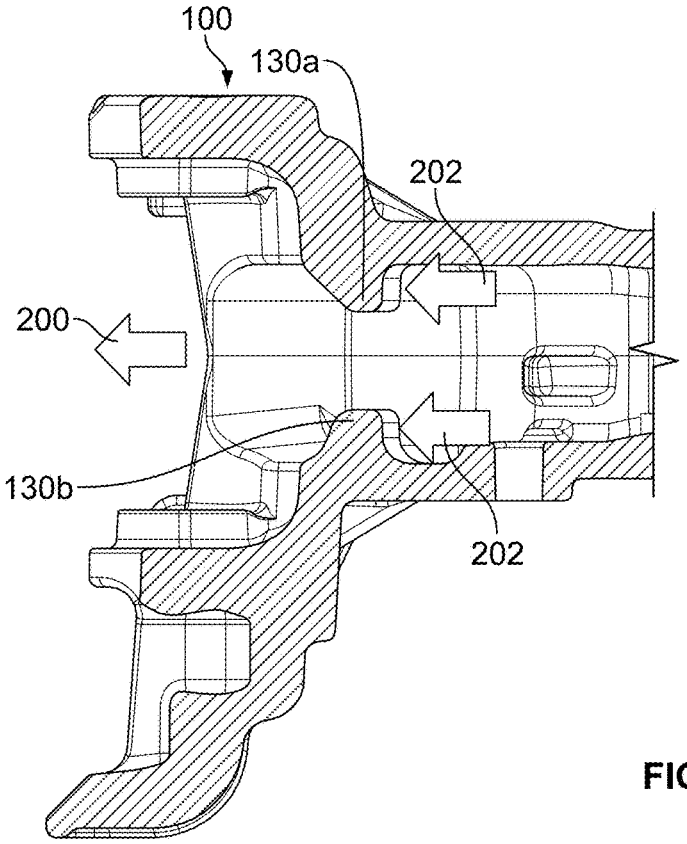
FIG. 15A shows a diagram of loads on an example coupler body during a draft condition from the knuckle.
Figure 15B:
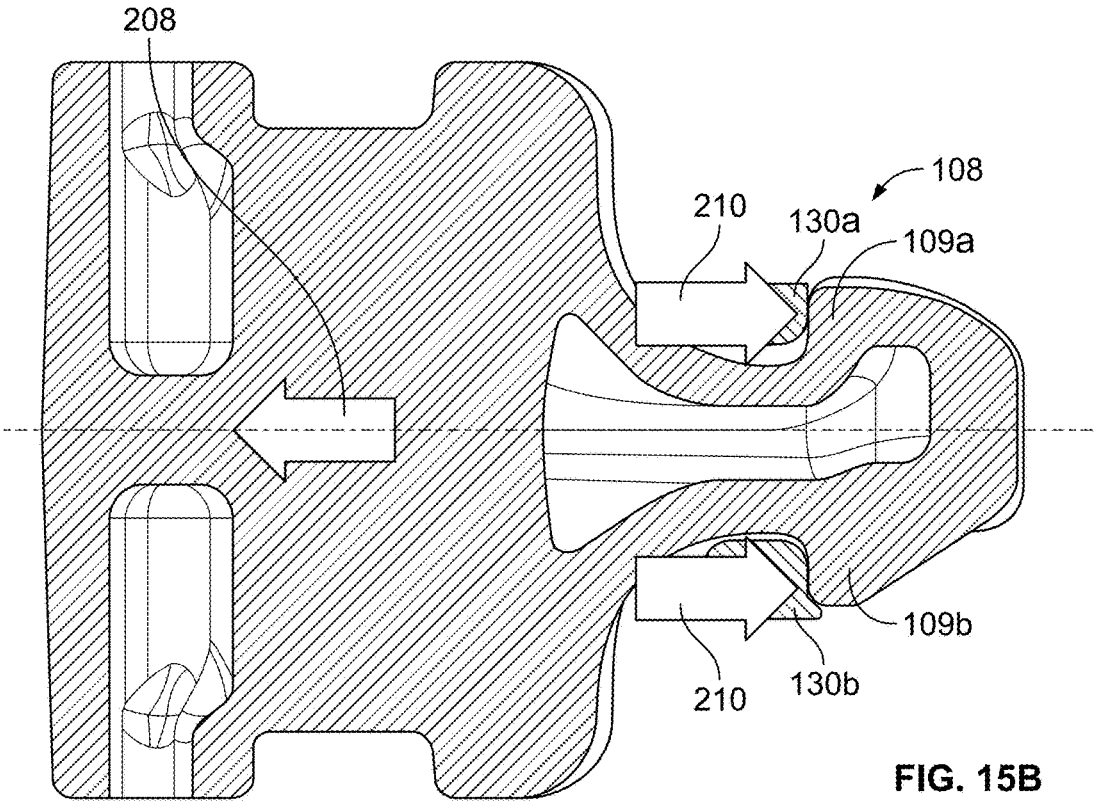
FIG. 15B shows a diagram of loads from the coupler onto an example knuckle during a draft condition.
Figure 15C:
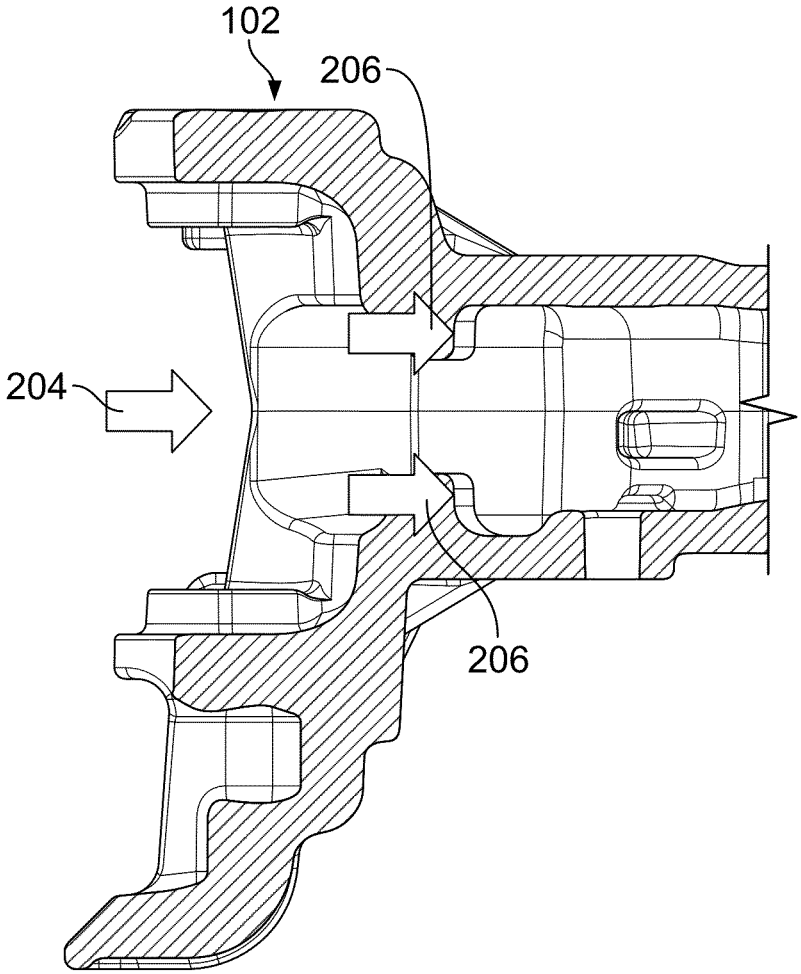
FIG. 15C shows a diagram of reactive loads on an example coupler body from a knuckle in draft condition.

Aspects in this disclosure can help to better distribute the load and interaction between the pulling lugs and the knuckle pulling lugs, which may result in coupler bodies and knuckles having less wear and improved fatigue lives as further explained and illustrated below in relation to FIGS. 15A-15C. FIGS. 15A-15C show the main forces or loads acting on the top and bottom pulling lugs 130*a*, 130*b* in the coupler body 100 and how the main forces or loads acting on the top and bottom pulling lugs 130*a*, 130*b* can be balanced.

FIG. 15A represents the coupler body 100 in draft condition and shows the loads that the coupler body 100 receives from the knuckle 108. When the coupler body 100 is in the draft condition (e.g. when the coupler body 100 is being pulled), as discussed herein, the load of the knuckle 108 is transferred to the coupler body 100 through the top and bottom pulling lugs 130*a*, 130*b*. As shown in FIG. 15A, in one example, the coupler body 100 is designed such that the load represented by arrow 200 transferred to the coupler body 100 is evenly distributed amongst the top and bottom pulling lugs 130*a*, 130*b* when engaged by the knuckle as represented by arrows 202, such that the loads 202 are equal.

15B represents a knuckle 108 in the draft condition, and the loads the knuckle 108 receives from the coupler body 100. The arrows 208 and 210 illustrate the loads acting on the knuckle 108 from the coupler body 100. Arrows 210 represent the balanced reactive load of the coupler body pulling lugs 130*a*, 130*b* on the upper knuckle pulling lug 109*a* and the lower knuckle pulling lug 109*b*, where arrows 210 represent an equally distributed load to the upper knuckle pulling lug 109*a* and the lower pulling lug 109*b*.

FIG. 15C shows the reaction loads to the knuckle 108 on the coupler body 100 when the coupler body 100 is in the draft condition. The coupler body 100 reaction loads from the knuckle are shown by arrows 206. The top and bottom pulling lugs 130*a*, 130*b* assist in spitting the reactive load 204 from the knuckle and dividing the reactive load 204 into equal loads 206.

As discussed herein, the above examples assist in more evenly distributing the stresses in the coupler body top pulling lug and the coupler body bottom pulling lug as the loads are transferred from the knuckle. As discussed, the coupler body top pulling lug can be configured to engage the upper knuckle pulling lug, and the coupler body bottom pulling lug can be configured to engage the lower knuckle pulling lug to receive loads from the knuckle. The coupler body top pulling lug and the bottom pulling lug can be configured to balance the loads transferred to the coupler head such that the loads and corresponding stresses between the upper pulling lug and the bottom pulling lug are substantially equal. Also the coupler body top pulling lug and the coupler body bottom pulling lug can have substantially equal strengths and deformation rates to evenly distribute or receive loads from the upper knuckle pulling lug and the lower knuckle pulling lug to maintain the loads and stresses on the upper knuckle pulling lug and the lower knuckle substantially balanced.

Figure 16:
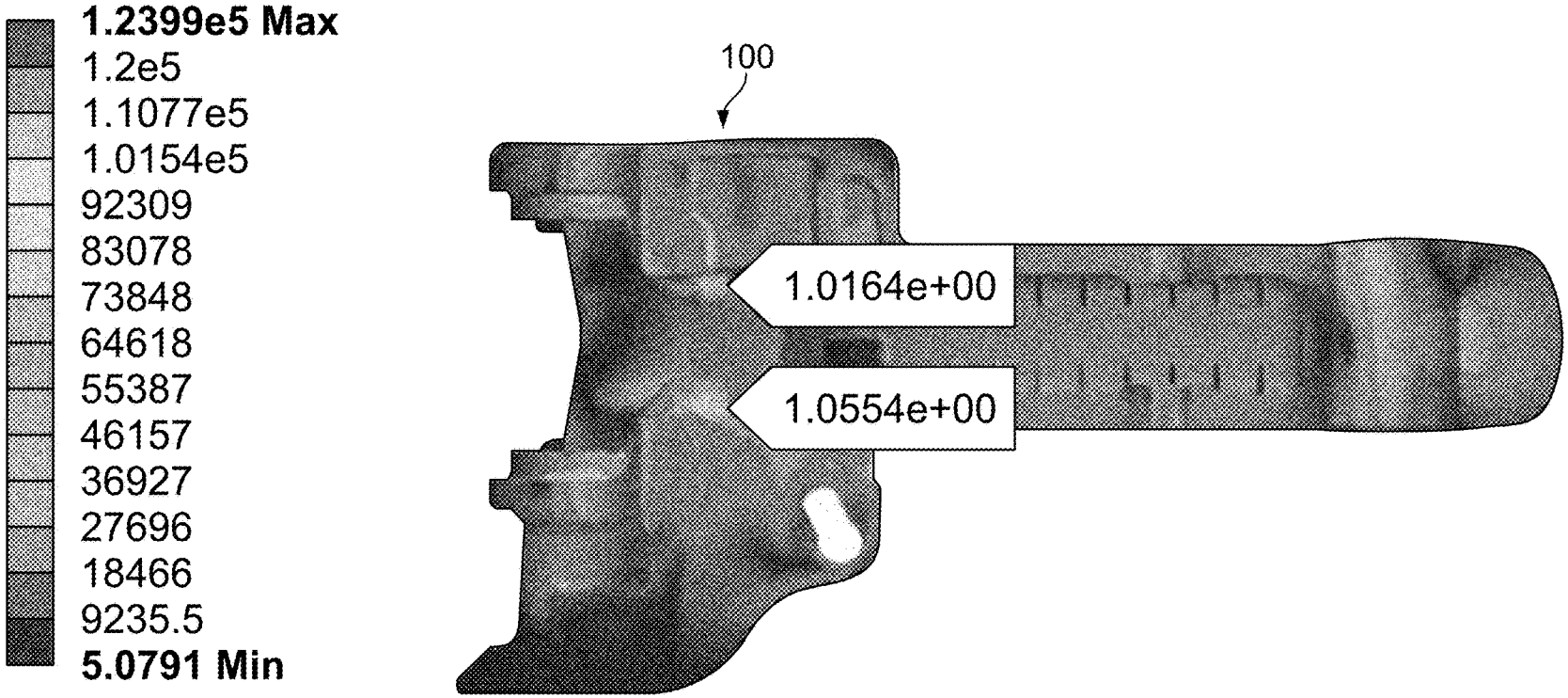
FIG. 16 depicts the stresses acting on a coupler body during a draft condition in accordance with an example discussed herein.

In particular, the coupler body top pulling lug 130*a* and the bottom pulling lug 130*b* are designed for equal strength such that the deformation of the top pulling lug and the bottom pulling lug under a draft load, transferred through the upper knuckle pulling lug and the lower knuckle pulling lug, are substantially equal. For example, FIG. 16 illustrates the stresses acting on a coupler body during draft and shows almost equal deformation of the coupler body upper pulling lug and coupler body lower pulling lug under 900,000 lbs. of draft load. The equal strength of the coupler body top pulling lug and the bottom pulling lug is a product of unique dimensional combination of root cross sectional area of the top pulling lug and the bottom pulling lug, the contact area with the respective knuckle pulling lugs, the side-to-side length of the top pulling lug and the bottom pulling lug, and the height of the top pulling lug and the bottom pulling lug.

II. Features of Example Railcar Couplers According to Examples of the Disclosure In one example, a railcar coupler can include a knuckle having an upper knuckle pulling lug and a lower knuckle pulling lug. A pin can be configured to extend through the knuckle, and the knuckle can be configured to rotate about the pin. The railcar coupler can also include a lock comprising a head and a leg which can be configured to maintain the knuckle in either a locked position or an unlocked position and a lock lift assembly that can be configured to move the lock from a locked position to an unlocked position.

The railcar coupler may also include a thrower configured to move the knuckle from a locked position to an unlocked position and a thrower retaining lug. The thrower may include a lower trunnion and an upper trunnion, and the upper trunnion can define a pivot for the thrower. The upper trunnion can define an outer circumference. The thrower retaining lug is configured to guide the upper trunnion at a contact portion of the outer circumference through a range of motion of the thrower, and the contact portion of the outer circumference can be less than 90 degrees, and, in other examples, can be less than 60 degrees. The thrower retaining lug and the thrower may define an overlapping area such that the thrower is maintained in position in the coupler head regardless of the orientation of the coupler head including when the coupler head is in an upright position and when the coupler head is in an inverted position regardless if the knuckle is an open or closed position. An overlapping distance between the thrower retaining lug and the thrower can be approximately 0.4 in. or more and the overlapping area can be approximately 0.4 $in^2$ or more. The thrower retaining lug can include a first surface and a second surface, and the first surface and the second surface can form an angle of less than 70°.

The railcar coupler may also include a coupler head having a shank and a head portion. The head portion can define a cavity for receiving the knuckle, the thrower, and the lock. The cavity may include a top pulling lug, a bottom pulling lug, a knuckle side lock guide, and the thrower retaining lug. The top pulling lug can be configured to engage the upper knuckle pulling lug, and the bottom pulling lug can be configured to engage the lower knuckle pulling lug to receive loads from the knuckle and can be configured to help balance the loads from the upper knuckle pulling lug and the lower knuckle pulling lug. During operation of the railcar coupler a ratio of the loads between the coupler body top pulling lug and the coupler body bottom pulling lug can be approximately equal to or less than 1.5. The top pulling lug and the bottom pulling lug can be configured to balance the loads received from the knuckle such that the loads and corresponding stresses between the upper pulling lug and the bottom pulling lug are substantially equal. The top pulling lug and the bottom pulling lug can have substantially equal strengths and deformation rates to evenly distribute or receive loads from the upper knuckle pulling lug and the lower knuckle pulling lug to maintain the loads and stresses on the upper knuckle pulling lug and the lower knuckle substantially balanced. Additionally, the upper knuckle pulling lug and the lower knuckle pulling lug can be configured to receive equal reacting loads from the coupler body top pulling lug and the coupler body bottom pulling lug to help increase fatigue lives of the coupler body and the knuckle.

The top pulling lug can include a non-contact side and a contact side, and the top pulling lug can have a substantially uniform thickness from the non-contact side to the contact side. The top pulling lug can define a first end thickness and a second end thickness, and the first end thickness can be substantially equal to the second end thickness. The non-contact side and the contact side can define first and second arcuate paths in a common plane at a predetermined height, and the first and second arcuate paths can be substantially parallel. The top pulling lug can define a top pulling lug length and the bottom pulling lug can define a bottom pulling lug length. The ratio of the top pulling lug length to the bottom pulling lug length can be less than or equal to 1.3.

The top pulling lug can also have a top pulling lug base defining a cross-sectional area larger than a top pulling lug cross-sectional area adjacent to a distal end. In one example, the ratio of the top pulling lug base cross-sectional area to the top pulling lug cross-sectional area adjacent to the distal end can be greater than 2. The bottom pulling lug can have a bottom pulling lug base defining a cross-sectional area larger than a bottom pulling lug cross-sectional area adjacent to a distal end, and in one example, the ratio of the bottom pulling lug base cross-sectional area to the bottom pulling lug cross-sectional area adjacent to the distal end can be greater than 2. In another example, the ratio of the top pulling lug base cross-sectional area to the top pulling lug cross-sectional area adjacent to the distal end can be greater than 2.5. In another example, the bottom pulling lug can have a bottom pulling lug base defining a cross-sectional area larger than a bottom pulling lug cross-sectional area adjacent to a distal end, and the ratio of the bottom pulling lug base cross-sectional area to the bottom pulling lug cross-sectional area adjacent to a distal end can be greater than 2.5. The bottom pulling lug base cross-sectional area can range from 8 $in^2$ to 12.0 $in^2$. In one example, the top pulling lug base cross-sectional area can be approximately 10.5 $in^2$ to 11.5 $in^2$, and the top pulling lug cross-sectional area adjacent to the distal end can be approximately 2.5 $in^2$ to 3.5 $in^2$. The bottom pulling lug base cross-sectional area can be approximately 9.5 $in^2$ to 10.5 $in^2$, and the bottom pulling lug cross-sectional area adjacent to the distal end is approximately 2.5 $in^2$ to 3.5 $in^2$.

In another example, the coupler body bottom pulling lug can have a bottom pulling lug cross-sectional area at the base, and the coupler body top pulling lug can have a top pulling lug cross-sectional area at the base, and a ratio of the top pulling lug cross-sectional area to the bottom pulling lug cross-sectional area can be less than 1.5. In another example, the bottom pulling lug cross-sectional area can be equal to the top pulling lug cross-sectional area.

The bottom pulling lug can converge in the longitudinal direction from the base area to the distal end. A base fillet radius can extend around a majority of the bottom pulling lug base and can extend to a drain hole, an opening for the lock, a bottom buffing shoulder, and a bottom front face.

A contact side of the bottom pulling lug contacting the lower knuckle pulling lug can define a top contact-side fillet radius, a contact-side lock side fillet radius, and a contact-side, thrower side-fillet radius that form a substantially continuous fillet radius in the range of 0.1-0.5 in. extending along the contact side along outer edges of the bottom pulling lug, which starts at the base of the bottom pulling lug on a lock side and continues up in a substantially vertical direction, then in a substantially horizontal direction, then in a substantially vertical direction and ends at the start of a drain hole, and a substantially continuous fillet radius at the base of the bottom pulling lug that bridges the contact-side lock-side fillet radius and the contact-side thrower-side fillet radius. The drain hole can form a substantially continuous fillet radius bridging the contact-side thrower-side fillet radius and a base fillet radius of the bottom pulling lug.

The thrower can be configured to be removed from the coupler head without interference from the bottom pulling lug when aligned up against the bottom pulling lug, the thrower lug and the knuckle side lock guide. In one example, the knuckle side lock guide is positioned about more than 2.75 in. above a thrower support surface on the coupler head.

When the railcar coupler is in the unlocked position, the thrower can overlap with the bottom pulling lug such that the thrower extends over the bottom pulling lug at an area starting from a thrower side of the bottom pulling lug at a base of the bottom pulling lug and extending over a slope starting at a first fillet at the base of the bottom pulling lug and ending at an intersection of a second fillet adjacent the top of the bottom pulling lug and a vertical tangent of the bottom pulling lug. The first fillet radius can be approximately 0.7 in. and the second fillet radius can be approximately 1.125 in.

In one example, during the operation of the railcar coupler a ratio of the stresses between the top pulling lug and the bottom pulling lug can be approximately equal to or less than 1.5. In one example, a stress in the top pulling and a stress in the bottom pulling lug are approximately 120 Ksi in a 900 Kips draft condition.

The top pulling lug can define a top pulling lug contact patch area for contacting the upper knuckle pulling lug, and the bottom pulling lug can define a bottom pulling lug contact patch area configured to engage the lower knuckle pulling lug. The top pulling lug contact patch area for contacting the upper knuckle pulling lug which can be greater than or equal to 1.0 $in^2$. In one example, the bottom pulling lug contact patch area is approximately 1.6 $in^2$. A ratio of the top pulling lug contact patch area to the bottom pulling lug contact patch area can be equal to or less than 1.5. In another example, the ratio of the top pulling lug contact patch area to the bottom pulling lug contact patch area can be approximately 1 to 1. In one example, the ratio of the length to the height of the bottom pulling lug contact patch area can be approximately 5 to 1.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

The invention claimed is:

1. A railcar coupler comprising:

a knuckle having an upper knuckle pulling lug and a lower knuckle pulling lug;

a pin extending through the knuckle and wherein the knuckle is configured to rotate about the pin;

a thrower configured to rotate the knuckle from a locked position to an unlocked position and a thrower retaining lug, the thrower comprising a lower trunnion and an upper trunnion, the upper trunnion defining a pivot for the thrower defining an outer circumference and wherein the thrower retaining lug is configured to guide the upper trunnion at a contact portion of the outer circumference through a range of motion of the thrower and wherein the contact portion of the outer circumference is less than 90 degrees, wherein the thrower retaining lug and the thrower define an overlapping area such that the thrower is maintained in position in the coupler head regardless of an orientation of the coupler head including when the coupler head is in an upright position and when the coupler head is in an inverted position regardless if the knuckle is an open or closed position, wherein an overlapping distance between the thrower retaining lug and the thrower is approximately 0.4 in. or more and wherein the overlapping area is approximately 0.4 $in^2$ or more the thrower retaining lug comprising a first surface and a second surface wherein the first surface and the second surface form an angle of less than 70°;

a lock comprising a head and a leg configured to maintain the knuckle in either a locked position or an unlocked position;

a lock lift assembly configured to move the lock from a locked position to an unlocked position; and a coupler body comprising a shank and a head portion, the head portion defining a cavity for receiving the knuckle, the thrower, the lock lift assembly, and the lock, the cavity comprising a top pulling lug, a bottom pulling lug, a knuckle side lock guide, and the thrower retaining lug, wherein the coupler body top pulling lug is configured to engage the upper knuckle pulling lug and the coupler body bottom pulling lug is configured to engage the lower knuckle pulling lug and to help balance the loads from the upper knuckle pulling lug and the lower knuckle pulling lug, wherein during operation of the railcar coupler a ratio between the loads on the coupler body top pulling lug and the coupler body bottom pulling lug is approximately equal to or less than 1.5;

wherein the top pulling lug comprises a non-contact side and a contact side, the top pulling lug having a substantially uniform thickness from the non-contact side to the contact side, wherein the top pulling lug defines a first end thickness and a second end thickness and the first end thickness is substantially equal to the second end thickness, wherein the non-contact side and the contact side define first and second arcuate paths in a common plane at a predetermined height and wherein the first and second arcuate paths are substantially parallel;

wherein the top pulling lug defines a top pulling lug contact patch area configured to engage the upper knuckle pulling lug and the bottom pulling lug defines a bottom pulling lug contact patch area configured to engage the lower knuckle pulling lug and wherein a ratio of the top pulling lug contact patch area to the bottom pulling lug contact patch area is equal to or less than 1.5;

wherein the top pulling lug has a top pulling lug base defining a cross-sectional area larger than a top pulling lug cross-sectional area adjacent to a distal end and wherein the ratio of the top pulling lug base cross-sectional area to the top pulling lug cross-sectional area adjacent to the distal end is greater than 2.5 and the bottom pulling lug has a bottom pulling lug base defining a cross-sectional area larger than a bottom pulling lug cross-sectional area adjacent to a distal end and wherein the ratio of the bottom pulling lug base cross-sectional area to the bottom pulling lug cross-sectional area adjacent to the distal end is greater than 2.5 and the bottom pulling lug base cross-sectional area ranges from 8 $in^2$ to 12 $in^2$;

wherein the bottom pulling lug converges in the longitudinal direction from the bottom pulling lug base cross-sectional area to the bottom pulling lug distal end, wherein a base fillet radius extends around a majority of the bottom pulling lug base cross-sectional area and extends to a drain hole, an opening for the lock, a bottom buffing shoulder, and a bottom front face;

wherein a contact side of the bottom pulling lug contacting the lower knuckle pulling lug defines a top contact-side fillet radius, a contact-side lock-side fillet radius, and a contact-side thrower-side fillet radius that form a substantially continuous fillet radius in the range of 0.1 in. to 0.5 in. extending along the contact side along outer edges of the bottom pulling lug, which starts at the base of the bottom pulling lug on a lock side and continues up in a substantially vertical direction, then in a substantially horizontal direction, then in a substantially vertical direction and ends at the start of a drain hole, and a substantially continuous fillet radius at the base of the bottom pulling lug that bridges the contact-side lock-side fillet radius and the contact-side thrower-side fillet radius;

wherein the thrower is configured to be removed from the coupler head without interference from the bottom pulling lug when aligned up against the bottom pulling lug, the thrower lug and the knuckle side lock guide and wherein the knuckle side lock guide is positioned at or more than 2.75 in. above a thrower support surface on the coupler head;

wherein when the railcar coupler is in the unlocked position, the thrower overlaps with the bottom pulling lug such that the thrower extends over the bottom pulling lug at an area starting from a thrower side of the bottom pulling lug at a base of the bottom pulling lug and extending over a slope starting at a first fillet at the base of the bottom pulling lug and ending at an intersection of a second fillet adjacent the top of the bottom pulling lug and a vertical tangent.

2. The railcar coupler of claim 1 wherein during operation of the railcar coupler a ratio of stresses between the top pulling lug and the bottom pulling lug is approximately equal to or less than 1.5.

3. The railcar coupler of claim 2 wherein the ratio of the top pulling lug contact patch area to the bottom pulling lug contact patch area is equal to or less than 1.5.

4. The railcar coupler of claim 1 wherein top pulling lug contact patch area for contacting the upper knuckle pulling lug is greater than 1.0 $in^2$ and the bottom pulling lug contact patch area is greater than 1.0 $in^2$.

5. The railcar coupler of claim 1 wherein the top pulling lug defines a top pulling lug length and the bottom pulling lug defines a bottom pulling lug length and wherein the ratio of the top pulling lug length to the bottom pulling lug length is less than or equal to 1.3.

6. The railcar coupler of claim 1 wherein the top pulling lug base cross-sectional area is approximately 10.5 $in^2$ to 11.5 $in^2$ and the top pulling lug cross-sectional area adjacent to the distal end is approximately 2.5 $in^2$ to 3.5 $in^2$.

7. The railcar coupler of claim 1 wherein the bottom pulling lug base cross-sectional area is approximately 9.5 $in^2$ to 10.5 $in^2$ and the bottom pulling lug cross-sectional area adjacent to the distal end is approximately 2.5 $in^2$ to 3.5 $in^2$.

8. The railcar coupler of claim 1 wherein the first fillet radius of the bottom pulling lug is approximately 0.7 in. and the second fillet radius of the bottom pulling lug is approximately 1.125 in.

9. The railcar coupler of claim 1 wherein the upper knuckle pulling lug and the lower knuckle pulling lug are configured to receive equal reacting loads from the coupler body top pulling lug and the coupler body bottom pulling lug to help increase fatigue lives of the coupler body and the knuckle.

10. The railcar coupler of claim 1 wherein the coupler body bottom pulling lug has a bottom pulling lug cross-sectional area at the base and the coupler body top pulling lug has a top pulling lug cross-sectional area at the base and wherein a ratio of the top pulling lug cross-sectional area to the bottom pulling lug cross sectional area is less than 1.5.

11. The railcar coupler of claim 10 wherein the bottom pulling lug cross sectional area at the base is equal to the top pulling lug cross sectional area at the base.

12. A railcar coupler comprising:

a knuckle having an upper knuckle pulling lug and a lower knuckle pulling lug;

a thrower configured to move the knuckle from a locked position to an unlocked position;

a lock comprising a head and a leg configured to maintain the knuckle in either a locked position or an unlocked position; and a coupler body comprising a shank and a head portion, the head portion defining a cavity for receiving the knuckle, the thrower, and the lock, the cavity comprising a top pulling lug, a bottom pulling lug, a knuckle side lock guide and a thrower retaining lug, wherein the coupler body top pulling lug is configured to engage the upper knuckle pulling lug and the coupler body bottom pulling lug is configured to engage the lower knuckle pulling lug and to help balance the loads from the upper knuckle pulling lug and the lower knuckle pulling lug;

wherein the top pulling lug comprises a non-contact side and a contact side, the top pulling lug having a substantially uniform thickness from the non-contact side to the contact side, wherein the top pulling lug defines a first end thickness and a second end thickness and the first end thickness is substantially equal to the second end thickness, and wherein the non-contact side and the contact side define first and second arcuate paths and wherein the first and second arcuate paths are substantially parallel;

wherein the top pulling lug has a top pulling lug base defining a cross-sectional area larger than a top pulling lug cross-sectional area adjacent to a distal end and wherein the ratio of the top pulling lug base cross-sectional area to the top pulling lug cross-sectional area adjacent to the distal end is greater than 2 and the bottom pulling lug has a bottom pulling lug base defining a cross-sectional area larger than a bottom pulling lug cross-sectional area adjacent to a distal end and wherein the ratio of the bottom pulling lug base cross-sectional area to the bottom pulling lug cross-sectional area adjacent to the distal end is greater than 2;

wherein the thrower is configured to be removed from the coupler head without interference from the bottom pulling lug when aligned up against the bottom pulling lug, the thrower lug, and the knuckle side lock guide, and wherein when the railcar coupler is in the unlocked position, the thrower overlaps with the bottom pulling lug such that the thrower extends over the bottom pulling lug.

13. The railcar coupler of claim 12 wherein during operation of the railcar coupler a ratio of stresses between the top pulling lug and the bottom pulling lug is less than 3 to 2.

14. The railcar coupler of claim 12 wherein the thrower comprises a lower trunnion and an upper trunnion, the upper trunnion defining a pivot for the thrower defining an outer circumference and wherein thrower retaining lug is configured to guide the upper trunnion at a contact portion of the outer circumference through a range of motion of the thrower and wherein the contact portion of the outer circumference is less than 90 degrees, the thrower retaining lug and the thrower define an overlapping area such that the thrower is maintained in position in the coupler head regardless of an orientation of the coupler head including when the coupler head is in an upright position and when the coupler head is in an inverted position and regardless if the knuckle is an open or closed position, the thrower retaining lug comprising a first surface and a second surface wherein the first surface and the second surface form an angle of less than 70°.

15. The railcar coupler of claim 12 wherein the top pulling lug base cross-sectional area is approximately 10.5 $in^2$ to 11.5 $in^2$ and the top pulling lug cross-sectional area adjacent to the distal end is approximately 2.5 $in^2$ to 3.5 $in^2$.

16. The railcar coupler of claim 12 wherein the bottom pulling lug base cross-sectional area is approximately 9.5 $in^2$ to 10.5 $in^2$ and the bottom pulling lug cross-sectional area adjacent to the distal end is approximately 2.5 $in^2$ to 3.5 $in^2$.

17. The railcar coupler of claim 12 wherein the ratio of the top pulling lug base cross-sectional area to the top pulling lug cross-sectional area adjacent to the distal end is greater than 2.5 and wherein the ratio of the bottom pulling lug base cross-sectional area to the bottom pulling lug cross-sectional area adjacent to the distal end is greater than 2.5.

18. The railcar coupler of claim 12 wherein during operation the ratio of stresses between the top pulling lug and the bottom pulling lug is approximately 1 to 1.

19. The railcar coupler of claim 12 wherein the top pulling lug defines a top pulling lug contact patch area for engaging the upper knuckle pulling lug and the bottom pulling lug defines a bottom pulling lug contact patch area configured to engage the lower knuckle pulling lug and wherein a ratio of the top pulling lug contact patch area to the bottom pulling lug contact patch area is less than 1.5.

20. The railcar coupler of claim 19 wherein the ratio of the top pulling lug contact patch area to the bottom pulling lug contact patch area is approximately 1 to 1.

21. The railcar coupler of claim 19 wherein the top pulling lug contact patch area is greater than 1.0 $in^2$ and the bottom pulling lug contact patch area is greater than 1.0 $in^2$.

22. The railcar coupler of claim 12 wherein the bottom pulling lug defines a bottom pulling lug contact patch area configured to engage the lower knuckle pulling lug, the bottom pulling lug contact patch area having a length and a height and wherein a ratio of the length to the height is greater than or equal to 3 to 1.

23. The railcar coupler of claim 12 wherein the knuckle side lock guide is positioned at or more than 2.75 in. above a thrower support surface on the coupler head.

24. The railcar coupler of claim 12 wherein a base fillet radius extends around a majority of the bottom pulling lug base and extends to a drain hole, an opening for the lock, a bottom buffing shoulder, and a bottom front face.

25. A railcar coupler comprising:

a knuckle having an upper knuckle pulling lug and a lower knuckle pulling lug;

a thrower configured to move the knuckle from a locked position to an unlocked position;

a lock configured to maintain the knuckle in a locked position; and a coupler body comprising a shank and a head portion, the head portion defining a cavity for receiving the knuckle, the thrower, and the lock, the cavity comprising a top pulling lug, a bottom pulling lug, a thrower retaining lug, and a knuckle side lock guide, the top pulling lug being configured to engage the upper knuckle pulling lug and the bottom pulling lug being configured to engage the lower knuckle pulling lug and to help balance the loads from the upper knuckle pulling lug and the lower knuckle pulling lug, wherein during operation of the railcar coupler a ratio of the loads between the coupler body top pulling lug and the coupler body bottom pulling lug is approximately equal to or less than 1.5;

wherein the top pulling lug has a top pulling lug base defining a cross-sectional area larger than a top pulling lug cross-sectional area adjacent to a distal end and wherein the ratio of the top pulling lug base cross-sectional area to the top pulling lug cross-sectional area adjacent to the distal end is greater than 2 and the bottom pulling lug has a bottom pulling lug base defining a cross-sectional area larger than a bottom pulling lug cross-sectional area adjacent to a distal end and wherein the ratio of the bottom pulling lug base cross-sectional area to the bottom pulling lug cross-sectional area adjacent to the distal end is greater than 2.

26. The railcar coupler of claim 25 wherein the thrower retaining lug and the thrower define an overlapping area such that the coupler can be oriented upside down without the knuckle moving from the locked position to the unlocked position or from the unlocked position to the locked position.

27. The railcar coupler of claim 25 wherein the thrower is configured to be removed from the coupler head without interference from the bottom pulling lug when aligned up against the bottom pulling lug, the thrower lug, and the knuckle side lock guide, and wherein when the railcar coupler is in the locked position, the thrower overlaps with the bottom pulling lug.

* * * * *